US006041561A

United States Patent [19]

LeBlang

[11] Patent Number: 6,041,561

[45] Date of Patent: Mar. 28, 2000

[54] SELF-CONTAINED MOLDED PRE-FABRICATED BUILDING PANEL AND METHOD OF MAKING THE SAME

[75] Inventor: Dennis LeBlang, Kildeer, Ill.

[73] Assignee: Wayne LeBlang, Lincolnshire, Ill.

[21] Appl. No.: 08/916,626

[22] Filed: Aug. 22, 1997

[51] Int. Cl.[7] ..... E04H 1/00

[52] U.S. Cl. ..... 52/234; 52/309.12

[58] Field of Search ..... 52/234, 235, 309.12, 52/583.1, 393, 378

[56] References Cited

U.S. PATENT DOCUMENTS

| | | | |
|---|---|---|---|
| 4,669,240 | 6/1987 | Amormino | 52/236.6 |
| 5,216,863 | 6/1993 | Nessa | 52/439 |
| 5,491,947 | 2/1996 | Kim | 52/426 |

*Primary Examiner*—Beth Aubrey
*Attorney, Agent, or Firm*—Sidney N. Fox

[57] ABSTRACT

The invention provides pre-fabricated self-contained building panels, including a panel incorporating a truss structure as a part thereof, and combinations thereof. The panels include a skeletal assembly comprising generally an array of plural structural steel channels, rigid sheeting proximate to said channels, support members adjacent the rigid sheeting, the channels supported between suitable base plates, angles for defining portions of said skeletal assembly and a forming structure as a part of said skeletal assembly, said skeletal assembly and forming structure being oriented horizontally on a planar surface. A self-hardening material, such as concrete, clay, etc. is introduced to the forming structure for embedding at least a portion of said skeletal assembly. The forming structure becomes an integral part of the completed building panel and is not disassembled therefrom. Angles are included as a part of the skeletal assembly for defining receiving chambers for self-hardening material such as concrete, clay and the like. A building truss including a pair of double-angle struts and a web-reinforcement bar threaded therealong, as well as rigid sheeting arranged to define a receiving chamber for the self-hardening material, is provided and combined as a part of the above mentioned building panels. A moulding and means to enable press-seating thereof in a wet concrete wall are disclosed as is a flexible brick facing also pressed into a wet concrete wall. The skeletal structures function as forms for forming the panel and/or the truss combined therewith. Forms also are described forming various architectural bodies and forms.

85 Claims, 25 Drawing Sheets

10A'
10B'
10C'
10D'
76
76A
76B
76C
77
78
78A
78B
80
80A
80B
80C
84
88
90
90A
90B
92
92A
92B
92C
94
96
100
100A
101
101A
101B
101C
101'
101'A
101'B
101'C
102
103
103'
104
104A
106B
108
108A
110
112
112A
112B
114
114A
116
116A
116B
118
120
120A
124
14

SELF-CONTAINED MOLDED PRE-FABRICATED BUILDING PANEL AND METHOD OF MAKING THE SAME

FIELD OF THE INVENTION

This invention relates generally to pre-fabricated building panels and methods for forming the same and is particularly directed to a pre-fabricated molded self-contained molded building panel and method for forming same, said pre-fabricated molded self-contained molded building panel including a skeletal assembly incorporating an array of spaced steel support structural channels, thermal insulation, reinforcing means, suitable anchor means and additional functional plate means and a forming structure for receiving said skeletal assembly, said skeletal assembly being embedded within said forming structure with said forming structure being incorporated in the finished building panel, said building panel being readily transportable to a construction site for installation in the construction of a building. The invention further relates to building systems utilizing the above mentioned panels including methods for combining said panels for forming said building systems, as well as providing decorative structures for application to the concrete surfaces of said panels.

BACKGROUND OF THE INVENTION

Pre-fabricated building panels have become increasingly popular in the building industry so as to provide a building structure erectable in less time and lower cost than conventional on site construction materials and techniques. Conventional pre-fabricated building wall systems have involved molding techniques which include the teardown of the forming means after the completion of the molding process. The prior art includes many different formations which may be completed at a factory site and shipped to the building construction site for installation. These systems generally offer little flexibility in design and construction. Often the molding techniques employed require the forming structures, i.e. the molds, to be separated from the molded pieces and require a mold or forming structure to be employed for each unit with that forming structure to be disassembled, occasionally destoyed and a new forming structure to be constructed for each piece produced. Not only does such singular forming structure use require the step of forming structure teardown for each building panel formed, resulting in additional expense in time and materials, but also results in reduced productivity of the completed building walls. Other conventional molding methods require the application of mold release materials to the interior walls of the mold structure, yet, in view of the size and weight of the resulting product, still require disassembly of the mold structure. In many instances, different molds must be constructed for the formation of the many varieties in function that must be provided for the completion of the intended buildings. Each change in function for the building wall requires construction of a one-time forming structure dedicated to the production of a single one of the specific function bulding wall. Some building walls must be installed with different footing structures, different framework forms such as including singular and multiple window frames, mounting upon stone beds, concrete footings, caissons, load-bearing frameworks, non-load bearing frameworks, building walls coupled or incorporating joists and joist supports, different types of bearing walls, interior and exterior non-load bearing and load bearing walls, variations in bracing, strapping, spandrel walls, coupling means for joining building wall units and panels together and other functional and constructional variables including variable heights, lengths and thickness.

Another problem encountered with the pre-fabricated wall systems proposed by the prior art is the difficulty in providing access therein for workmen to install in-wall and through-wall services. Further, production of pre-fabricated building walls and panels which offer facility in joining units together in constructing the buildings is another problem encountered with the use of such "prefabs". Integration of inter-related units into the object being constructed also has been more difficult with the available structures and methods presently available to the construction art.

Further difficulty is experienced when considering combinations of different materials such as concrete wall panels with brick and/or brick facing. Such combinations of different construction materials have gained in popularity, where a section of the building being constructed includes concrete exterior walls and, in addition, brick faced sections. Providing pre-fabricated building walls which are combination brick facings and concrete panels is esthetically attractive but difficult and expensive to produce. Means to provide such combinations have not as yet been provided except by the use of embossing a brick pattern upon a concrete surface. The resultant product is far from the esthetic appearance obtained when actual brick is employed. The method and result produced in accordance with the method of the invention enables such contrasting materials to be provided.

Provision of versatile pre-fabricated wall systems and structures at relatively low cost for facile installation and production is a need also not fulfilled by the methods and structures offered by the prior art. Additionally, provision of pre-fabricated cementitious building wall panels which are relatively light in weight yet structurally strong, which can be used as basement walls, foundations, floors and roofs, which are esthetically and physically strong, which can be easily assembled to other of these elements, which are capable of varied attractive appearance, which offer excellent thermal-resistive characteristics and which are capable of multi-level incorporation, likewise has been sadly lacking.

A system that involves fully self-contained pre-fabricated building walls and panels which incorporate the forming structure as a part thereof, yet allows for considerable variation in the their interior, structural content, has not become available despite a long felt need therefor. It is this need that is satisfied with the pre-fabricated building panel system provided by the invention.

Of the plurality of pre-fabricated building walls provided by the prior art, several will be discussed hereinafter to illustrate the state of the art pertinent to the herein described invention. Among these are U.S Pat. Nos. 5,526,629 (Cavaness, Jun. 18, 1996), 5,524,412 (Cori, Jun. 11, 1996), 4,276,730 (Lewis, Jul. 7, 1981), 4,494,353, (Lewis, Jan. 22, 1985, 4,885,884 (Schilger, Dec. 12, 1989), 4,619,032 (Sudrabin, Oct. 28, 1986), 4,930,278 (Staresina et al, Jun. 5, 1990), 4,271,111(Sheber, Jun. 2, 1981), 4,669,240 (Amormino, Jun. 11, 1987), 4,649,682 (Barrett,Jr, Mar. 17, 1987), 4,909,007 (Bodnar, Mar. 20, 1990), 3,885,008 (Martin, May 20, 1975), 4,751,803,(Zimmerman, Jun. 21, 1988), 3,965,635,(Renkert, Jun. 29, 1976), 4,570,398 (Zimmerman, Feb. 18, 1986), 4,605,529, (Zimmerman, Aug. 12, 1986), 3,730,476 (Prichard,Jr. May 1, 1973), 4,934,121, (Zimmerman, Jun. 19, 1990), 5,055,252 (Zimmerman, Oct. 8, 1991), 5,216,863 (Nesssa et al, Jun. 8, 1993) and 5,491, 947 (Kim, Feb. 20, 1996).

Cavaness provides a composite building panel comprising a framework formed of a perimetric frame assembly, an array of plural elongate metal studs arranged parallel and spaced within the frame assembly. Each of the metal studs is of elongate C-shaped cross-sectional configuration with middle section wider than a pair of front and rear right angle flanges, the front one of the flanges being embedded in a concrete slab, the concrete slab defining the front of the panel and the remaining portions of the studs defining open spaces or cavities accessible for installation of services, insulation and means for joining one panel to others.

Once the frame assembly is completed, form members are attached about the perimeter thereof defining a mold for receiving the during the pouring of the concrete defining the concrete slab serving as the front of the panel. The floor of the mold is a forming pad adapted to rest upon a planar surface. The mold is oriented horizontally during the pouring of the concrete into the rear of the panel embedding the front portion of the stud, including the front flange thereof. The mold is knocked down (disassembled) when the curing of the concrete is completed.

The free portions of the stud array define cavities to provide for the installation of the requisite services, i.e. plumbing, electrical wiring and insulation. A wall board can be placed over the rear portion of the frame and attached thereto so that the cavities are covered, the wall board functioning as the interior facing wall of installed panel. The panels can be joined end to end by bolting the end studs forming a butt joint. Increased cost is experienced due to the necessity of disassembling the mold after each panel formation. Incorporation of the additional framework components required for varied functional building requirements would be better served if these varied additional framework portions could be incorporated during the molding process common to all panels. Obviously, it would be most economically benficial if the completed panels could be self-contained as well as versatile, i.e. adaptable for plural functions.

The Cori patent is pertinent to the formation of building panels including a framework comprising a frame member having a top and a bottom plate joined by parallel spaced C-configured studs. A mold is prepared and a layer of hardenable cementations material is deposited in a mold. The frame member is laid on top of the cementations layer and a second cementations layer is applied to embed one side of each stud therein, leaving the remaining portion of the frame open. Once a panel is completed, the mold must be dismantled. Although the patentee states that the mold may be reused, it appears that the more prevalent practice is to use the mold as a one-time use either requiring the application of a mold-release by spraying or destroying the mold during the unmolding. The panels produced are half sections used to form a double walled construction, each panel constituting a half-section combined to form various building walls of a building construction. One difficulty is that the panels produced are substantially identical. The use apparently is to form double walls, leaving a space therebetween, with insulation capable of being installed as foam or loose fiber fill.

Lewis '730 provides wall structure modules comprising a plurality of panels of integral sandwich construction with a thickness of insulation molded between two thicknesses of concrete. These panels are formed with tongue and groove configuration along opposite sides, enabling them to be nested together. Spaced steel studs are encased in each exterior panel and a cap channel fits over and along the tops of the nested panels. A small bracket at the top of the panel which is exposed for the attachment of a top plate. A channeled top plate is fitted over the panels of a completed wall section. The steel studs are provided with spaced openings to permit flow through of the concrete in the forming of the panel. A channeled raceway is secured to the panels horizontally for receipt of piping and electrical conduits opening to the interior surface of panel. Teachings are absent which lead to retention of the molds in the finished panels.

Lewis '353 teaches the provision of load bearing wall sections having frame units formed of metal sections providing interconnected longitudinal frame members and interconnecting means defining a rectangular skeletal frame having an infill of rigid insulation. The metal sections are studs having passageways for reinforcing bars to pass through. The studs are C-shaped with flanges carrying said passageways. Two layers of insulation are fitted along the studs. Although the pouring of concrete to embed a portion of the studs and insulation assembly is taught, there is no disclosure indicating how the concrete is poured, nor do the drawings show the use of concrete, except as a footing (FIG. 13 thereof) to which the panel is bolted. The entire framework is not enclosed in concrete.

Schilger provides a panel functioning as a building component. The panel comprises plural spaced C-shaped metal studs coupled to an rigid insulation board by projecting lugs, the lugs being embedded in a sprayed on concrete layer. A wire mesh reinforcing layer is applied to the concrete layer. An embodiment is illustrated in which the lugs projecting from the inner flanges of the studs are embedded in concrete, and, as well provision is mode to join adjacent panels via butt joints in which the lugs are embedded in a concrete floor. Concrete is poured into a horiztontally oriented form and the beam and formwork assembly is placed upside down in the wet concrete, the wire mesh sinking into the wet concrete until the panel surface engage the wet concrete. The formwork panel, i.e. the rigid insulation board to which the studs are secured by the lugs remains as a part of the final construction but the horizontally oriented form functions as a mold and is detached once the curing of the concrete is completed.

Sudrubin is directed to a thin reinforced wall formed of sprayed concrete and short lengths of glass fibers as a preformed outer shell intended to be exposed to the atmosphere. An inner load supporting structure is secured to the inner surface of the outer shell, said load supporting structure being formed of a metal frame aligned with the inner surface of the outer shell and spaced metal studs. The studs are flanged channel members seated in on their inner flanges in spaced array across the inner surface of the outer shell, each mid-portion of the studs carrying spaced cut-outs to permit concrete to flow therethrough and oriented perpendicular to said inner surface. Plural wire matrices are permanently applied to the inner surface of the outer shell in spaced array adjacent the studs, and cementations material is applied thereover to form raised patches.

A fixture similative of the frame and stud array but having a lower flange thereof of a width generally equal to the width of the patches, is employed as a guide for the installation of the studs and frame are correctly installed.

Concrete is poured into the fixed arrangement of the frame and stud array with the flex-ties properly installed. Other walls may be formed substituting sheet insulation installed within the stud/frame before the concrete is introduced. After the concrete has cured, the resulting panel is tipped along its edge and installed as the building wall.

Finished panels thus are installed but no provision was made for installation of services, etc. after the panels have been erected installation of the load supporting structure. Plural flexible ties are attached to the patches at one of their ends and secured to the respective studs, said ties functioning as "tie-downs". The patches are fixed in position by spraying same with a glass-fibrous material or concrete, and the other of the flexible tie-ends are secured to the wire matrice (and patch), holding the stud (studs) in properly orientated condition.

Staresinna et al provides a composite building panel comprising a slab of cementations fiber reinforced material and a stud framework keyed thereto. The studs are of C-configuration with a flange abutting the inner wall surface of the slab and a plurality of tabs are formed in the flange which project downwardly to key the stud in retaining the slab in the cementations layer. Each stud is formed with a center portion comprising a series of trusses. The slab had been formed by pouring the hardenable material into a suitable casting form, which may be provided with a decorative veneer or which may be discarded. Again the result is a decorative wall panel, but one which apparently lacks versatility.

Sheber does not incorporate metal studs of any form but rather provides a building panel having a wall section, a plurality of concrete reinforcing ribs disposed along an inner surface of the wall section and a plurality of nailing strips anchored along an outermost surface of each reinforcing rib. Reinforcing bars are disposed in the reinforcing ribs. The outer surface of the wall section contains an embossed decorative pattern. Interior wallboard is attached by nails to the nailing strips. The basic wall section is formed in a mold, the decorative formations are rolled onto the concrete surface, the concrete cured and the embossed panel is separated from the mold. The provision of variations in framing structure and the accommodation of installation of services is not considered.

Amormino teaches the formation of a precast concrete building panel formed of inner and outer panel elements with a steel wire mesh embedded through each panel element. A series of laterally spaced continuous steel rod trusses are interposed between the panels and at right angle thereto. An insulating panel is bonded between and overlying the interior side of the panels. Pairs of aligned panels and related corner panels are interconnected by a concrete column poured in situ between adjacent panels. The spaces between the panels function as an air barrier zone. The wire mesh reinforcement does not function as a supporting element. The finished wall panel is formed in a mold and the mold is separated from the finished wall panel after curing of the concrete.

Barrett,Jr. is directed to the provision of a prefabricated building panel which may be filled with a hardenable material which need not have substantial load-bearing characteristics. The panel has a metal load-bearing framework formed of C-shaped cross section placed across the central opening. Means for reinforcement, lifting means, receptacle boxes and interconnecting conduit for said boxes and other service installing means can be installed as desired. Insulating material can be installed in the central opening. The frame is placed in a horizontal orientation on a horizontal surface, a transversely extending lip is formed around both sides of frame. Concrete is poured into the frame, forming a first layer embedding the lower portion of the studs. Insulating material is placed on the first layer and a second concrete layer is poured thereupon. After the concrete layers are hardened, the lip is removed, the lip having functioned as a retainer—a forming mold.

The reinforcing bars can be placed across the central opening of the frame and can be embedded in another concrete poured, another temporary retainer member being installed and after curing, removed. Barrett,Jr. uses these temporary forms for other retaining purposes, and then, teaches the steps of removing these forms once the material retained was hardened.

Bodnar utilizes the stud truss type configuration taught by Staresina et al which has a locking strip defining an acute angle with the first surface of a concrete slab with the flange from which the locking strip is formed being embedded in the cast material. A mold is utilized and discarded after cure of the cast material. The cast "slab" is formed of two layers with wire mesh embedded therein.

Martin also teaches the formation of a frame, here preferably formed of spaced wood studs across the opening of the frame. A retaining mold surrounds the frame and concrete is poured into the mold. The frame can be introduced into the mold prior to the pouring of the concrete or after the concrete had been poured. The mold is removed after the concrete had been cured.

Zimmerman '529 provides a method of forming a prefabricated concrete wall of the type forming a strong, insulated basement wall off-site for later installation. This method employes precast concrete studs with steel reinforcing rods cast thereinto. As the studs are cast, a wood strip is cast onto one elongate narrow edge which eventually functions as a support for fastening dry wall. Fasteners are cast into the opposite edge which will hold the exterior surface. The method comprises orienting the concrete studs horizontally in a frame with the edges exposed and fasteners protrude from the edges, laying rigid insulation within the frame on top of the said edges with the fasteners piercing the insulation, pouring concrete into the enclosure defined by the frame covering the rigid insulation and the fasteners and allowing the concrete to set. Once set, the finished structure is removed from the frame. According the frame must be constructed, placed and then removed . . . not forming a part of the finished structure. The concrete studs are employed for vertical height and strength and cast concrete is applied for sealing and waterproofing the exterior wall.

Zimmerman '803 also forms a prefabricated building wall employing concrete studs. Precast concrete studs with fasteners protruding from one edge thereof is oriented in a horizontal plane. Rigid sheet insulation is attached to the outside of the studs and wire mesh is laid upon the sheet insulation. Concrete is poured onto the insulation, the wire mesh and the protruding fasteners. Top and bottom beams bonded to the studs are formed at the same time as the outer concrete surface is formed. The formation takes place in a mold which is removed after the concrete is cured. The resulting wall is a single integral structure transportable to the site of construction. The result is a fully embedded concrete unit as the prefabricated panel.

Renkert employs a mold form laid horizontally and places bricks at the indicated reception areas of the mold form and applies a layer of a fibrous cementations mixture to the spaced between the bricks and over the tops of the bricks. A lattice work consisting of steel studs arranged in a crossed lattice formation is laid onto the still soft cementations mixture. A resinous insulating material is foamed in situ in the mold cavities formed between the lattice work elements and a finish coat of cementations material is spread over the resinous insulating material by troweling or spraying. After the materials have finshed curing, the mold form is removed. The resulting panel has an outer brick surface, and is insulated. No provision is made for installation of services.

Prichard,Jr provides a unitized reusable form for generally vertical concrete surfaces including plural form panels and metal supporting studs having associated fastening devices. The studs are provided with spaced holes to accept headed snap ties releasably maintained by fastening wedges communicating between the snap tie and the stud. The mold is defined by a pair of spaced wooden sheets retained by vertically oriented bars mounted on opposite sides of the wooden sheets by seating on a cross bar (or stud) array of the exterior studs, said studs carrying clips and waler supports for cross-beams or cross studs. Concrete filler is introduced between the pair of the vertically oriented wooden sheets from the upper end thereof to fill the spaces therebetween.

Zimmerman '398 utilizes precast concrete studs to build a framework of the vertical walls of a basement, rigid sheet insulation being attached to the outside of the concrete studs and wire mesh is attached to the insulation. Concrete is sprayed onto the insulation and wire mesh to form a continuous waterproof outer surface. The forming of such basement wall is performed on the construction site.

In contrast to Zimmerman '398, Zimmerman '121 provides a prefabricated concrete wall structure formed of concrete studs having integrated, interconnecting reinforcing structure comprising a horizontal beam within the stud and cross bars connected to said beams extending inward of the openings of the framework and adapted to be connected ones to the others to define an integrated network. The provision of a shear connector which interconnects the reinforcing rod in the vertical stud to the rods in the top and base beams of the frame. An assembly jig is formed and the framework is formed therein. The jig includes stud molds from which the skeleton of the wall section is assembled.

The studs include holes therethrough at various locations along their length to permit electrical cable and plumbing pipes to pass therethrough after the wall section is installed as a part of a building. In constructing the wall section, the reinforcing rods are arranged and wired together. The stud molds are oriented perpendicular to support members within which concrete is poured. The required network of reinforcing rods is assembled with the stud molds located so only one is located adjacent to the frame member, the internal stud molds of the skeletal framework extending fully between the support members. Then three successive layers is applied to the stud mold framework. The first layer is rigid insulation laid across the entire framework except for the tops of the stud molds and the support members. The next layer is wire mesh to reinforce the to be formed concrete layer. The wire mesh is laid across the entire insulation layer. The final layer is the concrete covering everything. After the concrete hardens, the resulting wall section is lifted from the assembly jig.

Zimmerman '252 is directed to a method of constructing a prefabricated wall structure including the steps of orienting interspaced stud molds, with channel shaped cross section configurations and edges defining an open portion of channel shape, in a horizontal configuration within a framing means so that the edges of the stud molds form uppermost parts of the stud molds and are located within an essentially horizontal plane within the framing means; orienting two parallel support members configured like the above mentioned stud molds but with channel shaped cutouts in one wall of the channel configuration at opposite ends of the stud molds so that the stud molds adjoin the support members at said channel shaped cutouts and the edges of the support members are uppermost and are located in the horizontal plane of the edges of the stud molds. Next, layers of rigid insulation panels are laid within the framing means on top of the edges of the stud molds and support members but not covering the open portions, whereby to form a continuous surface within the framing means. Lastly, concrete is poured into the enclosure formed by the framing means to form the prefabricated wall structure when cured. Thereafter, the wall structure is removed from the framing means, i.e. the "mold".

Nessa et al and Kim each employ interlocking metal panels arranged to form a form-fil wall which is filled with concrete and the form becomes part of the finished wall. Nessa et al provides a formwork including plural interconnectable disposable generally cylindrical metal elements, each consisting of an elongated, thin-walled cylinder-shaped element adapted to be coupled to a next like element, the elements being vertically oriented and filled with concrete forming a row of fused concrete columns. The forms can remain as the external surfaces or can be removed. Kim provides a form-fil concrete wall assembled from a plurality of connected metal wall panels but not formed into cylindrical columns but connected to define a continuous wall having inner and outer panels, concrete being used to fill the spaces between the panels. The form-fil panels are retained to form the finished siding of the resultant wall. The cross-section of the resultant wall is octagonal.

SUMMARY OF THE INVENTION

The invention provides a method of forming a prefabricated self-contained molded building panel using a skeletal assembly, including a forming structure, the assembly of structural steel channels including insulation means and a forming structure as a part thereof, at least a portion of said assembly being, embedded in concrete or other self-hardenable material and the forming structure remaining an integral part of the resulting building panel.

The structural steel channels are provided with holes for receipt of fasteners, reinforcing means and services, said holes providing a pass-through for integrating the concrete or other self-hardenable material into and through the structural steel channels whereby said structural steel channels resist bending under vertical load and under horizontal loads due to wind pressure. Base plate extensions are provided which serve to restrain the flow of the concrete confining the concrete, said extensions extending to the edge of the concrete enabling the panel to be self-contained, enabling the framing structure to be retained in the panel rather than requiring fabrication in a mold which must be separated from the finished unit. According to the invention, the individual finished wall panels, upon curing or hardening, are ready for transport to the construction site and installation at said construction or can be completed at the construction site.

The panel according to the invention enables inclusion of variations of and attachments to the steel stud/concrete framework so as to enable joists to be substituted for or incorporated with the steel studs so that the resultant panel can be installed to any desired pitch or slope of the building roof.

Further, the invention enables the wall panel to be supported on a caisson in lieu of a footing or directly on a stone base. A section of a parapet wall can be combined with a building wall panel of the invention and be installed above the steel joists. Means also are provided to facilitate coupling of individual panels to form a lengthened wall with or without corners.

The invention also provides a novel flexible brick facing, including mouldings alone or capable of being incorporated onto the concrete surface of said building panel enabling the provision of decorative surface patterns on the outside surfaces of the finished wall panels, the said brick facing, including mouldings and other decorative patterns to be applied during the formation of the panels.

Additionally, the invention contemplates partially and/or completely filled panels functioning as joists and/or truss structures formed at the manufacturing plant or on a construction site.

Further, the method of the invention enables the inclusion of windows and doors as a part of the self-contained building wall panels. The building panels according to the invention can be installed as rafters, joists as well as walls as floors and/or disposed angularly oriented for building construction applications.

The invention also contemplates the provision of decorative surface patterns on the inside and/or the outside surfaces of the finished wall panels, the said patterns being applied during the formation of said wall panels.

The invention further provides a pre-fabricated molded combination concrete panel/truss structure, the truss structure thereof being formed of a simplified meeting conventional truss structural requirements yet being easily and economically constructed.

Additionally, the invention provides novel means for assuring the drainage for any moisture penetrating building walls, such as foundation walls for example, at weaknesses such as cracks, fissures or junctions, from the exterior of such building walls, such means capable of being introduced into the earth or stone areas bordering such building walls.

Also, the invention provides for the formation of load carrying beams extending either angular from or parallel to a vertically oriented building wall, said load carrying beams being an intimate part of the building wall.

DESCRIPTION OF PREFERRED EMBODIMENTS

Figure 1:
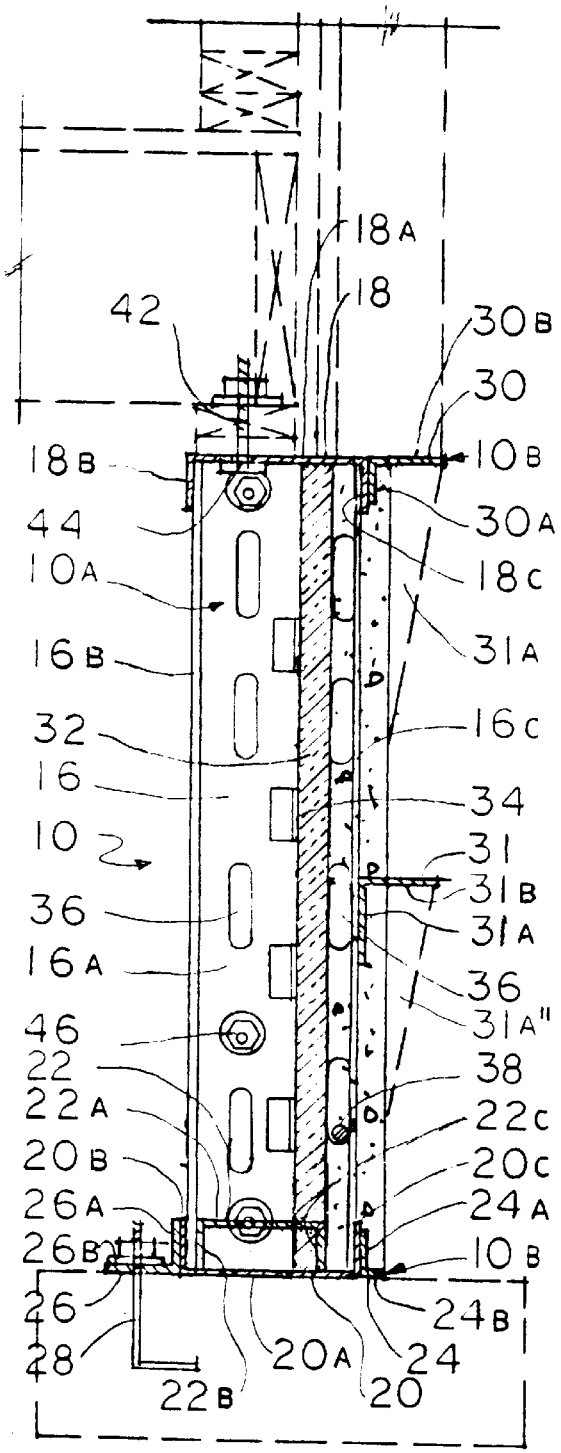
FIG. 1 is a vertical sectional view of the wall panel according to the invention illustrated as installed on a footing.

The prefabricated building panel according to the invention includes self-contained building panels formed of a skeletal assembly encased in a forming structure and embedded in a hardenable material such as concrete, for example. The skeletal assembly is formed of a plurality of spaced parallel vertically arranged steel structural channels with insulation, reinforcing means and means for incorporating additional add-on structure for attaching various structural elements enabling the resulting building panel to be employed for the construction of various building constructions, yet enables off-site formation and transport to a job site ready for installation in a building construction. Completion of the skeletal assembly at a plant site and completion of the concrete fill at the construction site also is enabled and contemplated. The skeletal assembly further includes means for establishing interior flow paths facilitating the passage of the poured concrete into the interstices of the skeletal structure without leaving air-holes or air-pockets within the embedded skeletal assembly and the building panel. The forming structure is retained and is incorporated as a integral part of the building panel.

The building panel according to the invention is capable of functioning as rafters, joists, floors and walls (including basement and foundation walls).

The building panel formed in accordance with the invention can be modified to function not only as a building wall but is a combination of a concrete panel and a truss, capable of forming flat roof as well as an angled roof, basement walls, vertical building walls and foundation walls with unusual strength and substantial load bearing capacity, the resulting building wall can be of height substantially greater than possible when employing conventional prefabricated concrete panels.

The herein invention further involves the provision of a novel, useful and unobvious simple structural truss which can be incorporated as an intimate part of the panel of the invention, but also can be useful for the performance of structural truss functions.

There will be described a flexible brick facing which can be applied to any wet concrete surface for use in providing a decorative surface to a concrete building panel. In addition, there will be described hereinafter, means for providing a building panel with either a perpendicular, angular or parallel load carrying beam formed as an intimate part of a building panel.

The herein invention further is directed to the method of forming the building panel by a molding process in which the selected add on structures are incorporated to produce the self-contained pre-fabricated building panel. The building panel is formed by molding using a forming structure which is incorporated in and retained as a integral part of the building panel, and need not be disassembled or torn down after use.

For the purpose of the description to follow, reference will be made to the skeletal assemblies of the components forming the self-standing components of the panels of the invention, as well as the forming structure employed in the practice of the method of the invention. Each of the panels to be described hereinafter will be designated generally by certain reference numbers. The skeletal assemblies related to each of said panels will be designated generally by reference characters directed related to the generally designated reference characters while the forming structure related to the formation of each of said panels will also be identified by reference characters also directly related to the designated general reference characters employed generally to designate the particular related panel. These general designations will be displayed on each of the respective FIGURES of the drawings. These general designations with their specific relationships to specific panels should prevent any possible confusion in coordinating the specific reference characters to the specific panels.

Referring now to FIG. 1 of the drawings, the building panel according to the invention is illustrated in vertical installed condition and is designed generally by reference character 10. The panel 10 comprises a skeletal assembly designated generally by reference character 10A arranged in a forming structure designated generally by reference character 103 (best shown in FIG. 15) and is embedded in a hardenable material, such as concrete. The skeletal assembly 10A includes plural spaced elongate like structural steel channels 16 vertically arranged in a row, each channel having a web 16A and inside and outside longitudinal edge flanges 16B and 16C; a top steel channeled base plate 18 and a bottom steel base plate 20 functioning as channel retainers. The top base plate 18 has a web portion 18A, an inside flange 18B and an outside flange 18C. The bottom base plate 20 has a web portion 20A, an inside flange 20B and an outside flange 20C. The top base plate 18 is fitted over the upper end of the row of channels 16 while the bottom of the row of channels 16 is fitted within the bottom base plate 20. An elongate angle 24 is arranged along the length of the outside edge flange 20C of the bottom base plate 20, one leg 24A abutting the outside flanges 20C of the bottom base plate 20 and secured thereto preferably by spot welding. The other leg 24B is adapted to rest upon the concrete footing (shown in phantom outline) to which the panel 10 is to be secured. A second angle 26 is arranged along the length of the inside flange 20B of the bottom base plate 20, one leg 26A abutting the flange 20B of the bottom base plate 20 and secured thereto preferably by spot welding. The other leg 26B is secured to the concrete footing (shown in phantom outline) via an anchor bolt, washer and nut assembly 28, the bolt of which being embedded within the said concrete footing. Inverted spacers 22 formed of a web portion 22A and opposite end flanges 22B and 22C are interspersed between the channels 16 to brace the concrete. An angle 30 is secured to the outside flange 18C of the top base plate, leg 30A abutting the structures shown in phantom, said leg 30A being secured to respective flanges 18C and preferably by spot welding. Leg 30B can be formed long enough so as to serve to contain the concrete during the introduction of concrete into the forming structure. The leg 30B can be formed long enough so as to extend horizontally outward sufficiently to function as a ledge for supporting the typical framing of the building, such as brick veneer or building framing (represented by phantom outline), and from the thickened portion 31'.

Angle 31 is located substantially midway along the length of the outer longitudinal edge flange 16 with the leg 31A secured to the outer longitudinal edge flange and the horizontal leg 31B extending outwardly parallel to the leg 30B so as to result in the thickened portion 31A" of the concrete wall resulting when concrete is introduced to the forming structure 10B when the forming structure 10B, with the skeletal assembly 10A therein, is oriented horizontally. The thickened portions 31A supply added strength to the protruding horizontal legs 30B and 31B of angles 30 and 31, and additional support for a taller panel which may be combined with panel 10 in constructing a building.

Rigid sheet members such as rigid insulation boards 32 are arranged between the web portions 16A of the channels 16. Such rigid sheets can comprise a single member of length capable of resting on the inside and/or the outside flanges of each of the row of channels 16. The rigid insulation boards 32 can be supported by punch-out tabs 34 formed in the web 16A of the channels 16 or by small angle members (not shown) which can be secured to web 16A or to the inside surface of the outside flanges 16C of the channels. It should be noted that when the legs 30B and 24B of angles 30 and 24, are formed to extend outward the same distance from the base plates 30 and 24, and serve to restrain the flow of concrete during the introduction thereof the thickness of the concrete layer is defined so that the outer concrete surface is flush with the terminal edges thereof whereby the outwardly facing concrete wall resulting subsequent to introduction of concrete into the forming structure 10B will have a planar surface.

The forming structure 10B comprises the top and bottom base plates 18,20 and their associated angles 24,30, the rigid sheet(s) such as the rigid insulation boards 32, a portion of the web 16A and the outside flanges 16C of the channels 16. Concrete is introduced into the forming structure 10B which fills the forming structure 10B including the cavities between channels, to define the outwardly facing wall. Two rows of spaced flow-through holes 36 are formed spaced along the length of webs 16A of the channels 16, the holes 36 being aligned when the channels 16 are installed between the base plates 18 and 20. Horizontally oriented reinforcing rods 38 can be passed through the holes 36.

Electrical boxes, conduit for other services, etc.(not shown) can be positioned bolted or otherwise secured to selected ones of the channels 16, access being easy to obtain. The embedding concrete extends only along a portion of the web 16A and the outside flange 16C of each channel, the rigid insulation and the outside wall of the completed panel 10. The web 18A of top steel base plate 18 carries a key-shaped passage hole 44 and a bolt 42 of bolt/washer/nut assembly 42 is passed from the interior of the panel through the key-hole 44 and extends outward for coupling the panel 10 to the superstructure of the building (shown in phantom line representation). It should be noted that bolts 46 can be provided passing through the webs 16A of the channels 16 to connect the channels, and, additionally, where the channel 16 is an end channel of the panel, the bolts extend outward of the sides of the panel 10 for use in coupling adjacent panels end to end, when desired.

In forming the panel 10, the skeletal assembly 10A is completed and disposed upon a planar surface in horizontal orientation so that the skeletal assembly 10A with the array of channels 16 is oriented horizontally, with the rigid insulation board 32 and the inside flanges 18B, 20B of the top and bottom base plates engaged with the planar surface and the cavities defined by the channels opening upwardly. The concrete is poured into the upwardly facing side of the forming structure 10B until the level thereof reaches the level of the ends of legs 24B and 30B of angles 24 and 30. The outside of the concrete surface is flush with the ends of said legs 24B and 30B. Where the leg 30B is longer than leg 24B, as shown in FIG. 1, a thickened concrete area 31A is formed, supplying extra strength load bearing capacity for angle 30.

Figure 2:
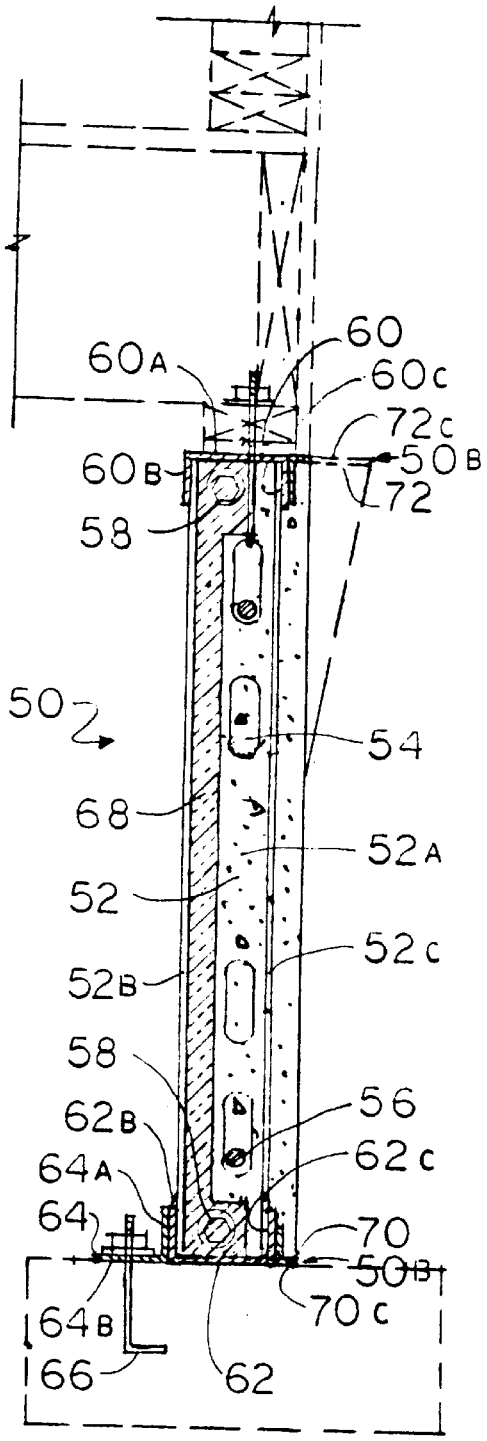
FIG. 2 is a vertical sectional view of a modified embodiment of the wall panel according to the invention illustrated as installed on a footing.

In FIG. 2, a modified embodiment of the wall panel of the invention is designated generally by reference character 50. Panel 50 is similar to panel 10 of FIG. 1 in that panel 50 is thinner and the webs 52A of channels 52 are narrower than the webs 16A of channels 16. Only one row of holes 54 are formed in the webs 52A of the channels 52 to allow the concrete to flow therethrough. The holes 54 are aligned and reinforcing steel bars 56 are illustrated as disposed therethrough. The upper and lower bolts 58 extend outward of the end of the panel 50 serving to fasten the next adjacent panel. Top steel base plate 60 having a web 60A and opposite edge flanges 60B and 60C is secured to the inside and outside flanges 52B and 52C of the channels 52 while bottom steel base plate 62 has inside and outside flanges 62B and 62C respectively. An elongate angle 64 is arranged with the leg 64A abutting the inside flange 62B of the bottom steel base plate 62, secured thereto by spot welding. The leg 64B rests upon the concrete footing (shown in phantom outline) to which said leg 64B is secured by bolt/washer/nut assembly 66, the bolt thereof being embedded in the precast or poured in place concrete footing (shown in phantom outline) extending upward therefrom, tightening of the nut of said bolt/washer/nut assembly 66 securing the leg 64B and the panel 50 to said concrete footing. A rigid insulation board 68 is disposed adjacent the inside flanges 52B of the channels 52. Angle 70 is disposed secured in abutting relation to the outside flanges 62C of the bottom base plates 62 while angle 72 is secured in abutting relation to the outside flanges 60C of the top base plates 60 along the length thereof. The legs 70C and 72C of the respective angles 70 and 72 extend horizontally outward and serve as a part of the forming structure SOB and, like the equivalent legs 24B and 30B of panel 10, function to define a ledge to support the typical brick veneer or building framing (shown in phantom outline). The horizontal extension of leg 72C of angle 72 enables an alternate thickened portion adjacent to the undersurface of said leg 72C to be formed, depending upon the thickness of the wall construction, framing, brick veneer and the like and load applied thereby which will rest on said completed panel 50. The forming structure 50B remains an integral part of the completed panel 50.

Figures 3A, 3B, 3C:
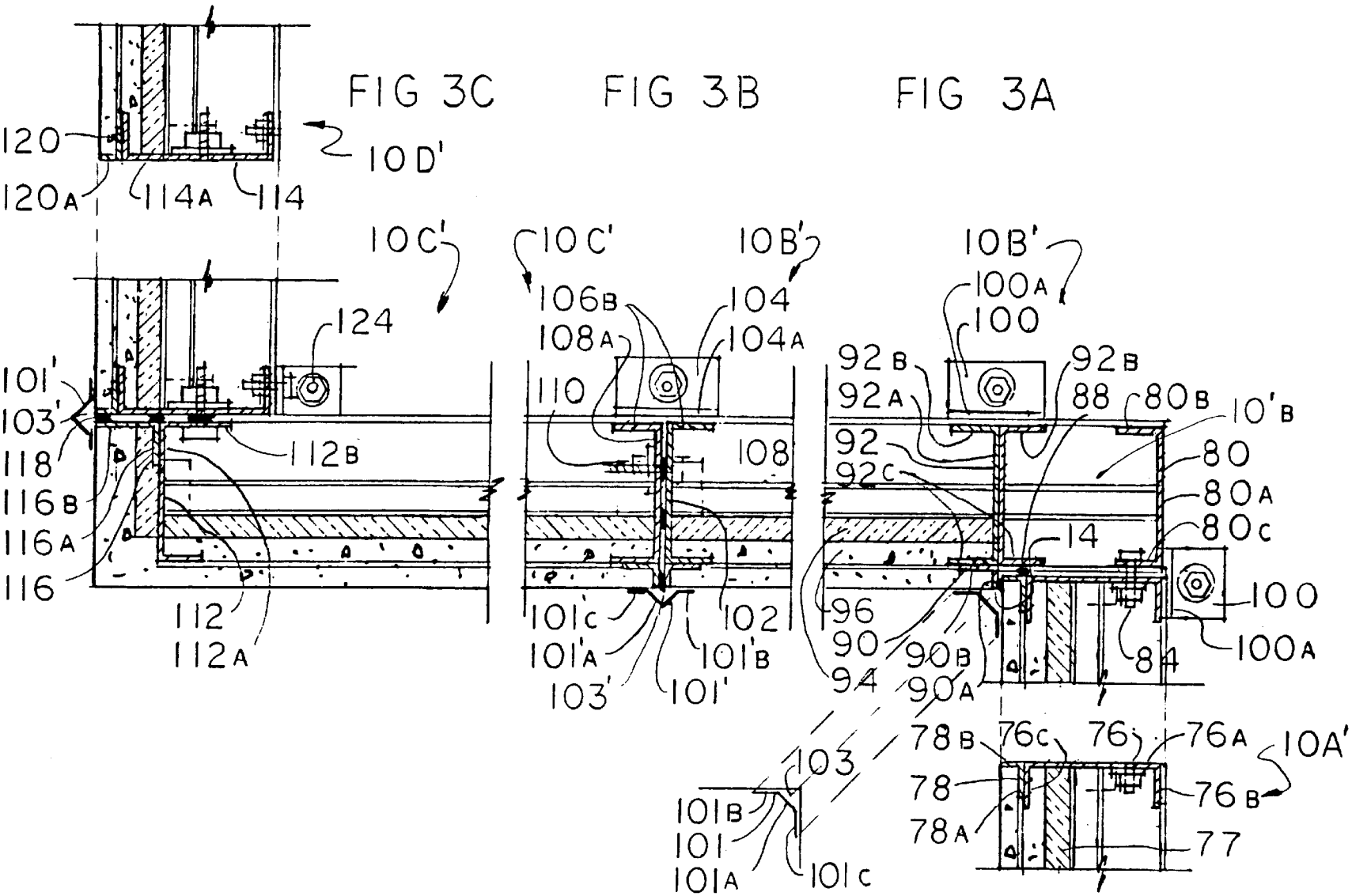
FIGS. 3A, 3B and 3C are fragmentary horizontal plan detail views of wall panels according to the invention illustrating respectively, an outside corner, a butt joint between adjacent wall sections and an inside corner.

Directing attention to FIGS. 3A, 3B and 3C, there are illustrated three junctions between adjacent wall panels. FIG. 3A illustrates a outside corner junction between two wall panels 10A' and 10B' which are arranged to intersect perpendicular at their ends defining a corner and the concrete surfaces are in proximity to each other at a corner; FIG. 3B illustrates a butt joint between two parallel panels 10B', 10C' abutting end to end, the panels being mirror images; and, FIG. 3C illustrates an inside corner, that is a junction of two panels 10C' and 10D' respectively abutting and coupled together.

In FIG. 3A, the channel 76 of panel 10A' has an angle 78 abutting the outside flange 76C thereof with the leg 78A thereof secured thereto, the leg 78B extending perpendicular to the web 76A of said channel 76 and rigid insulation boards 77 seated adjacent the web 76A form a border part of the forming structure thereof. The panel 10A' is arranged perpendicular to the panel 10B'.

Panel 10B' has a channel 80 having a central web 80A, a outer flange 80C and an inner flange 80B. The outer flange 80C is secured to the web 76A of the channel 76 of panel 10A' and is secured thereto via bolt/washer/nut assembly 84 for effecting the connection between the panels 10A' and 10B'. Angle 90 is disposed along the flange 92C of web-to-web double sided channel 92 of panel 10B' with leg 90B secured thereto so that extended leg 90A thereof is parallel to the flange 92C of web-to-web double sided channel 92. Rigid insulation board 94 is seated adjacent the web 92A at panel 10B' and defines a chamber 96 which provides an angular path for concrete introduced into the exterior of panels 10A' and 10B' for filling the chamber 96 and the area of panel 10B' between the rigid insulation board and the forming structure 10'B employed in the formation of panel 10B'. Caulking beads 88 are introduced between web 76 and flange 92C, and between angle leg 90B and flange 92C of panel 10B' as well as between flange 92C of panel 10B' and angle 78B of panel 10A'. An angle 100 is secured to the footing (not shown) with the vertical leg 100A thereof secured to the inner flange 76B of the channel 76 and the web 80A of channel 80. An equivalent angle 100 is secured to flange 92B of the web-to-web double sided channel 92.

An elongate water-stop element 101 is installed adhered to the surfaces along the exterior length of the juncture between panels 10A' and 10B' and closely proximate to the exterior surface thereof. Water-stop element 101 is formed of a central planar web 101A and angular legs 101B and 101C, each of which is installed closely proximate the connection thereof extending along the length of said mid-portion 101A. The water stop element 101, when installed into the earth closely adjacent the said juncture and bridging same functions to define an air chamber or pocket 103 which receives any moisture bleeding through the said juncture or percolating through the area adjacent thereto. The material forming the water-stop element 101 preferably should have fine perforations which would pass moisture through the sides thereof by capillarity to increase the drainage of moisture received from the surrounding ground since the said water-stop element 101 is intended to be installed to reach the depth of the footing (not shown).

In FIG. 3B, a butt joint is established when the end of one panel 10B' is parallel with the adjacent panel 10C'. Caulking beads 102 are applied at the abutting ends of said panels 10B'. An angle 104 is secured to the footing (not shown) bridging the juncture of the abutting ends of said panels 10B' and 10C', with the leg 104A thereof secured to the inner flanges 106B of the respective end channels 108 of said abutting panels, the respective webs 108A of said end channels being secured together by bolt/washer/nut assembly 110.

An elongate water-stop element 101' is illustrated installed adhered to the surfaces along the exterior length of the junction of panels 10B' and 10C' closely proximate the exterior surface thereof. Water-stop element 101' comprises a triangular mid-portion 101'A having opposite arms 101'B and 101'C unitary therewith and extending along the length of said mid-portion 101'A bridging the junction of panels 10B' and 10C'. The water-stop element 101', when installed into the earth closely adjacent said juncture and bridging same functions to define an air chamber or pocket 103' which receives any moisture bleeding from the exterior of the juncture or percolating through the area adjacent thereto. The material forming the water-stop element 101' preferably should have fine perforations which would pass moisture through the sides thereof by capillarity to increase the drainage of moisture received from the surrounding ground since the said water-stop element 101' is intended to be installed to reach the depth of the footing (not shown).

FIG. 3C illustrates an outside and inside corner arrangement of two panels, 10C' and 10D'. The channel 112 at the end of panel 10C' abuts the channel 114 of the end of adjacent panel 10D'. The panel 10C' is disposed perpendicular to the panel 10D' with the steel channel 112. Angle 116 is attached to the web 112A with leg 116A and leg 116B now being coplanar with flange 112B of panel 10C'. Caulking beads 118 are introduced between the leg 120A of angle 120 and the web 114A of panel 10D' and flange 112B and angle 116B. The bolt/washer/nut assembly 124 secures the inner flange 112B of channel 112 of panel 10C' to the web 114A of the channel 114 of the panel 10D'. A water-stop element 101' (described in respect of the juncture of panels 10B' and 10C') is installed closely proximate to the exterior or outside walls of panels 10C' and 10D' which define the corner junction thereof. It should be noted that the air-pockets (chambers) 103 and 103' defined by the water-stops 101' can be filled with fine gravel (stones) to faciliate percolation of water through the air pocket defined thereby.

Figure 3D:
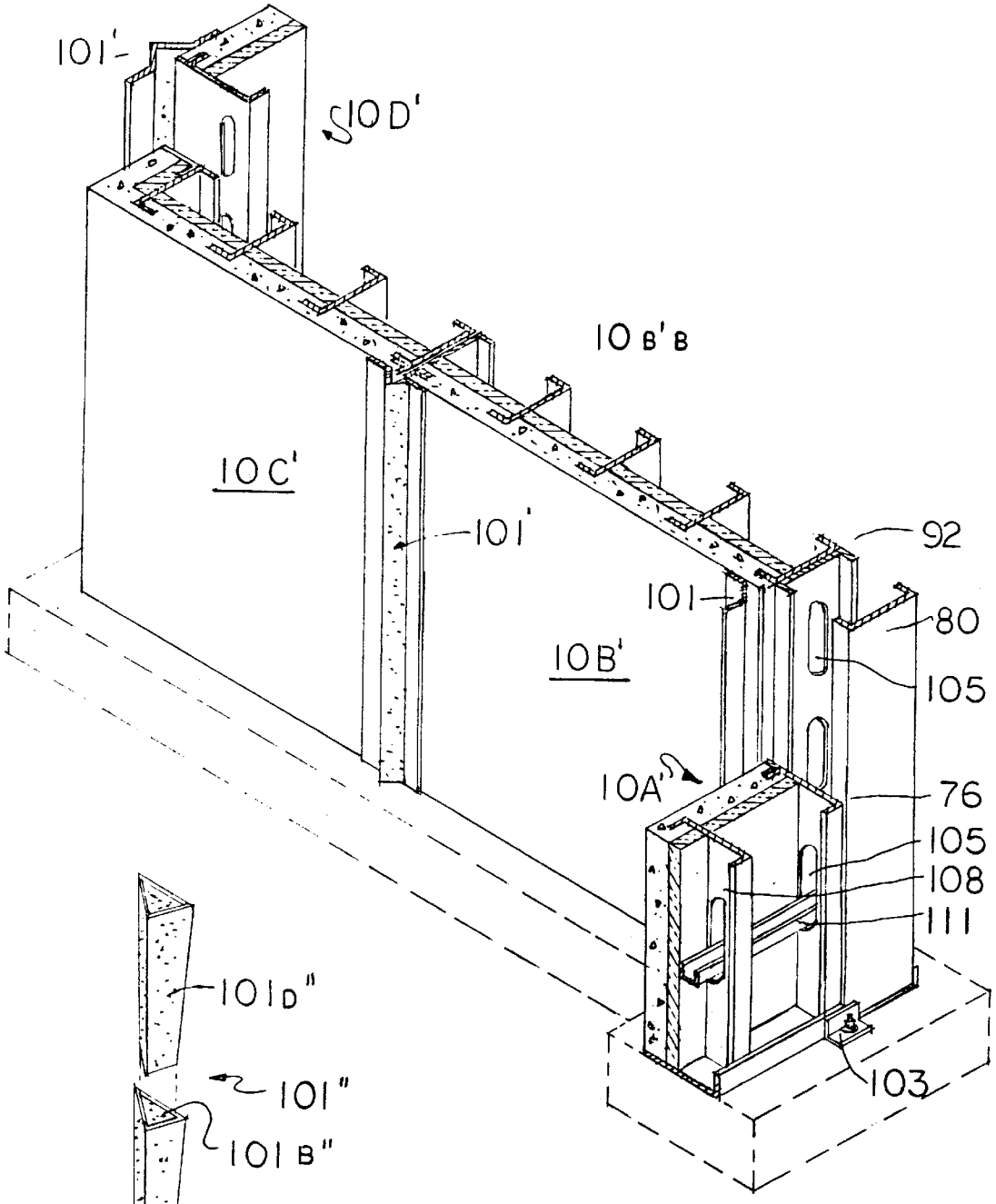
FIG. 3D is an isometric view of a building wall comprising an assembly of the panels illustrated in FIGS. 3A, 3B and 3C, portions broken away to illustrate interior structures.

In FIG. 3D, the wall construction represented in the plan representation in FIGS. 3A, 3B and 3C are shown in isometric representation which illustrates the outside corner of FIG. 3A, the planar section of the wall construction including the butt joint of panels 10B' and 10C' illustrated in FIG. 3B and the inside corner defined by the junction of panels 10C' and 10D' which is illustrated in plan representation in FIG. 3C. Panels 3A' and 3B', at their junction, are illustrated with the associated angle 103 fastened to the concrete footing (shown in phantom outline) and the panels 10A' and 10B' shown with the rows of holes formed in the channels thereof, including the web-to-web channel 92 and further illustrating the imperforate end channel 80. Channel 76 is shown with a narrow U-channeled reinforcing member 111 disposed through the selected hole 105 formed in the channels 76 and 108. The water-stops 101 and 101' are shown installed on the respective surfaces at the junctions between the panels 10D' and 10D', 10C' and 10B' and 10B' and 10A respectively, with the weep-hole 101'A illustrated.

Figure 3E:
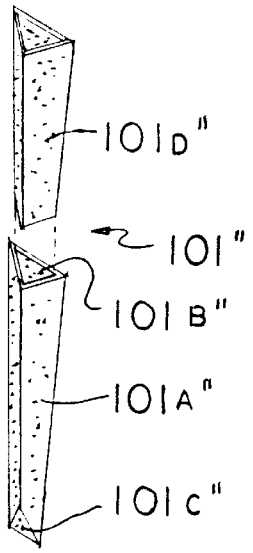
FIG. 3E is an exploded perspective view of a portion of a water-stop element modified from the water-stop element shown installed in FIGS. 3A, 3B and 3D.

FIG. 3E illustrates a further modified water-stop element 101" suitable for installation adjacent an already completed exterior basement and/or foundation wall (not shown). The water-stop element 101" comprises a hollow triangular rigid member 101A" having an open top 101B" and an opposite blade end 101C". A second triangular hollow rigid member 101D" is adapted to be introduced into the open top 101B" of element 101A" and forced therein, preferably by use of a hammer or sledge-hammer, until jammed therein. Additional elements 101" can be introduced so that the combined elements 101D" and 101A" when inter-engaged, reach the depth of the wall, e.g. which could be an exterior basement wall (not shown).

Figure 4:
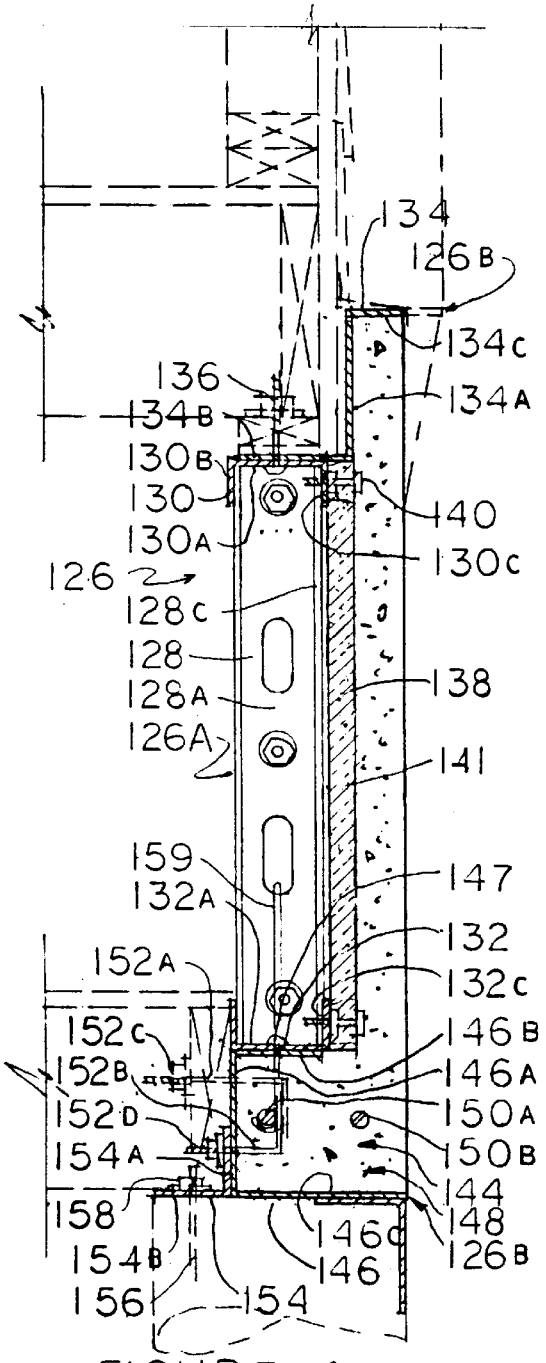
FIG. 4 is a vertical sectional view of a further modified embodiment of the wall panel according to the invention illustrated as installed on a steel cassion.

Attention is directed now to FIG. 4 wherein a modified embodiment of the invention comprise a panel designated generally respectively by reference character 126. Panel 126 is constructed to be seated as a bridge spanning between a series of buried caissons (shown in phantom outline) as well as mounting a suspended wood basement floor (also shown in phantom outline). The skeletal assembly 126A of panel 126 includes the spaced channel array of which the representative channel 128 is illustrated as seated between the top base plate 130 and the bottom base plates 132. A Z-channel 134 having a horizontal leg 134B secured to the web 130A of the top base plate 130, a unitary vertical leg 134A and a unitary horizontal leg 134C capable of functioning as a support for a brick load, if necessary. It is contemplated that the Z-channel 134 can be modified so as to provide the horizontal web 134A with a vertical flange (not shown) unitary with the horizontal leg 134B of the Z-channel 134 depending downardly from the free edge thereof so as to enable the modified Z-channel 134 to function the same as the base plate for the panel 126 in lieu of the top base plate 130 illustrated in FIG. 4, the said vertical flange (not shown) functioning as the inner flange 130B of the replaced base plate 130. The outer flange 130C of said replaced base plate 130 can be replaced with a planar steel flat steel member (not shown) of a width which is the same as the width of said flange 130C.

Frame siding (shown in phantom outline) can be installed on the superstructure (also represented in phantom outline). The remainder of the superstructure of the building construction also is shown in phantom outline and is mounted on the top base plate 130 of panel 126 by the bolt of the bolt/washer/nut assembly 136 which extends through the top base plate 130 and fastened by the washer and nut of said bolt/washer/nut assembly 136. A rigid insulation board 138 is fastened to the outer flange 130C (or the aforementioned equivalent steel flat member (not shown replacing the outer flange 130 when the modified Z-channel is employed in lieu of the replaced top base plate 130) and also is secured to the outer flange 128C of the channel 128 which, as mentioned earlier, is one of the channel array incorporated in the skeletal assembly 126A by double headed screw 140. The rigid insulation board 138 also is secured to the outer flange 132C of the bottom base plate 132 and the outer flange 128C of the channel 128 by a double headed screw 140. A relatively fine air space 141 is defined by the thickness of the flanges 130C (where the aforementioned steel flat plate (not shown) is employed when the modified Z-channel 134 is employed in lieu of base plate 130). This air space 141 is capable of receiving the rigid insulation board 138 when said rigid insulation board is pressed thereinto by the weight of the concrete.

The concrete grade beam 144 is unitary with the panel 126 and is formed of a "C"-channel 146 having an upper horizontal flange 146B, an intermediate vertical web 146A and a lower horizontal flange 146C together defining a chamber or cavity 148 adapted to receive concrete during the introduction of concrete into the remaining pertinent locations within the panel 126. The concrete grade beam 144 functions as an intermediate connector between the buried cassion (shown in phantom line) and the panel 126. The upper horizontal flange 146B of the "C"-channel 146 is connected to the web 132A of the bottom base plate 132 and to the concrete grade beam 144 by weld 147. The concrete grade beam 144 includes a pair of reinforcing bars 150A and 150B extending horizontally therethrough and a pair of L-shaped bolts 152A and 152B which, with the reinforcing bars 150A and 150B, are embedded in the concrete, when filled therewith. The threaded end 152C of bolt 152A extends through the vertical web 146A to engage the floor or other adjacent structure (represented in phantom outline) for connection of the concrete grade beam 144, and the panel 126 thereto. The leg 154A of angle 154 is secured to the web 146A of said "C"-channel 146 with the flange 146C resting upon the upper end of the buried cassion. The threaded end 152D of bolt 152B also extends through the vertical web 146A as well as through the leg 154A of angle 154 and is secured to the adjacent structure, here a suspended wood basement floor (represented in phantom outline). An elongate anchor bolt 156 passes through the leg 154B of angle 154 with its end (not shown) for securing the adjacent structure to the buried cassion. The securement of the leg 154B of angle 154 to the adjacent structure is accomplished by bolt/washer/nut assembly 158. The hook reinforcing rod 159 passes through web 128A and passes through aligned holes in base plate flange 132A and the channel flange 146B, and hooks around the reinforcing bar 150A.

The skeletal assembly 126A of the panel 126, as well as the other panels described or to be described hereinafter are placed horizontally oriented, except for those panels to which concrete is introduced through an open top thereof, and the concrete is introduced to the forming structure 126B for the panels while the skeletal assembly and the forming structure 126B is disposed in said horizontal orientation.

Figure 5:
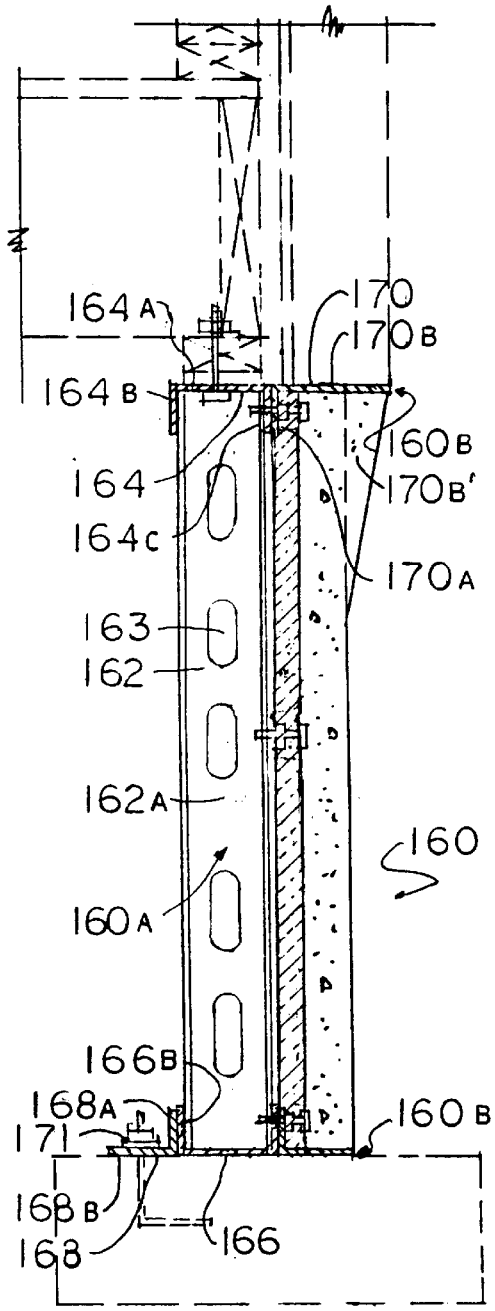
FIG. 5 is a vertical sectional view of an additional modified embodiment of the wall panel according to the invention illustrated as installed on a concrete footing.

A further modified panel of the invention is illustrated in FIG. 5 and designated generally by reference character 160. The panel 160 as seated on a rectangular solid footing (shown in phantom outline) which can be formed of concrete or other suitable material. Panel 160 is similar to panel 126 but differs in that the panel 160 is seated secured to the solid rectangular footing (represented in phantom outline) and that each channel 162 of the channel array is provided with only a single row of spaced holes 163 along the web 162A of said channel 162. Each channel 162 of the channel array included as a part of the skeletal assembly 160A of panel 160 is seated between the top base plate 164 and the bottom base plate 166. The top base plate 164 includes a web 164A, an inside flange 164B and an outside flange 164C. The leg 168A of angle 168 is secured to the inside flange 166B of base plate 166 with leg 168B resting upon the concrete footing (represented in phantom outline). The leg 168B and, hence, the panel 160 is secured to the concrete footing via an L-bolt embedded within the concrete foot and extending outward thereof, said L-bolt being a part of the bolt/washer/nut assembly 171. An angle 170 is secured to the outer flange 164C of the top base plate 164. The leg 170A of angle 170 is secured to the outside flange 164C of the top base plate 164 and leg 170B functions as an extension thereof capable of supporting framing or brick veneer facing (represented by the rectangular phantom outline) and/or other load exerting structure. An area 170B' of thickened concrete is formed supplying extra strength to load bearing angle 170 (similar to the thickened portion 31A described as provided in panel 10). The thickness and size of the steel channel(s) vary depending upon the vertical load if and when additional floor and roof loads are contemplated. The double-headed screws as well as the rigid insulation board, the steel top and bottom base plates and the related angles define the forming structure 160B which remains as an integral part of the panel 126 once the concrete is cured.

Figure 6:
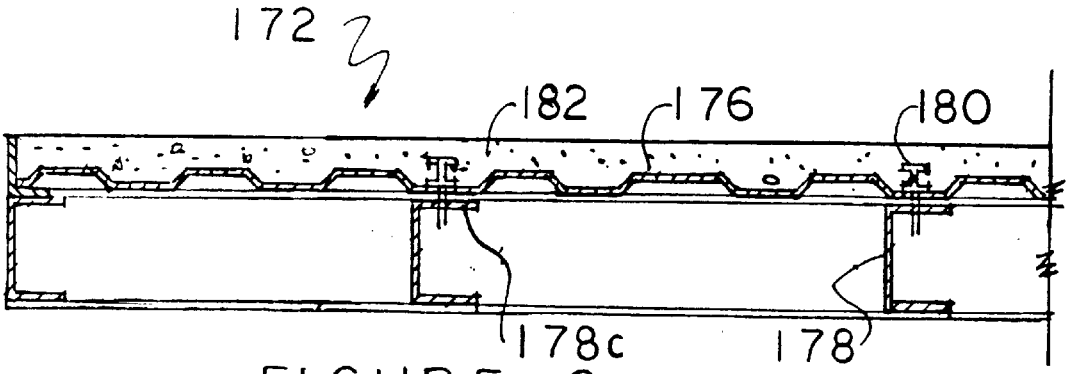
FIG. 6 is a fragmentary plan view of another modified embodiment of the wall panel according to the invention.
Figure 7:
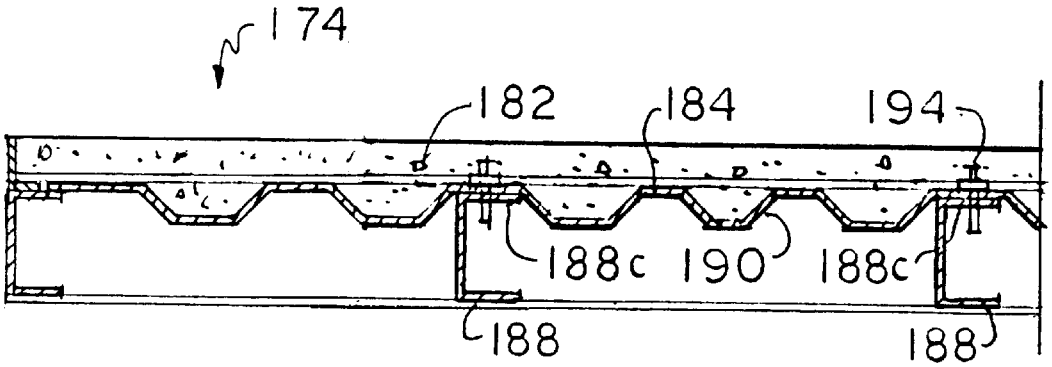
FIG. 7 is a fragmentary plan view of a modified embodiment of the wall panel according to the invention as shown in FIG. 6.
Figure 8:
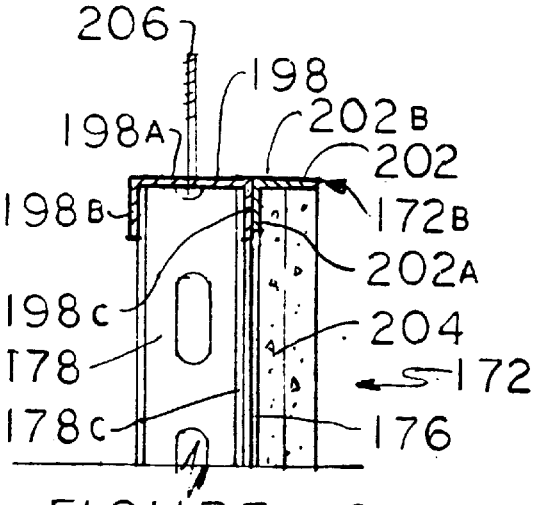
FIG. 8 is a fragmentary vertical sectional view of the wall panel illustrated in FIG. 6.

In FIGS. 6 through 9, there are illustrated modified embodiments of the invention in which the rigid sheeting comprises steel decking instead of the rigid insulation board to provide panels designated generally by reference characters 172 and 174. In FIGS. 6 and 8, the steel decking 176 is applied to the outer flanges 178C of the channels 178 and secured thereto by means of double-headed screw 180 and concrete is poured thereover to form concrete layer 182.

In FIG. 7, the panel 174 is illustrated with the steel decking 184 illustrated as laid upon the outer flanges 188C of the channels 188 with the portions 190 of said decking 184 inserted between the channels 188. The decking 184 is fastened to outer flanges 188C by bolts 194 and concrete is poured thereover to form the concrete layer 182. In respect of panels 172 and 174, a rigid wall board or steel sheet may be interposed between the decking and the outer flanges of the respective channels to provide additional strength.

Figure 9:
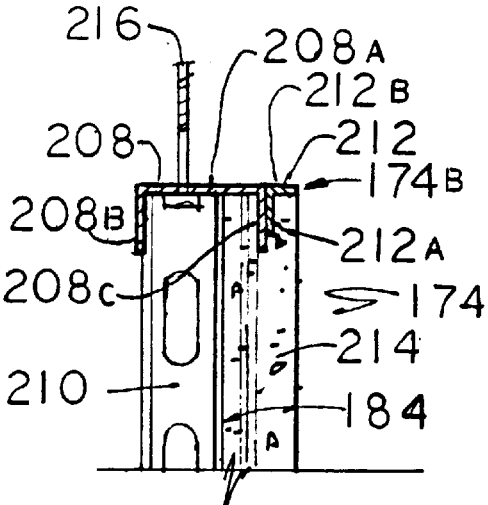
FIG. 9 is a fragmentary vertical sectional view of the wall panel illustrated in FIG. 7.

The ends of each panel 172 and 174 are illustrated in FIGS. 8 and 9 respectively. In FIG. 8, the top base plate 198 having web 198A and inner and outer flanges 198B and 198C respectively, are engaged over the upper end of channel 178. The leg 202A of angle 202 is secured to the outer flange 198C of the top base plate 198. The leg 202B of angle 202 extends outward to define the thickness of the concrete layer 204, said leg 202B being a part of the forming structure 172B when concrete is poured over the decking 176 bounded by the leg 202B. A bolt 206 extends upward through the web 198A of the top base plate 198 of panel 172.

The upper half of panel 174 is illustrated in FIG. 9. In FIG. 9, the top base plate 208 having web 208A and inner and outer flanges 208B and 208C respectively, is engaged over the upper end of channel 210. The leg 212A of angle 212 is secured to the outer flange 208C of top base plate 208 while the leg 212B of angle 212 extends outward to define the thickness of the concrete layer 214 as a part of the forming structure 174B, along with the steel decking 184. A bolt 216 extends upward through the web 208A of the top base plate 208 of panel 174.

Figure 10:
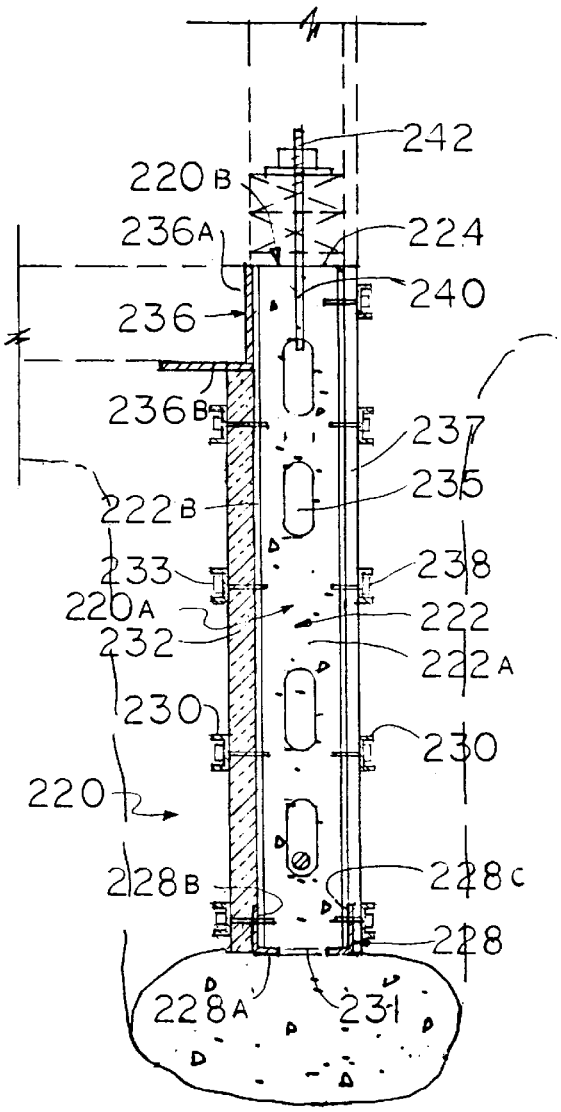
FIG. 10 is a vertical sectional view of a further modified embodiment of the wall panel section according to the invention illustrated as installed below ground level.

Referring now to FIG. 10, another modified embodiment of the building panel according to the invention is designated by reference character 220 and comprises a skeletal assembly 220A formed of plural spaced steel channels 222 arranged in an array and has an open top end 224 and the channel array is seated in an elongate bottom steel base plate 228 having a web 228A, an inner flange 228B and an outer flange 228C, said web 228A having a hole 231 formed therein. A rigid sheet such as rigid insulation board 232 is applied over the inner flanges 222B of the channels 222 of the channel array and secured thereto along with the rigid insulation board 232. Plural cold-rolled narrow support channels 230 are arranged horizontally spaced along the length of the rigid insulation board 232 and are secured to said rigid insulation board 232 and the inner flange 222B of channel 222, the screw 233 also passing through the flange 228B of the bottom base plate 228. An angle 236 having a leg 236A secured to the inner flange 222B of channel 222, the leg 236 being flush with the open end 224 of the panel. The leg 236B extends outward from the inner flange 222B coplanar with the said open top end 224, the leg 236B extending horizontaly outwardly defining a "ledge" for receiving a floor, etc. Each of the channels 222 is provided with at least one row of holes 235 formed along the web 222A thereof.

A rigid wallboard 237 is applied to the outer flanges 222C of the channels 222. The rigid wall board 237 is secured to the outer flange 222C of the channel 222 by screw 238 which passes through the outer flange 222C, the flange 228C of the base plate 238 and the rigid wallboard 237 and fastened thereto by screws 238. The construction of the skeletal assembly 220A of the panel 220 i.e. the assembly of the channel array, the rigid insulation board and the rigid wallboard, the flanges and the angle, takes place when the components of said skeletal assembly 220A are arranged horizontally oriented, when resting on or across a pair of support members (not shown) as a horizontally oriented bridge thereacross or upon a planar surface such as an assembly table (not shown). The said assembly 220A may be completed in horizontal orientation and then placed in vertical orientation.

When the said completed skeletal assembly 220A, which includes the forming structure generally designated by reference character 220B (made up of the skeletal assembly including the base plates, i.e. those portions of said assembly 220A which are embedded in the concrete and the surrounding base plates) and which when concrete is poured thereinto and cured, becomes the panel 220, is arranged first horizontally oriented, and then is placed vertically oriented in a preformed ditch (shown in phantom representation), and only then is the concrete poured into the then open top 224 of said assembled skeletal assembly 220A, including the forming structure thereof. The concrete passes through the plural holes 235 formed in the channel 222 to fill the interior of the panel 220. The concrete will travel gravitationally through the holes 235 carried by the channels 222 not only filling the interior of the panel 220, and passing through the hole 231 formed in the web 228A of bottom base plate 228 forming a unitary concrete footing (shown in FIG. 12). The portion of the ditch surrounding the surrounding the panel 220 generally is filled with stone and/or earth/stone mixture to ground level along the outside of the panel 220. The said portion of the ditch alternatively can be filled with earth to ground level with the concrete footing 282 resting upon the bottom of said ditch.

A threaded rod 240, functioning as the bolt of the bolt/washer/nut assembly 242, is introduced into the open top end 224 of the panel and is embedded in the concrete when same is cured, threaded rod 240 extends upwardly, outwardly to be fastened to means (represented in phantom outline) via said washer/nut elements of the bolt/washer/nut assembly 242, closing off the top end of the panel 220 and/or leading to the construction superstructure (also represented in phantom outline).

The forming structure 220B, when the concrete has filled the interior of the panel and formed the concrete footing and is cured, embedding the skeletal assembly 220A therein, remains as an integral part of the completed panel 220. Thus the forming structure 220B remains with the panel 220 and does not require disassembly or breakdown such as required with conventional molding procedures known to the prior art for forming molded concrete building panels. The leg 236B of angle 236 of the panel 220 is shown extending horizontally outward from a location below the top of the panel 220 and is capable of supporting a floor (an end portion of which is represented by in phantom outline) of the building construction (also represented in phantom outline).

Figure 11:
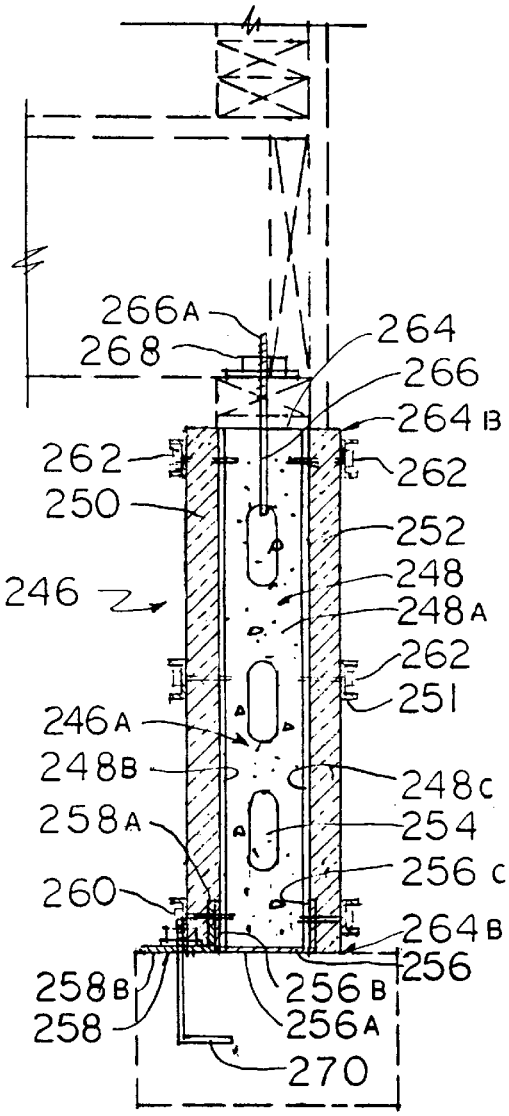
FIG. 11 is a vertical sectional view of a further modified embodiment of the wall panel illustrated in FIG. 10 adapted to be installed on a concrete footing.

The modified embodiment of the invention illustrated in FIG. 11 comprises a panel generally indicated by reference character 246 which also receives concrete poured through the open top thereof. Panel 246 comprises a spaced steel channel array (each channel represented by channel 248 in FIG. 11). A rigid sheet such as a wallboard, a steel board or, as shown in FIG. 11, rigid insulation boards 250,252 are applied on the inner and outer flanges 248B and 248C respectively of the channels 248. The rigid insulation board 252 is applied over the outer flanges 248C of the channels 248 while insulation board 250 is applied over the inner flanges 248B of said channels 248. Each steel channel 248 is provided with at least a row of spaced holes 254 formed in the web 248A of the channel 248. The array of channels 248 is seated within the inner and outer flanges 256B and 256C of bottom steel base plate 256. An angle 258 is disposed along the length of the inner flange 256B of said bottom steel base plate 256, with the vertical leg 258A of said angle 258 disposed between the rigid insulation board 250 and the inner flanges 256B of said bottom base plate 256. A washer screw 260 passes through the rigid insulation board 250, the vertical leg 258A, said inner flange 256B and said inner flange 248B of the channel 248 so as to secure said rigid insulation board 250 to the said inner flanges 256B and 248B. Plural U-shaped elongate cold-rolled narrow support channels 251 are arranged spaced horizontally along the length of rigid insulation boards The said support channels 251. Screws 262 are passed through the support channels 251, the rigid insulation boards 250 and 252 and the respective inner and outer edge flanges 248B and 248C of the channels 248 to secure the rigid insulation boards 250 and 252 in place. The top end 264 of the resulting panel 246 is open. The bottom end of the resulting panel 246 is closed by the web 256A of the bottom base plate 256.

As described in respect of the panel 220 illustrated in FIG. 10, the skeletal assembly 246A of panel 246 can be assembled by placing the components horizontally oriented, say on a planar surface or can be assembled upright or can be installed vertically upright in installed condition. In case of assembly of said skeletal assembly 246A in horizontal orientation, the resulting assembled skeletal assembly, which, of course includes the forming structure as a part thereof, can be tipped from its horizontal orientation to a vertical orientation, whereat the concrete can be introduced through the open top 264 of the assembled skeletal assembly 246A, the concrete passing through the holes 254 carried by the channels 248 to completely fill the interior of said assembled skeletal assembly 246A to form the panel 246 after curing of the concrete embedding the skeletal assembly 246A thereof therein. It should be noted that the web 256A of the steel base plate 256 is imperforate, closing off the bottom end of the panel 246. Further, the forming structure 246B of panel 246 comprises the rigid insulation boards 250, 252, the bottom base plate 256 and the horizontal leg 258B of the angle 258 and remains an integral part of the completed panel 246 subsequent to curing of the concrete.

A threaded bolt 266 functioning as the bolt of bolt/washer/nut assembly 268 is introduced into the concrete interior of the panel 246 through the top end 264 of the panel 246 so that the threaded end 266A thereof protrudes outwardly upwardly through closure member (shown in phantom outline) and be fastened by the washer/nut of the bolt/washer/assembly 268, closing off the top end of said panel 246. The panel 246 can be fastened securely to the concrete or other footing (represented in phantom outline) by means of a L-shaped bolt of the bolt/washer/nut assembly 270 embedded within said footing or otherwise secured thereto. The threaded end of the bolt of said bolt/washer/nut assembly 270 passes through the horizontal leg 258B of the angle 258 and is tightened by manipulation of the nut of said assembly 270. The completed skeletal assembly 246A of panel 246 can be secured to the aforementioned footing prior to the pouring of concrete thereinto or subsequent to completion of the panel, after curing of the concrete. Once secured on the footing, the building superstructure can be coupled to the additional superstructure of the building (represented in phantom outline, including the closure member).

Figure 12:
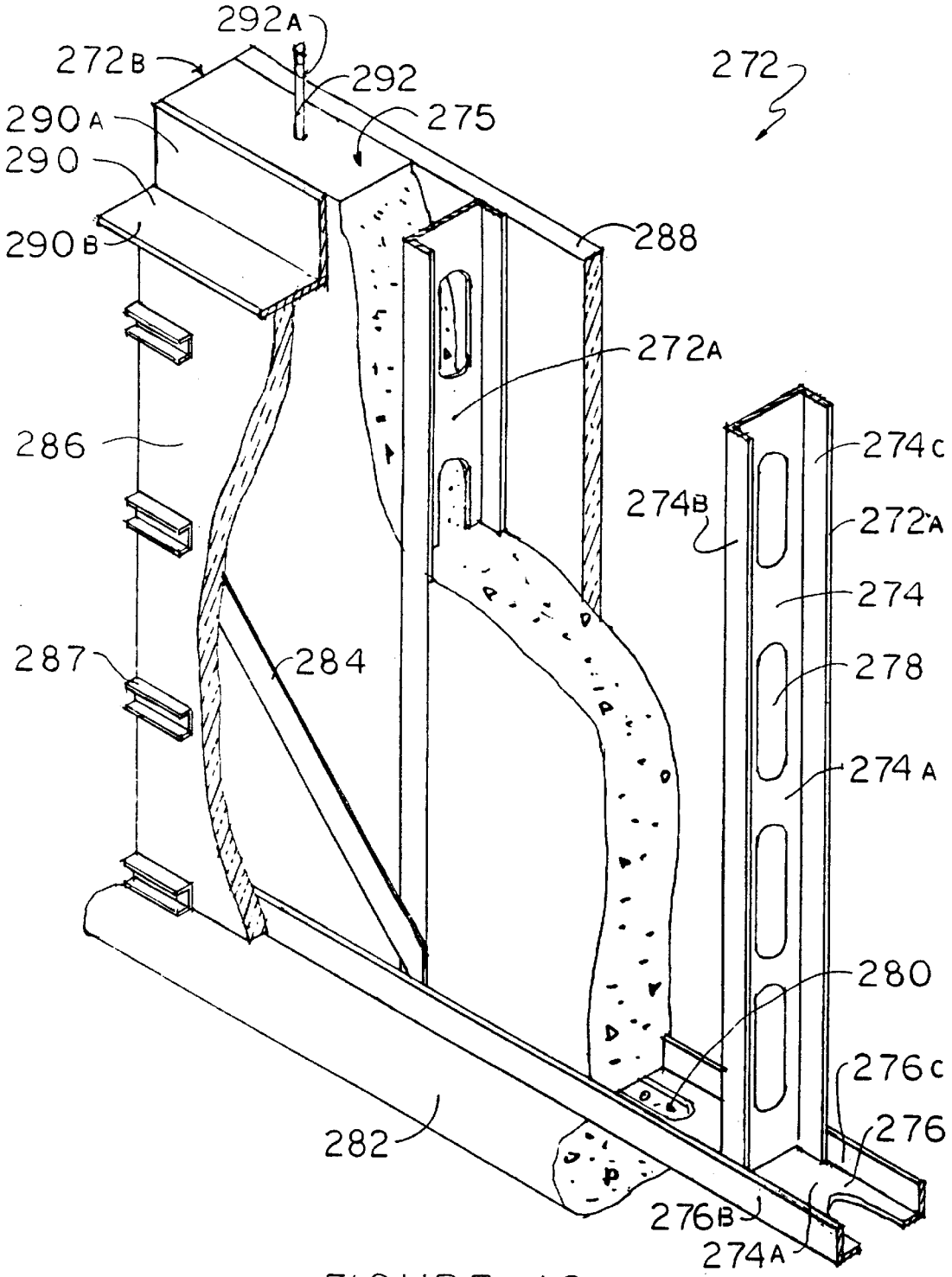
FIG. 12 is an isometric view of modified embodiment of the wall panel according to the invention which is illustrated in FIG. 10, portions broken off to show interior construction and which is not installed below ground.

The panel 272 illustrated in FIG. 12 is identical to the panel 220 illustrated in FIG. 10 except that the orientation of panel 272 in the isometric view of FIG. 12 shows the inner side of said panel at the front of the figure. In FIG. 12, portions of panel 272 are broken away better to view the interior disposition of the component elements of the skeletal assembly 272A thereof. The panel 272 is arranged vertically oriented in installed condition, except that the panel 272 would be installed below ground level in a preformed ditch formed in the ground (as shown in FIG. 10). Several vertically oriented channels 274 of the channel array are visible as seated secured in parallel disposition between the inner and outer flanges 276B and 276C of the bottom steel base plate 276. Each channel 274 is spaced generally equally one from the other with the inner and outer flanges 274B and 274C secured to the inner and outer flanges 276B and 276C of the bottom steel base plate 276.

A series of spaced holes 278 is formed in the web 274A of the channel 274 so as to permit the poured concrete to pass through the open top 275 of the forming structure designated generally by reference character 272B incorporated as a part of the skeletal assembly 272A, passing through said holes 278 and then through the spaced holes 280 formed in the web 274A to form the concrete footing 282. A rigid steel brace 284 is illustrated as disposed diagonally between the inner flange 276B of the bottom base plate 276 and the inner flanges 274B of the channels 274. A rigid insulation board 286 is applied over the surface of the brace 284 and the inner flanges 276B of the bottom steel base plate 276. A rigid insulation board 288 is applied over the outer flanges 274C of the channels 274 and the outer flange 276C of the bottom base plate 276. As described heretofore with reference to FIG. 10, the plurality of the U-shaped elongate cold-rolled narrow support channels 287 are applied horizontally spaced respectively parallel along the length of the rigid insulation board 286 and are secured thereat to said rigid insulation board 286 as well as to both the outer flange 276C of the bottom base plate 276 and to the outer flanges 274C of the channels 274. The support channels 287 also are applied in like disposition on the rigid insulation board 288 but are not visible in FIG. 12.

The rigid insulation board 286 is shorter than the rigid insulation board 288 and is below the top of the top of the upper end of the channel array of channels 274. An angle 290 applied along the upper ends of the inner flanges 274B of the channels 274, the vertical leg 290A thereof being secured to the outer surfaces of said inner flanges 274B, preferably by spot welding. If desired, a thin rigid sheet member (not shown) can be substituted for the illustrated brace 284. The top end of the vertical leg 290A of angle 290 is flush with the top of the channel 274 array, with the horizontal leg 290B of said angle 290 extending outward over the rigid insulation board 286 to define a supporting platform for a concrete floor (as illustrated in phantom outline in FIG. 10). A threaded bolt 292 which functions as the bolt of a bolt/washer/nut assembly (not shown) and was introduced into the concrete interior of panel 272 through the top end thereof so that the threaded end 292A protrudes outwardly upwardly from the top end of the panel 272, said bolt 292 being embedded fixedly in the concrete when same is cured, so as to enable coupling of the completed wall panel 272 to the superstructure of the building (shown in phantom outline in FIG. 10).

Figure 13:
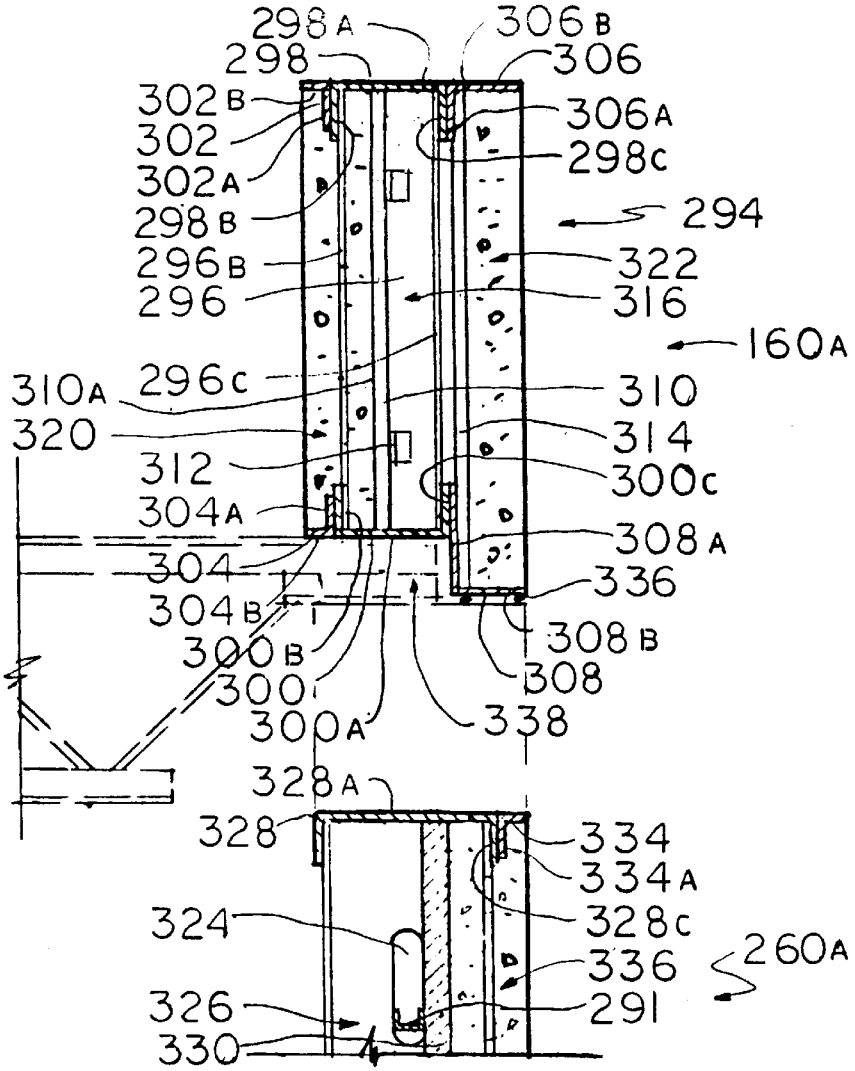
FIG. 13 is a fragmentary detail of the wall panel according to the invention as shown in FIG. 1 and illustrated with a parapet wall employed with a illustrated with a roof of a building construction shown in phantom representation.

In FIG. 13, a modified embodiment of the invention is illustrated as combination of a panel 160A closely similar to panel 160 shown in FIG. 5) and a parapet wall panel 294 adapted to be disposed about the roof of the building being constructed (shown in phantom outline). The parapet panel 294 has an array of spaced vertical steel channels 296 seated between the top steel base plate 298 and the bottom steel base plate 300. The said channels 296 are seated on the web 300A of the bottom steel base plate 300 with the inner surfaces of the inner and outer flanges 296B and 296C of the channels 296 being secured to the inner surfaces of the flanges 298B and 298C of the top base plate 298 and to the inner surfaces of the flanges 300B and 300C of the bottom base plate 300. Angle 302 is disposed adjacent the length of the inner flange 298B of the base plate 298. The vertical leg 302A of said angle 302 being secured, preferably by spot welding, to the outer surface of flange 298B of said top base plate 298. An angle 304 is disposed adjacent the length of the of the inner flange 300B of the bottom base plate 300. The vertical leg 304A of the angle 304 is secured, preferably by spot welding, to the outer surface of the inner flange 300B of the bottom base plate 300.

Angle 306 is arranged adjacent the outer flange 298C of the top base plate 298 along the length thereof with the vertical leg 306A thereof secured, preferably by spot welding, to the outer surface of the outer flange 298C of the top base plate 298. The horizontal leg 306B of angle 306 extends outward from the outer flange 298C. An angle 308 is arranged adjacent the outer flange 300C of the bottom base plate 300 along the length thereof, the vertical leg 308A of angle 308 being secured to the outer surface of said outer flange 300 while the horizontal leg 308B extends outward from said flange 300. The vertical leg 308A is substantially longer than the horizontal leg 308B so as to extend below the level of the web of the bottom base plate 300. The horizontal leg 308B of the angle 308 is the same width as the horizontal leg 306B of the angle 306. The horizontal legs 302B and 304B are of the same width. A rigid wallboard 310 is disposed tightly between the webs 298A and 300A of the top and bottom base plates 298 and 300 and is supported and braced by the punch-out tabs 312 formed in the channel 296 of the channel array. A rigid insulation board can be substituted for the rigid wallboard 310. A second rigid wallboard 314 is disposed against the outer surfaces of the vertical legs 306A and 308A of the top and bottom angles 306 and 308, respectively defining a cavity 316 bounded by the wallboards 310,314 and the top and bottom base plates 298 and 300. The horizontal legs 302B and 304B of angles 302 and 304, with the outer surface 310A of wallboard 310, define a open-faced chamber 320 while the horizontal legs 306B and 308B of angles 306B and 308B, also being of the same width, define, with the rigid wallboard 314, an open-faced chamber 322.

Concrete is introduced first into the chamber 320 to fill same and after the curing of the concrete, concrete is flowed into the chamber 322 and cured, whereby to define the parapet panel 294.

The panel 260A is closely similar to the panel 260 (FIG. 5) differing in the location of the row of holes 324 formed in the channels 326, the width of web 328A of the top base plate 328 and the introduction of the U-shaped plural elongate cold-rolled narrow supporting channels 291 optionally with bridge clips. The supporting channels 291 are arranged horizontally through the selected ones of the holes 324. The said supporting channels also can be disposed connected to the rigid wallboard 330 (or the rigid insulation board, where employed in lieu of the rigid wallboard 330) although not shown in FIG. 13, to protect against malformation of the wallboard or the insulation board instead of using the double-headed screw fasteners shown in FIG. 5. Angle 334 is arranged adjacent the inner surface of the outer flange 328C of the top base plate 328 while the vertical leg 334A of angle 334, secured to the outer surface of outer flange 328C of the top base plate 328 to define therewith a chamber 336 for receiving concrete introduced thereto filling and curing same. The parapet panel 294 is seated upon the panel 260A by placing the horizontal leg 308B of angle 308 upon the top base plate 328 of panel 260A, with cauking 336 introduced therebetween. Thus, a cavity 338 is defined for receiving and supporting the edge portions of a conventional joist shown as a roof (illustrated in phantom outline).

Figure 14:
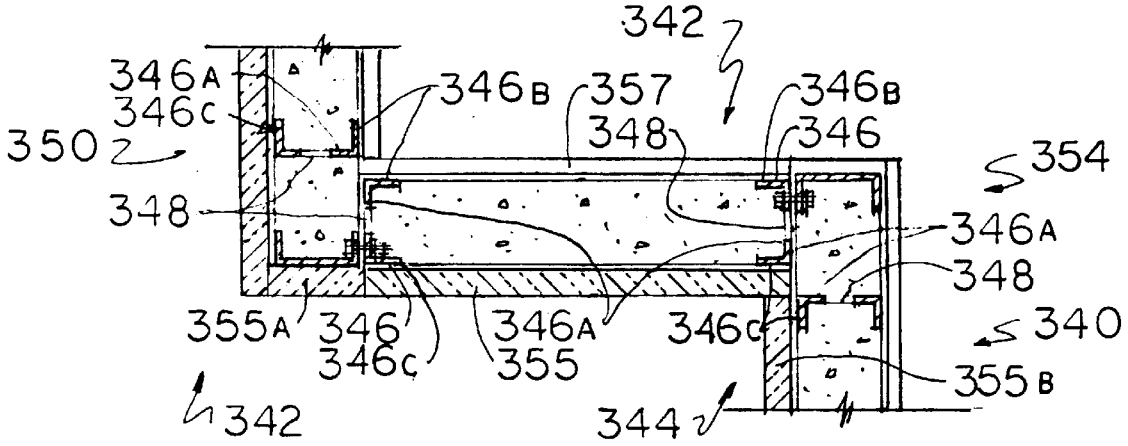
FIG. 14 is a fragmentary plan detail of a wall panel assembly similar to the wall panel illustrated in FIG. 12.

A concrete filled panel arrangement 340 is illustrated in FIG. 14. The panel arrangement 340 has outside and inside corners 342 and 344 showing a change in the direction of the panel arrangement 340. The corners 342,344 are assembled together before the pouring of concrete. The interior channels 346 define the corners 342 and 344, the webs 346A of said channels 346 carrying holes 348 through which the concrete flows through and past the corners 342,344. The interior of the individual panels 350,352 and 354 of the panel arrangement 340 are bordered by rigid insulation boards 355 along the outer flanges 346C of each of the channels 346 and the rigid wallboards 357 secured to the outer surfaces of the inner flanges 346B of said channels 346. A short length 355A of a rigid insulation board 355 is seated between the outer surface of the web 346A of the channel 346 of panel 350, said short length 355B of rigid insulation board disposed along the interior surface of the outer flange 346C of the channel 346 within the panel 354. The interior of said panels are filled completely with concrete so as to embed the channel arrays of the panels 350, 352 and 354 making up the panel arrangement 340.

The method according to the invention for forming the prefabricated panels is described by reference to FIGS. 15 and 16 in which a forming structure designated generally by reference character 358B for the formation of a modified panel according to the invention which is designated generally by reference character 358. Modified panel 358 is closely similar to the panel 10 illustrated in FIG. 1 except for the provision of a header formation 360 and a window opening formation 362 (see FIG. 16) as a part thereof, the skeletal assemblies 360A and 362A of said formations 360 and 362 being included as a part of the skeletal assembly designated generally by reference character 358A for said modified panel 358. The skeletal assembly 358A for modified panel 358 includes an array of the plural equal length elongate channel members 364, a pair of channel members 366 and 368 and a pair of opposite end channel members 370 and 372, each of said channels 364–368 being equal in length and arranged parallel ones to the others. Channels 364 each carry rows of spaced holes formed in the webs 364, and, optionally carrying spaced holes 400 formed in the outer flanges 378 and in the webs 364A of the channels 364. Channels 366 and 368 have imperforate webs 366A and 368A along the portions thereof bordering the window formation 362 but the remainder of said webs 366A and 368A carry holes 400. The outer flanges 378 of said chanels 366 and 368 do carry holes 400 formed therein along the length thereof. The U-shaped plural elongate cold-rolled narrow supporting channels are arranged through selected ones of said holes 400 formed in the respective ones of the channels 364. The opposite end channels 370 and 372 each have imperforate webs. An intermediate channel member 374 which is shorter than the other channel members, is interposed between the pair of channel members 366 and 368, each extending between the base plate 387 and the window opening 362. The intermediate channel member 374 is shorter than as well as equispaced from said pair of channel members 366 and 368. Channel member 374 also carries holes 400 formed in the web 374 as well as in the outer flange 374C. The holes 400 formed where formed in the webs of said channels by comprise one or more rows. All the channel members each have an inner flange represented generally by reference character 376, an outer flange represented generally by reference character 378 and an intermediate web represented generally by reference character 380.

The array of channels are seated within the opposite base plates 386 and 387 cooperating with the opposite imperforate end channels 370, 372 to define an outer frame of the skeletal assembly 358A' of the panel 358. The frame serves with the rigid insulation board and the other components of the skeletal assembly, including the angles, and other surfaces which receive concrete thereon, comprise the forming structure 358B.

The channels 366 and 368 which develop the header opening formation 360 and the window opening formation 362 are single channels, each formed of a pair of channel members like channel members 364 arranged engaged web to web, preferably secured together by spot welding. A pair of spaced parallel cross-channels 382 and 384 are secured between the channels 366 and 368 bridging same to define, with said channels 366 and 368, the header formation opening 360 and the window opening formation 362.

An angle 388 is arranged along the outer flanges 386C, 387C of base plates 382 and 384, the outer flanges 370C of end channels 370, 372 as well as the portions of outer flanges 378 of said channels 382 and 384 disposed between the channels 366 and 368, the horizontal legs 388A of said angle 388 being secured to said respective outer flanges, preferably by spot welding. Each of the outer flanges 378 of channels 364 through 368, including outer flanges 378 of the intermediate channel 374 carrying angle 388. The outer flanges 382C and 384C of parallel base plates 382 and 384 are positioned between channels 366 and 368 and secured to the imperforate webs 366A and 368A thereof for defining the header opening 360 and the window opening 362.

The channels 366–368 and opposite end channels 370 and 372 are seated within top and bottom base plates 386 and 387 having outer flanges 386C, 387C and inner flanges 386B, 387B respectively. Angles 392 and 394 are disposed secured respectively, as by spot welding, to the outer flanges 386C and 387C of said top and bottom base plates 386 and 387. Rigid insulation boards 396 are disposed between each of the channels 364–372 and between the intermediate channel 374 and the adjacent channels 366 and 368, the ends of said rigid insulation boards 396 engaging the opposite webs 386A and 387A of said top and bottom base plates 386 and 387. The said rigid insulation boards 396 are supported by the elongate cold rolled narrow supporting channels 398 passed through the spaced holes 400 formed in the web 380 of each of the channels 364–368, except as noted in the channels bordering the header and window formations 360, 362, and, also are formed in the web of channel 374, with bridge-clip members (not shown) optionally bracing said narrow channels. The rigid insulation boards 396 also can be supported by the punch-out tabs 399 such as formed in the web of the channels 364–368. The inner flanges 386B and 388B of the bottom base plates 386 and 387 rest on the planar surface.

Concrete is poured into the chamber 403 defined by the rigid insulation boards 396, angles 388–394, i.e. the vertical legs 388A–394A thereof, to fill same to the level of the top edges of said legs 388A–394A thereby to form the outer concrete wall, represented by reference character 402, of the completed modified panel 358.

The steps followed in the practice of the method according to the invention are as follows:

1. Construct, assemble and horizontally arrange the skeletal assembly 358A such as described above with respect to the panel 358. While one can utilize a planar surface such as a table, a working platform, etc., one merely can complete the panel while the skeletal assembly 358A is oriented in a horizontal plane, even bridging a pair of spaced supports.

Figure 15:
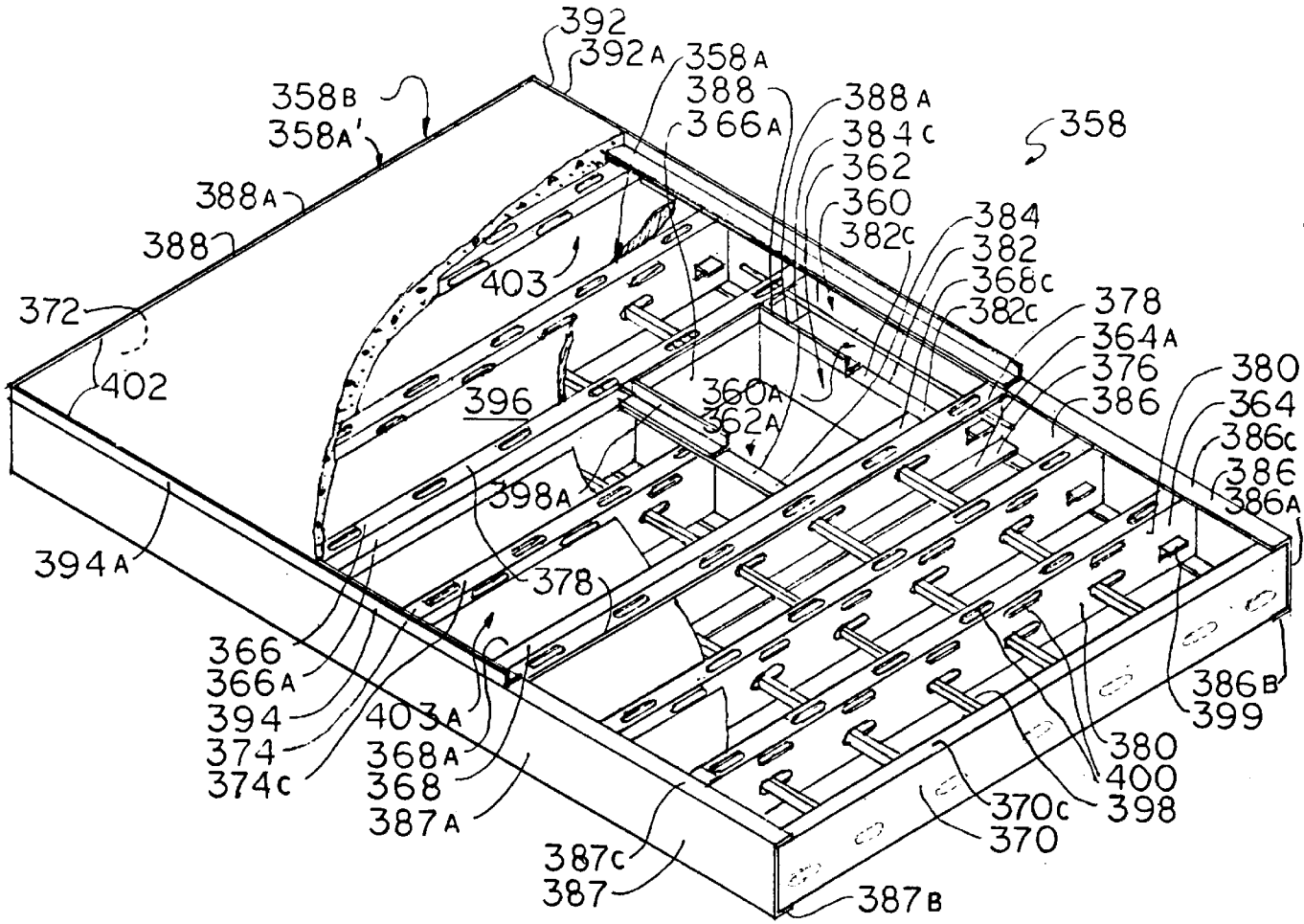
FIG. 15 is an isometric view of the wall panel according to the invention and the forming structure therefor illustrated during the formation of the wall panel according to the method of the invention, portions broken away to show interior structures.

The forming structure generally represented in FIG. 15 by reference character 358B comprises the opposite end channels 370,372 and the upper and lower base plates 386, 387 along with the angles 388,390,392 and 394, as well as the portions of the channels 366,368,382,384 (defining the window opening formation 362 and the header opening formation 360) defining a frame 403A within which the remaining components of the skeletal assembly 358A are disposed, the entire skeletal assembly 358A and the aforementioned frame 403A being oriented horizontally on the planar surface of the table or other working platform, the channel array resting on the inner flanges 364A of the respective channels thereof.

2. Pour concrete into the chamber defined by the forming structure 358B containing the remaining components of the skeletal assembly 358A filling the chamber 403 to form a level planar layer of concrete therein while the forming structure 356 and the said remaining components of the skeletal assembly 358A are horizontally oriented.

3. Permit the concrete to cure.

The forming structure 356 as described thus becomes an integral part of the completed modified panel 358 without disassembly therefrom.

Figure 16:
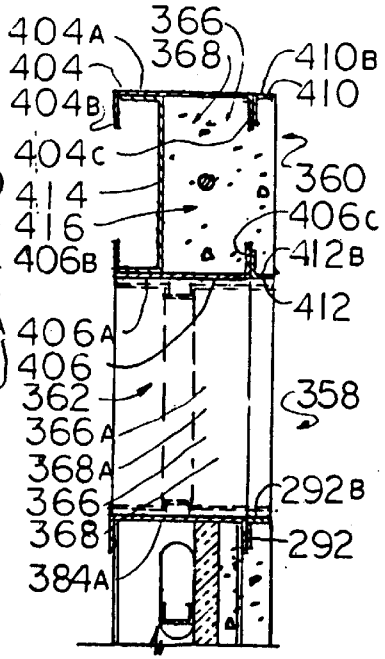
FIG. 16 is a enlarged detail sectional view taken through line 16—16 of FIG. 15 illustrating the structure showing details of the window construction of the wall panel in the process of formation.

Referring to FIG. 16, the header formation 360 of panel 358 as illustrated in said FIG. 16 comprises top and bottom base plates 404 and 406 respectively arranged spaced with the inner and outer flanges 404B, 406B and 404C, 406C respectively directed facing each other. Angles 410 and 412 are placed on the outer flanges 404C and 406C leaving the web 404A of the top base plate 404 and the horizontal legs 410B and 412B of the angles 410, 412 in the same plane. An channel 414 is placed between the top base plate 404 of the wall and the top window base plate 406, defining a chamber 416 defined by said base plates, said angles, and the webs of the channels 366 and 368. The window opening formation 362 is defined by the parallel facing webs 366A and 368A of channels 366 and 368 respectively plus the window sill formation defined by the web 384A and the horizontal leg 292B of angle 292. The window assembly when installed and represented in phantom outline in FIG. 16 is illustrated seated between the header formation and the sill 372.

Figure 17:
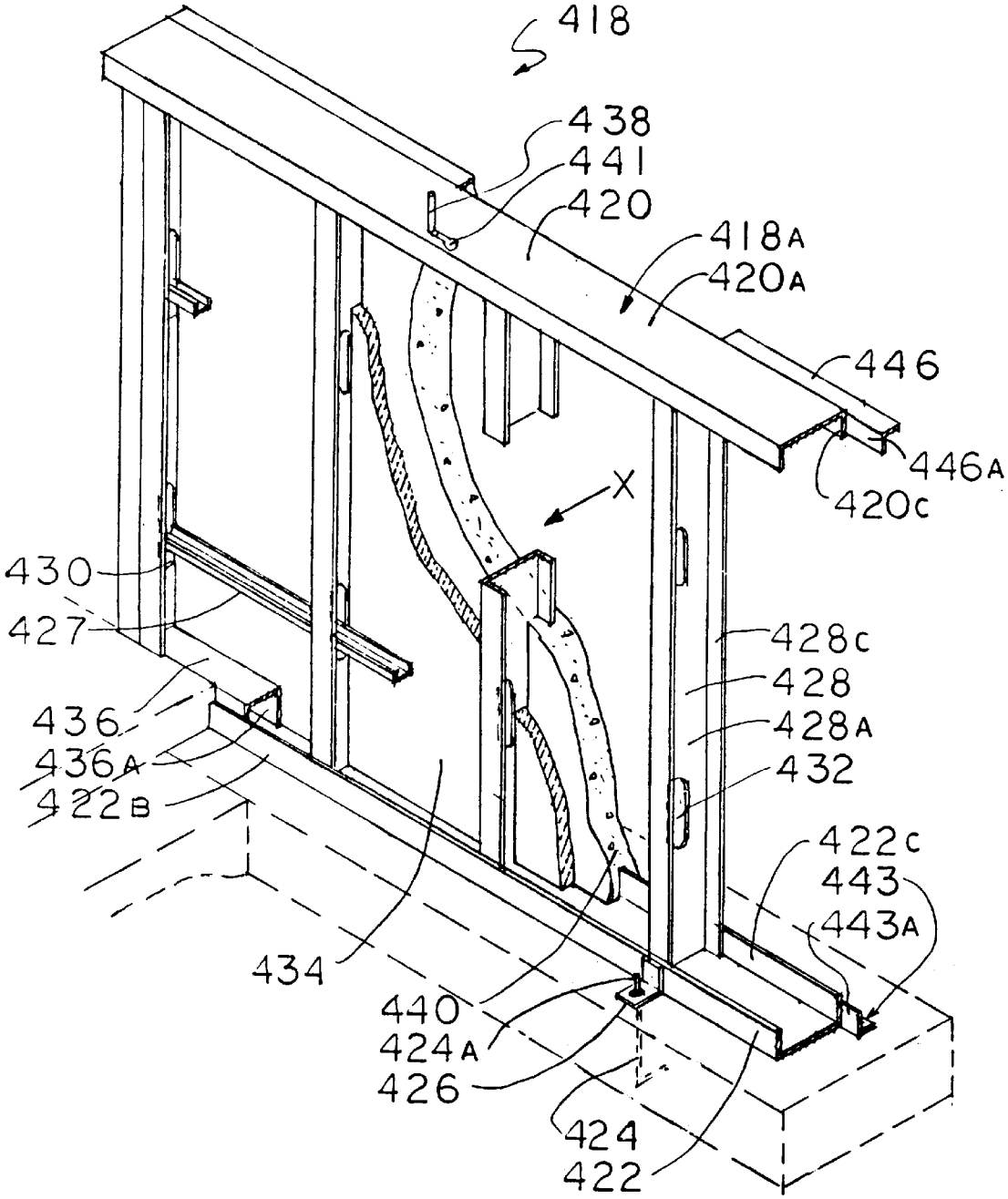
FIG. 17 is an isometric view of the wall panel according to the invention as installed in upright position, portions broken away to show interior structure, the footing and adjacent floor and ground environment being illustrated in phantom representation.

FIG. 17 illustrates a further modified embodiment of the invention represented by panel 418 shown erected in vertical orientation as installed upon a concrete footing shown in phantom outline and further illustrating an interior concrete floor and a representation of a stone fill alongside the concrete footing (shown in phantom outline). The skeletal assembly 418A of panel 418 comprises top and bottom steel base plates 420 and 422 respectively. The panel 418 is secured to the concrete footing by the L-shaped bolt of bolt/washer/nut assembly 424, said bolt being embedded within the footing (shown in phantom outline) and having a threaded end 424A projecting upward, passing through the steel angle 426, the panel 418 being secured by tightening of the nut of the bolt/washer/nut assembly 424. The steel channels 428 are arranged spaced apart and seated within the top and bottom base plates 420 and 422. Reinforcement means in the form of elongate cold rolled narrow U-shaped channels 427 braced with bridge clips 430 are shown passed through the holes 432 formed in the webs 428A of the channels 428. Rigid insulation boards 434 are arranged between the top and bottom base plates 420 and 422, and adjacent the holes 432, braced and secured by punch-out tabs (not shown in FIG. 17) also formed in the web 428A of channels 428. A U-shaped spacer 436 is placed inverted between the channels 428, the arms 436A thereof disposed closely adjacent both the rigid insulation boards 434 and the inner flange 422B of the bottom base plate 422. An anchor bolt 438 passes through key-hole opening 441 formed in the web 420A of top base plate 420 and extends outwardly upwardly to provide means for grasping the finished panel wall 418 to enable transport and installation thereof. The key-hole opening 441 can be provided without the anchor bolt, permiting a hook or the like to lift the finished panel for transport. In fact, additional key-holes can be provided to enable connection to various commercial lifting means (not shown) to be employed for lifting the finished panel.

A steel angle 443 is provided adjacent the length of outer flange 422C of the bottom base plate 422 with the vertical leg 443A secured to outer flange 422C thereby forming a concrete receiving chamber with the vertical leg 446A of angle 446 secured to the outer flange 420C of the top base plate 420 along the length thereof so that a flat concrete surface can be obtained after the concrete is introduced to the skeletal assembly 418A embedding the outer flanges 428C of the channels 428 and the outer flanges 422C and 420C of the bottom and top base plates 422 and 420 as well as the vertical legs 443A, 446A of the bottom and top angles 443 and 446.

Concrete is introduced in a direction indicated by arrow X when the skeletal assembly 418A is oriented horizontally. The resulting prefabricated wall panel 418 is completed when the curing of the concrete is completed. The completed panel wall 418 then is ready for transport as a self-contained unit to the construction site for installation. The pouring of the concrete can be effected at the job-site or when the skeletal assembly 418A is installed horizontally in installations where the panel is to constitute a floor.

Figure 18:
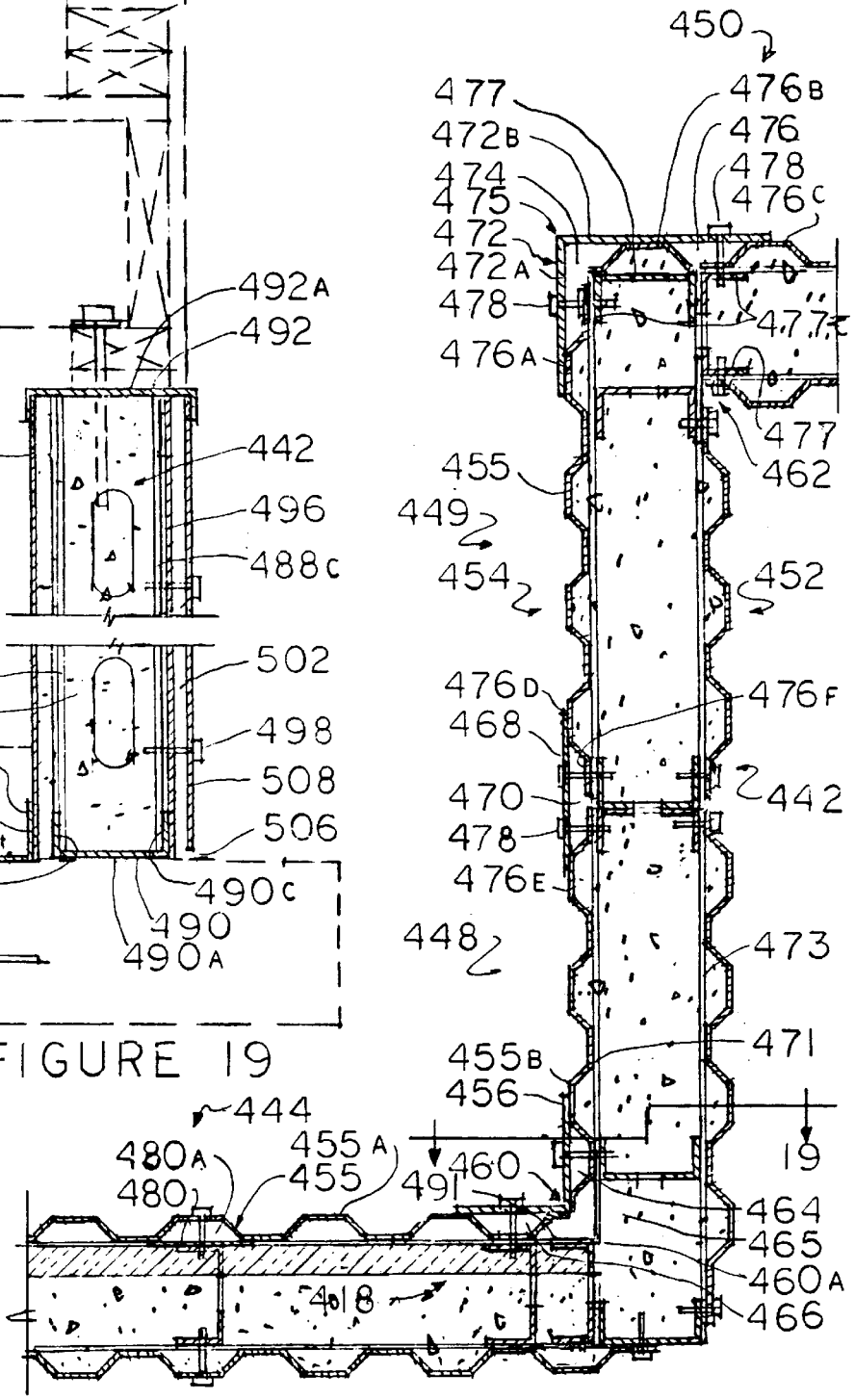
FIG. 18 is a plan view of an installation of further modified embodiments of the wall panel according to the invention, including a pair of corner structures illustrating inside and outside changes in wall direction.

An additionally modified embodiment of the invention is illustrated in FIG. 18 comprising the panel construction generally designated by reference character 442. Panel construction 442 is formed of a series of individual panels 444, 448, 449, 450 arranged joined end to end to define an inside and outside change of direction. Each of the panels 444–450 have an interior side 452 and an exterior side 454, each formed of steel decking of the type illustrated in FIGS. 6 and 8. Steel angle 456 is secured to the outer ribs 455A and 455B of the steel decking 455 and defines the outside corner 460 of the panel construction 442 as well as also defining vertically extending air-chambers 464, 465 and 466 at the outside corner 460. An angle (not shown) can be secured at corner 460A along the juncture of the flanges 491 of the base plate (not fully shown, the outer flanges of which are designated by reference character 471 and the inner flanges of which are designated by reference character 473). Angle 472 is secured to outer ribs 476A, 476B and 476C of the steel decking 455 and defines another outside corner 475 defined by the junction of the panels 449 and 450 of the panel construction 442. The legs 472A of angle 472 is secured to the rib 476A of the decking 455 and defines vertically extending air-chamber 474. The leg 472B of angle 472 is secured to the ribs 476B and 476C of the decking 455 and defines vertically extending air-chamber 476. Bolts 478 secure the angle 472 to the inner ribs of the decking and to the outer flanges 477C of the end channels 477 of panels 449 and 450 of the panel construction 442. A steel plate 468 is placed against the outer ribs 476D and 476E of the decking 455 and secured to the inner rib partial portions 476F of the decking 455 by bolts 478 bridging the butt joint of adjacent panels 448 and 449 and defining the vertically extending air-chamber 470 so as to protect the outside facing portion of the butt joint of panels 448 and 449 from water penetration from the exterior of said butt joint of said panels 448 and 449. The vertically extending air-chamber 470 protects the outside portion of the juncture between the panels 448 and 449. A metal strap 480 can be placed between the outside facing and the inside facing ribs of the decking to create an air-chamber 480A at any bolt connection.

Figure 19:
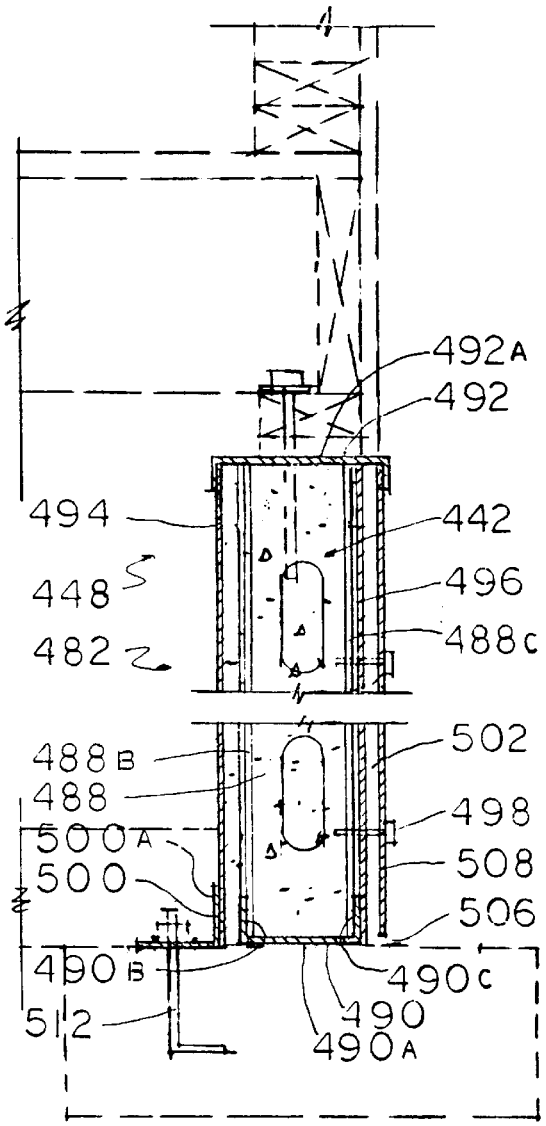
FIG. 19 is a vertical section taken along lines 19—19 of FIG. 18 as viewed in the direction of the arrows.

In FIG. 19, a portion of the panel 448 of the panel construction 442 of FIG. 18 is illustrated to show a representation of one of the panels of said panel construction 442 as it would be installed as a part of a building wall, the installation being typical, similar to than of other panels described. The channels 488 are seated between the top and bottom base plates 492 and 490 respectively. The bottom base plate 490 has a narrower web 490A than the web 492A of the top base plate 492. Vertically oriented steel walls 494 and 496 are secured to the outer surfaces of the flanges 4990B and 490C by bolts 498. An angle 500 is disposed along the length of said steel wall 494, the vertical leg being secured to the lower end of said steel wall. The steel wall 496 has a metal strip 508 secured to the outer rib spanning between the outer ribs thereby creating an air chamber between the metal support and the inner rib of the metal wall. The air chamber is open at their lower ends to define "weep-holes" 506 thereat. The "weep-holes" 506 permit any water to exit the air-chamber, should any water penetrate the decking connection to the channels.

The panel 482 is illustrated as secured to the concrete footing (shown in phantom outline) by anchor bolt of the bolt/washer/nut assembly 512, said anchor bolt being embedded within the concrete footing. The footing and the lower end of the panel 482 are disposed below ground, a portion of the footing conventionally is formed with drain tile and stone (not shown).

As mentioned earlier, the embodiments of the invention heretofore described have provided pre-fabricated panels having planar outwardly facing surfaces. Considerable popularity has been evidenced in providing decorative patterns on the panel surfaces, both those facing inwardly and/or outwardly. The conventional approach has been to impress designs into the wet concrete to provide some decoration to the conventional plain surfaces of concrete wall panels. These surfaces have been unattractive and usually are painted to give a more attractive appearance. Sand or aggregate have been impressed in the outer surface of the concrete panel just prior to completion of the curing or hardening thereof. Burying the surface in sand has been another proposal for providing some decoration to the outer surface of the completed wall panel. Actual thin bricks have been impressed in mortar and applied directly on a wall but not on horizontally placed concrete panels which are later cured and erected into a vertical orientation. The individual thin bricks have fallen short of direct set in prefabricated walls. Not only are these thin bricks expensive and fragile, but installation is expensive and time consuming. Tiles of various colors, surfaces and/or the like have been applied to wall surfaces using mortar, grout or mastic, but to the inventor's knowledge, these elements have not been capable of structural impression on concrete surfaces.

As will be described hereinafter, the invention provides for the formation of a prefabricated concrete building panel which is provided with an flexible exterior brick facing for application to the otherwise planar concrete panel, and particularly to the panel according to the invention disclosed herein, said facing being capable of installation simultaneous with the formation of the concrete panel.

Figure 20:
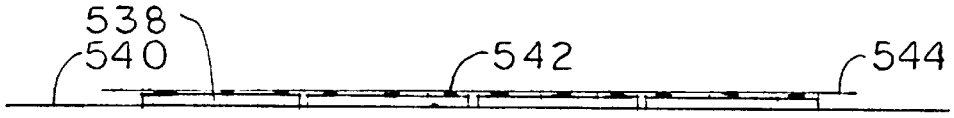
FIG. 20 is a sectional view of a decorative brick layer formation adapted to be applied to a wall surface of the wall panel constructed in accordance with the invention.
Figure 21:
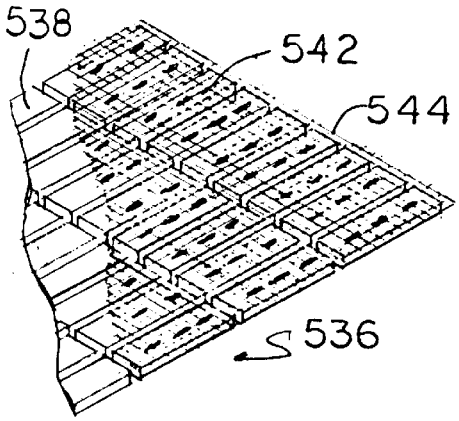
FIG. 21 is a perspective view of a flexible decorative brick facing adapted to be applied to the planar outer concrete surface of the a wall panel embodying the invention during the formation of the wall panel, portions being shown to illustrates the steps in formation of said facing, including the arrangement of the thin brick tiles in a pattern on the planar table surface, the application of adhesive mounds on the brick surface and the placement of a woven web screen onto the resulting surface.

In FIGS. 20 through 23, there are illustrated prefabricated molded concrete panels complete with real brick patterns on the outwardly facing surfaces thereof. In FIG. 20 there is illustrated a flexible brick facing 536 comprising an array of thin, (preferably one-half inch thick), rectangular bricks 538 arranged upon a planar surface 540, such as a table top, to form a desired pattern 536A. Small mounds 542 of adhesive, such as of the epoxy type or other suitable type, are deposited onto the outer surfaces of the bricks 538 and a flexible woven web screen 544 is applied over each of the adhesive mounds 542. The adhesive mounds 542 joining the flexible woven web screen 544 to the brick pattern 536A are permitted to cure.

When the panel such as any one of the panel walls described heretofore, is completed with the pouring of concrete on the skeletal assembly thereof, the flexible facing 536 comprising the joined web and brick pattern 536A, now with the adhesive cured, is laid onto the wet concrete surface and pressed thereinto. The spaces 546 between the respective bricks 538 can be topped with grout 548, i.e. applied upon any concrete which oozes out between the bricks 538 during the pressing of the facing into the wet concrete, the application of such grout 548 occuring after the concrete is cured.

Figure 23:
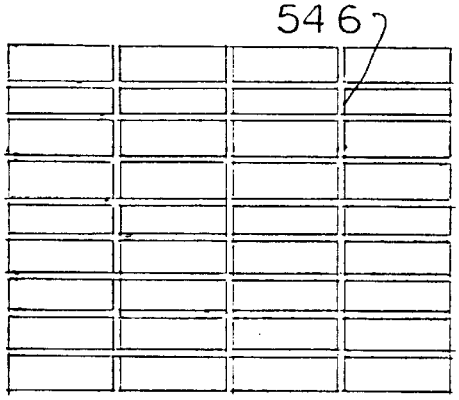
FIG. 23 is an elevational view of the brick facing illustrated in FIGS. 20 and 21

The resulting completed flexible brick facing 536 is illustrated in FIG. 23 oriented vertically so as to show the appearance of the said flexible brick facing 536 when viewed with said flexible brick facing oriented upright as it would be when applied to the aforementioned concrete panel carrying same.

Figure 22:
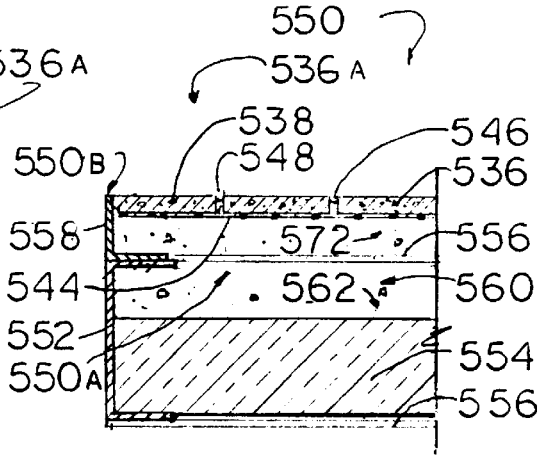
FIG. 22 is a fragmentary sectional detail illustrating a finished embodiment of the wall panel of the invention carrying the brick facing installed as a part thereof.

In FIG. 22, the panel 550 has been formed by pouring concrete into the completed skeletal assembly 550A thereof, including the steel channels 552, the rigid insulation boards 554 and the remaining forming structure 550B therefor including the top base plate (not shown) and the bottom base plate 556 and the associated angles 558 which define the concrete receiving chamber 560. Concrete is poured into receiving chamber 560 to reach a depth so as to leave a wet concrete layer slightly thinner than the thickness of the flexible brick facing 536. The facing 536 is applied to the wet concrete surface and pressed thereinto, partially to embed the facing 544 into said concrete surface. In FIG. 22, the completed panel 536A with the brick facing 536 applied to the outer side there, as installed thereon, is illustrated in the panel's normal installed vertical orientation.

It should be noted that the selected panel can be precast with the concrete layer 562 thereof cured. In such circumstance, as shown in FIG. 22, the angle 558 securing the channel 552 can have additional wet concrete or mortar forming a wet concrete layer or mortar 572 therein. The flexible brick facing 536 then is laid onto the surface of the wet concrete layer 572 and pressed thereinto. Thereafter, said wet concrete layer 572 is cured.

Conventionally, it is popular to apply molded millwork to exterior building walls, such millwork mouldings are in a plurality of different shapes, contours, lengths, thicknesses, and the like. Such moldings are provided with planar rear surfaces and are secured onto the exterior building walls by adhesive backing provided on such planar rear walls, generally supplied by adhesive material applied to such planar walls. The mouldings also can be applied to such exterior building walls by using masonry screws, nails, masonry anchors, etc. End blocks are employed to assure a tight contact between the building wall and the planar rear wall of the moulding. All of these conventional steps result in labor cost which can be expensive as well as possibly damaging the mouldings.

Of greater import, is the general inability to secure mouldings to concrete wall surfaces subsequent to curing of the concrete. Adhesives generally will not hold, particularly under the weather conditions to which exterior building walls are exposed. Therefore, such decorative elements, while attractive, are not conventionally provided on concrete walls since concrete walls have never been versatile enough to provide a decorative finish yet alone add decorative mouldings to concrete would be somewhat destructive both to the concrete and to the mouldings. However, most decorative mouldings which are employed for the decorative purposes are formed of synthetic material and in a variety of sizes. Therefore, one would desire means whereby such decorative mouldings can be applied to concrete walls as a substantially permanent installation. Such means has not been found to be available. However, the herein invention, which is directed particularly to the provision of prefabricated concrete panels, gave rise to such means.

Figure 24:
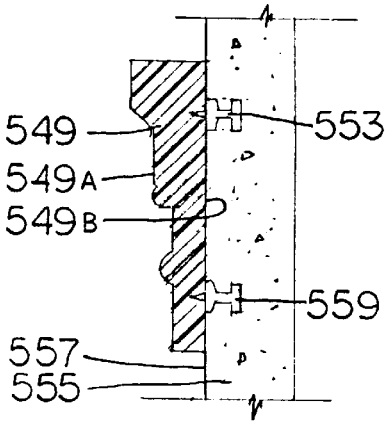
FIG. 24 is a fragmentary sectional detail illustrating a typical moulding structure adapted to be secured to the wet surface of a hardenable material such as concrete.

In FIG. 24, there is illustrated a moulding 549 having an exterior surface 549A and a rear surface 549B. Double-headed screws 553 are driven into the planar rear surface 549B. Now, when the concrete wall 555 is still wet, as will be the case when the exterior panel walls of the panels described heretofore are formed, the moulding is pressed against the exterior planar surface 557 of said wet concrete wall until the double-head 559 of said double-headed screws 553 are embedded therein and the planar rear surface 549B is flush against the concrete wall 555. The concrete is permitted to cure, with the result that the moulding 549 is permanently adhered to such concrete wall.

Figure 25:
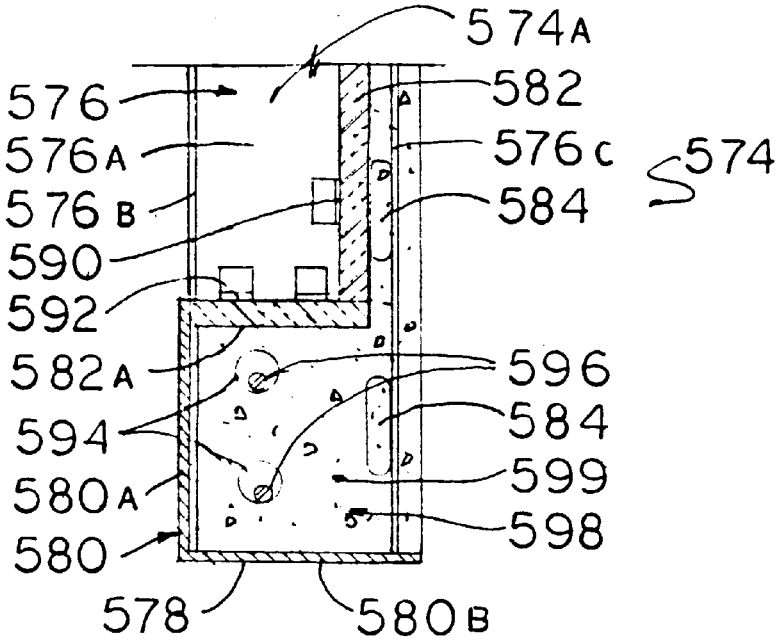
FIG. 25 is an elevational sectional detail of a modified building panel similar to the panel illustrated in FIG. 4.

FIG. 25 illustrates a modified embodiment of the invention as embodied in a panel 574 suitable for seating as a bridge spanning between a series of buried cassions one of which is shown in phantom outline, said panel 574 being closely similar to the panel 126 shown in FIG. 4 of the drawings. The skeletal assembly 574A for the panel 574 includes an array of spaced parallel elongate channels 576 arranged in a row between top and bottom base plates, only the bottom base plate 578 being shown in FIG. 25. The skeletal assembly 574A is closely similar to the skeletal assembly 126A of panel 126 shown in FIG. 4. However, there are significant differences between panels 126 and panel 574 to which attention now is directed. The bottom base plate 578 of panel 574 is formed of an angle 580 having a vertical arm 580A and a horizontal arm 580B. The channels 576 extend to the horizontal arm 580B of angle 580 and rest thereon. The horizontal arm 580B of angle 580 is secured to the lower ends of the channels 576 and extends past the lower ends of the channels 576. Rigid insulation boards 582 are disposed along the webs 576A of the channels 576 and between said channels 576, said rigid insulation boards 582 disposed adjacent the row of holes 584 formed in said webs 576A along the length of said channels 576.

As shown in FIG. 25, the rigid insulation boards 582 are shorter in length than the channels 576 and terminate at their lower ends at a horizontal plane located coincident with the upper end of said vertical arm 580A of the angle 580 located so that an elongate strip 582A of rigid insulation board extends between the inner flanges 576B and the lower ends of said rigid insulation boards 582 at a level so that the upper surface of strip 582A is coincident with the upper end of the vertical arm 580A of angle 580. The respective insulation boards 582 and 582A are supported by punch-out tabs 590 and 592 respectively. A pair of additional holes 594 are formed in the web 576A of each of the channels 576, said holes 594 being located near the lower ends of said channels. As with the holes 584 and the holes left by the punch-out tabs 590 and 592, the holes 594 are aligned with their matching holes formed in the webs 576A of the other channels 576.

Reinforcing means such as elongate steel bars 596 are passed through the holes 594 along the length of the array of channels 576. The holes 584 and 594 define a flow path for concrete introduced thereinto, particularly filling the entire chamber 598 defined by the the rigid insulation strip 582A, the vertical arm 580A of angle 580 and the horizontal arm 580B of angle 580 including therein the lower ends of the channels 576 and the base plates defining the outer wall of the panel 574. Thus, a fully functional concrete grade beam 599 is formed as an integral component of said panel 574. The beam 599 of the panel 574 extends perpendicular to the portions of the channels 576 embedded in said beam 599.

Figure 26:
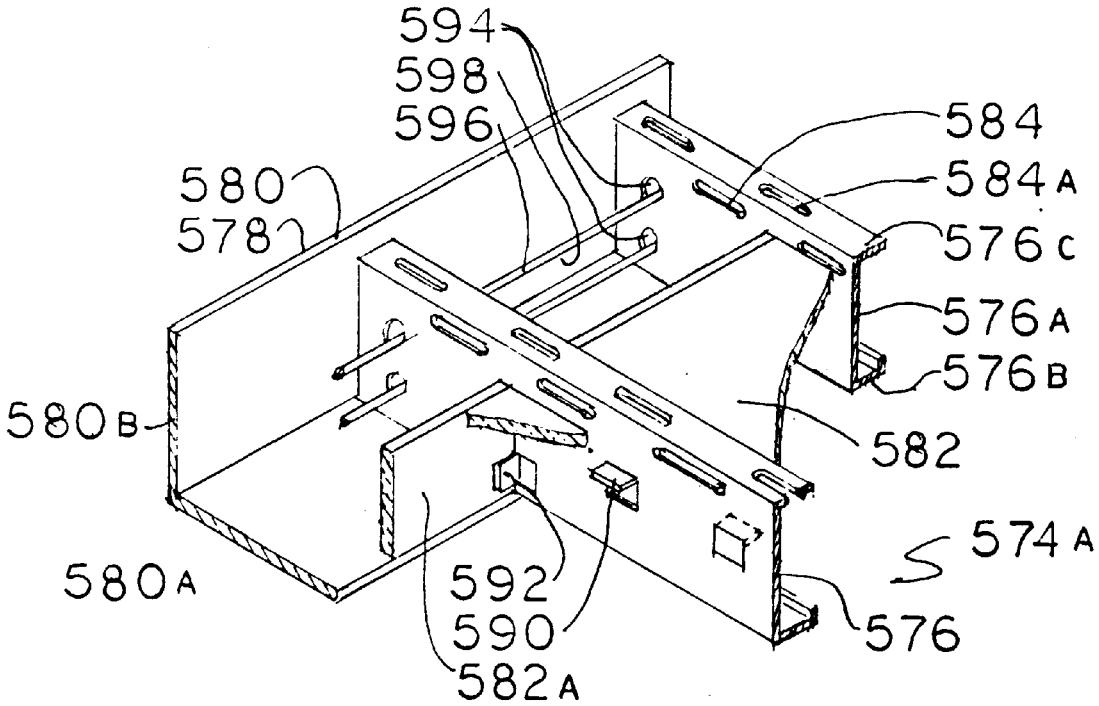
FIG. 26 is an isometric detail of a portion of the skeletal assembly employed in the modified building panel illustrated in FIG. 25.

In FIG. 26, the same skeletal assembly 274A of the panel 574 illustrated in FIG. 26, is illustrated with the same reference characters identifying the same elements of said assembly 274A. However, in FIG. 25, a row of holes 584A not visible in FIG. 24, are shown as provided in the outer flanges 576C of the channels 576. These holes 584A also function to define the flow path of concrete introduced into the chamber 598.

Attention now is directed to FIGS. 27 through 34 wherein the panels according to the invention are modified to form not only a panel which can be mounted angularly to form eaves and fascia (roof) of a building but, as well, forms panels which are a combination of a concrete panel and a truss as a part thereof. These panels are versatile and also can function to form a flat roof as well as an angled roof, basement walls, vertical building walls, foundation walls with unusual strength and substantial load bearing capacity and also can be constructed alone or in combination with additional vertically arranged prefabricated panels (with or without trusses) to function as a building wall of height substantially greater than possible employing convention prefabricated concrete panels. In particular, in considering FIG. 27, reference also should be directed to FIGS. 28 and 29, and particularly to FIG. 29 wherein an isometric view of the panel 600, its skeletal assembly 600A and its forming structure 600B are more clearly illustrated.

Figure 27:
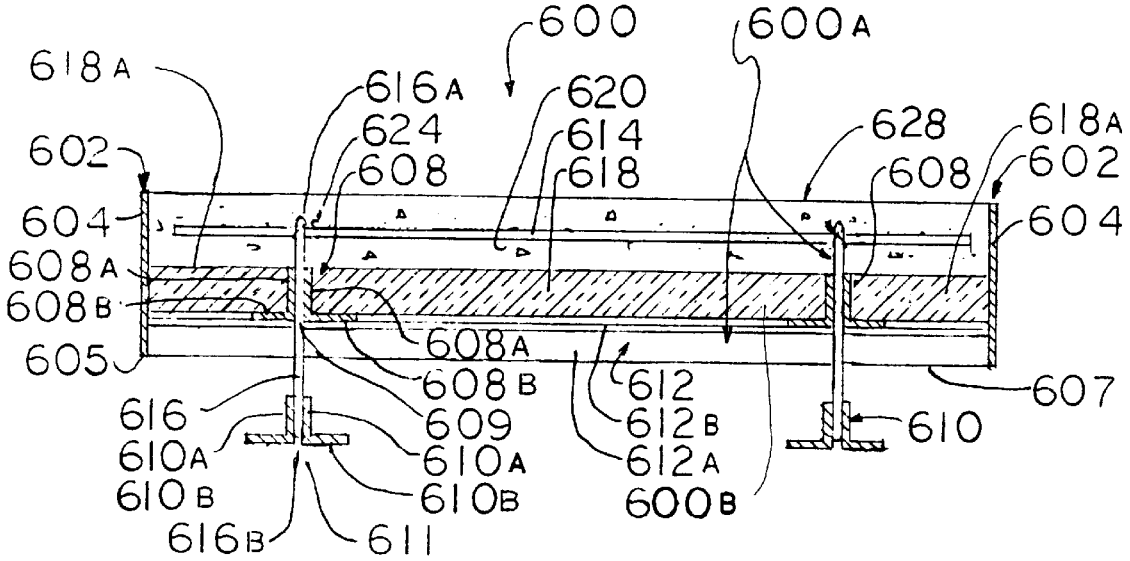
FIG. 27 is a partial sectional elevational view of a combination concrete panel and truss constructed according to the method of the invention.

In FIG. 27, a self-contained molded prefabricated panel constructed in accordance with the invention and formed following the method of the invention is designated generally by reference character 600. Panel 600 functions not only as a pre-fabricated structural steel concrete panel such as those described hereinbefore, but can function as a building joist, including a truss structure as a part thereof. The panel 600 includes a skeletal assembly 600A including a rectangular frame 602, which is part of the forming structure 600B defined by a pair of opposite end plates 604 and pair of opposite edge plates 606 (see FIG. 29), first matched pairs of elongate angles 608 and second matched pairs of plural elongate angles 610, plural elongate reinforcing bars 614, plural web-reinforcement bars 616 and plural rigid insulation boards 618. The forementioned matched pairs of angles 608 and 610 define double-angle struts which are designated generally hereinafter by the same reference characters 608 and 610 respectively.

The first double-angle strut 608 is arranged with the vertical legs 608A and 608B parallel but spaced a small distance apart to define a narrow gap 609 with the horizontal legs 608B being coplanar in a horizontal plane and extend outward at right angles in opposite directions relative to the vertical legs 608A. The second double-angle strut 610 also is arranged with the vertical legs 610A parallel but spaced a small distance apart to define a gap 611. The double-angle strut 610 is arranged with the horizontal legs 610B thereof being coplanar in a horizontal plane spaced below and parallel to the horizontal plane of horizontal legs 608B of double-angle strut 608. The double-angle struts 608 and 610 are aligned so that the gaps 609 and 611 are equal and aligned.

Plural like elongate angles 612 are equal in length and arranged parallel, coplanar and spaced equally ones from the others between the opposite end plates 604 of the rectangular frame 602 with their opposite ends secured to said end plates 604 as by welding. The lower ends 607 of the vertical legs 612A of angles 612 are coplanar with the lower ends 605 of the opposite end plates 604 and the horizontal legs 612B of said angles 612 also are coplanar in a common horizontal plane. The elongate angles 612 engage and rest on or are secured to the undersurfaces of the horizontal legs 612B of the angles 612, as by spot welding, for example. The plural reinforcing bars 614 are arranged spaced in a horizontal plane parallel to the horizontal plane of the angles 612 between the opposite end plates 604 of rectangular frame 602. As shown in FIG. 27, the horizontal legs 608B of the first double-angle struts 608 are placed upon the horizontal legs 612B of the angles 612. Rigid insulation boards 618 are placed upon the horizontal legs 608B of the first double-angle strut 608 and between and engaging each of the spaced plural double-angle struts 608. Each of plural web-reinforcement bars 616 is tied to the reinforcing bars 614 and extend vertically first through the aligned gaps 609 and 611 of the double-struts 608 and 610, finally reaching and secured within the gap 611. Each of the web-reinforcement bars 616 are each bent along its length to form generally equal curved upper bends 616A and similar lower bends 616B spaced along their length. One end of each of the upper bends, which is in fact a curved end of said web-reinforcement bar 616, is hooked onto the reinforcing bar 614 and tied thereon using a wire 624. The web-reinforcement bar 616 continues to pass through said gap 609 of said first double-angle strut 608 with the web-reinforcement bar 616 and being secured therein, preferably by welding, then continuing to pass into the gap 611 of the second double-arm strut 610. The web-reinforcement bar 616 continues, returning to and through the gap 609. This alternating pattern continues until the web-reinforcement bar 616 reaches its terminal end.

In making its traverse, the web-reinforcement bars 616 are disposed so that the reinforcing bars 614 are within the upper bends 616A and are tied thereto while the lower bends 616B are within the gap 611 and secured by preferably by welding to the vertical legs 610A of the second double-angle strut 610 which define said gap 611. The second double-angle strut 610 thus is held in place aligned with and below the first double-angle strut 608. The web-reinforcement bar thus is frozen in place fixed against movement relative to said first and second double-angle struts 608 and 610. It should be noted that a relatively narrow rigid insulation board 618A bridges the area between said first double-angle strut 608 and the said edge plate 604. When the assembly of the web-reinforcement bars 616, the reinforcing bars 614 and the concrete above the rigid insulation 618 and the respective double-angle strut 608 is completed, said assembly is capable of being characterized as a top chord. The web-reinforcment bar 616 in combination with the double-angle struts 610 define the bottom chord. The frame 602 extends above the rigid insulation members 618 amd 618A to define a chamber 620 for receipt of concrete embedding the reinforcing bars 614, the portions of the web-reinforcement bars above the rigid insulation boards, the frame 602 and the upper surfaces of the rigid insulation boards 618 as well as the portions of the end and edge plates.

Figure 28:
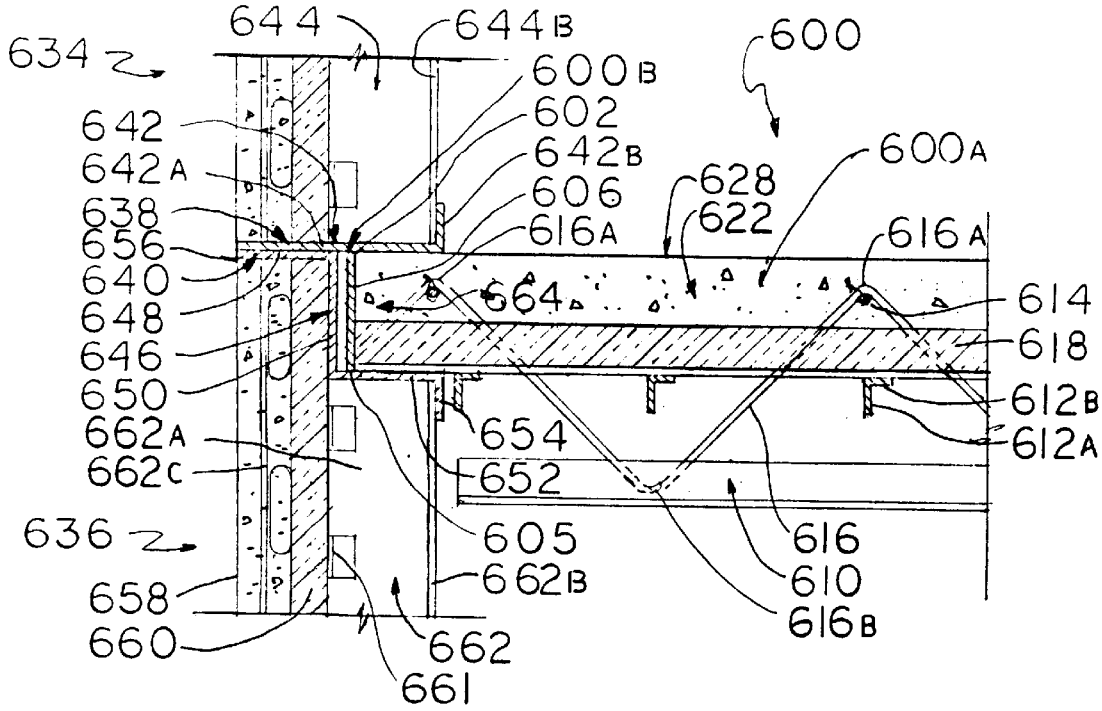
FIG. 28 is a partial sectional elevational view of a modified embodiment of the invention illustrated in FIG. 26 and shown coupled to a building wall construction formed of a pair of modified embodiments of the invention.
Figure 29:
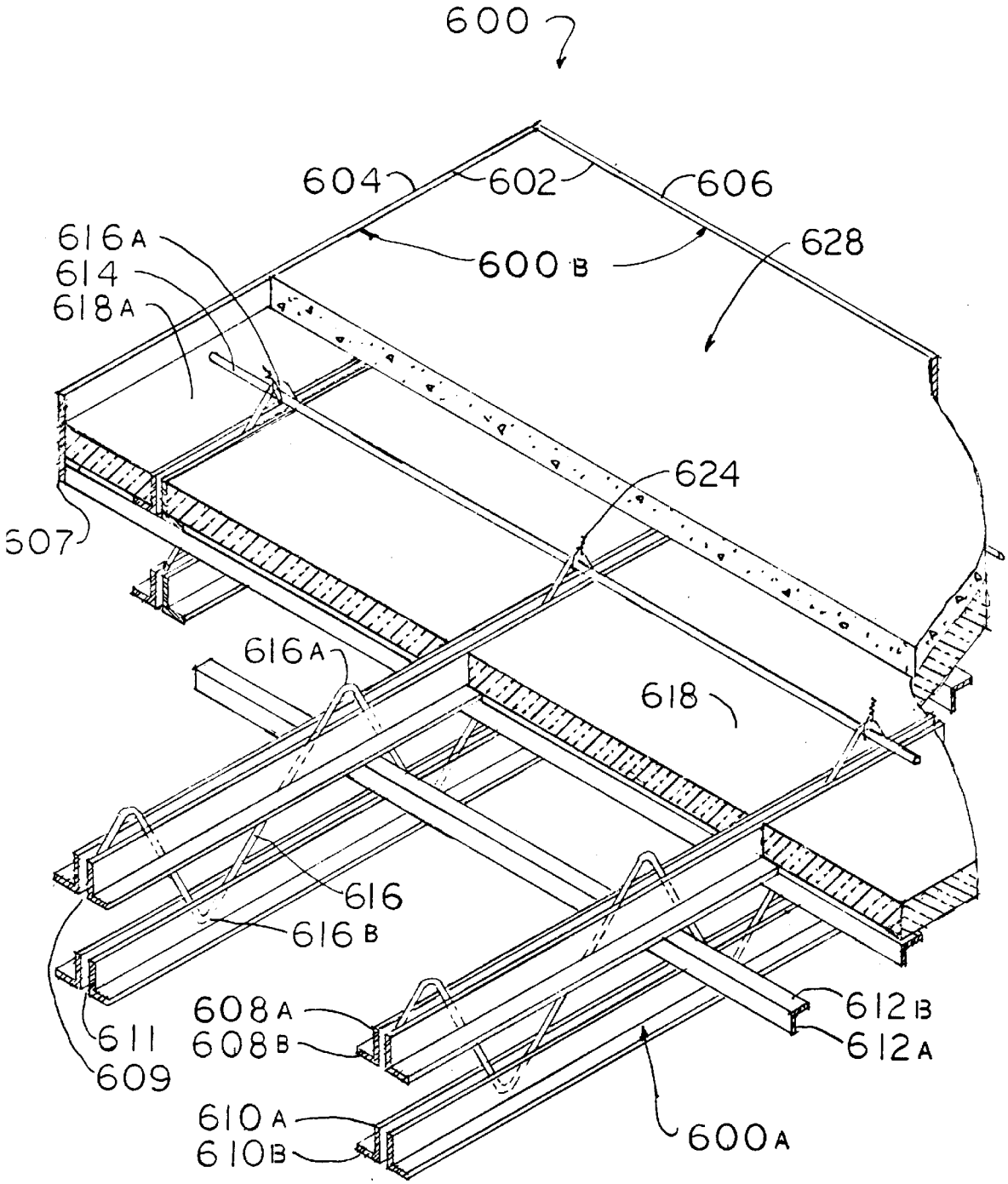
FIG. 29 is an isometric view of the combined concrete panel and truss illustrated in FIG. 28 and constructed in accordance with the invention, portions broken away to illustrate interior construction thereof.

Referring to FIGS. 28 and 29, the frame 602 is illustrated particularly in FIG. 29, the forming structure of panel 600B is illustrated as defined by the frame 602 formed of the end plates and the edge plates 604,606 shown secured at their respective opposite ends and the portions of the skeletal assembly 600A which will be embedded in concrete upon pouring of concrete thereinto when the skeletal assembly and the frame 602, including the rigid insulation board 618 shown in FIGS. 28 and 29, the upper tied bends 616A of the web-reinforcement bars 616 and the reinforcing bars 614. Since the upper-portions of the frame 602 constitute a border defining the chamber 622 for receiving concrete when the frame 602 and the skeletal assembly 600A is assembled and placed in a horizontally oriented condition, an outer concrete wall 628 thus is provided for curing.

Thus, as stated hereinabove, in assembled condition the top double-angle struts, the reinforcing bar and the upper bend portions of the web-reinforcement bar when assembled functions along with the rigid insulation and the concrete wall, and can be described as the top chord of the resulting truss, the bottom portions of the web-reinforcing bar and the bottom double-angle strut, in assembled condition, functions and can be described as the bottom chord of said resulting truss forming a part of the panel 600. The plates 604 and the edge plates 606 extend above the level of the rigid insulation boards 618, the reinforcing bars 614 and the bends 616A of the web-reinforcement bars 616 defining chamber 622 for receiving concrete poured therein to define the concrete outer wall 628 embedding said rigid insulation boards 618, reinforcing bars 614 and the upper bends 616A of the web-reinforcement bars 616 in the resulting concrete wall.

Directing attention to FIGS. 28 and 29, the panel 600 is illustrated as installed arranged supported within a cavity 664 defined between vertically oriented panels 634 and 636

(as will be described hereinafter). The panels 634 and 636 are substantially similar to panels 10 of FIG. 1 but for being a mirror image thereof and the configuration of their respective bottom and top base plates 638 and 640, to which attention here will be directed. In lieu of the channel base plate 20 and angle 24 of FIG. 1 (panel 10), the bottom base plate 638 of panel 634 is formed of an angle 642 having an elongate horizontal leg 642A extending over the entire bottom of the panel 634 and terminating in a vertical leg 642B secured to the inner flange 644B of the channel 644. The top base plate 640 of panel 636 is formed as a modified Z-shaped member 646 having a top horizontally oriented leg 648, a downwardly extending vertical leg 650, a second horizontal leg 652 terminating in a short downwardly directed vertical leg 654. The base plate 640 replaces the base plate 18 of panel 10. The top horizontal leg 648 is applied over the top portion 656 of panel 636 including the outer concrete wall 658 and the rigid insulation board 660 of the panel 636.

The channels 662 of the panel 636 are shortened compared to the channels 16 of panel 10 so that the web 662A and the outer flange 662C of channel 662 extend parallel to the vertical leg 646 and are secured to vertical leg 646 and the horizontal leg 648 of the top base plate 640. The second horizontal leg 652 is joined to the upper ends of the channels 662 of panel 636. The vertical leg 648 tightly abuts the rigid insulation board 660 with the horizontal leg 652 extending over the top ends of the shortened channels 662, said horizontal leg 652 being secured to said top ends of the channels 662 of panel 636. The vertical leg 654 of the thus defined top base plate 640 is secured to the inner flange 662B of the channels 662 of panel 636. The rigid insulation board 660 is supported by the punch-out tabs 661 formed in the channels 662. The cavity 664 supports the top chord at the end thereof.

Figure 30:
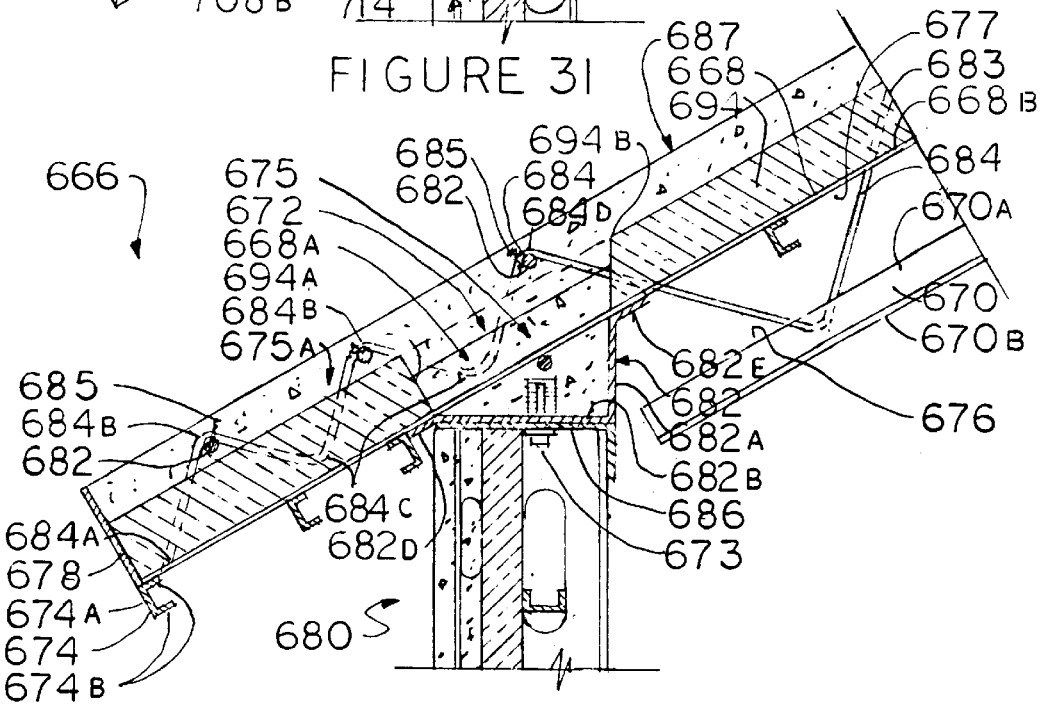
FIG. 30 is a sectional elevational view of a modified embodiment of the invention illustrated in FIG. 28 suitable for installation as an angularly disposed roof truss, same being shown as coupled to a building panel constructed according to the invention.

The panel 600 of FIGS. 27 through 29 has been modified resulting in panel 666 illustrated in FIG. 30 with said panel 666 installed oriented angularly and functioning as a roof. The modified panel 666 provides a double-angle struts 668 and 670. The double-angle strut 668 is provided with a horizontal legs 668B and vertical legs (not always visible in FIG. 30), the horizontal leg 668B supporting the rigid insulation boards 694. The double-angle strut 670 is foreshortened and also is provided with horizontal legs 670B and vertical legs 670A defining a gap 676. A gap 672 is defined between rigid insulation board sections 694A and 694B in place of the substantially continuous number of insulation boards 618 found in panel 600. U-shaped narrow channels 674 equivalent to angles 612 of panel 600, but each having a vertical mid-portion 674A with opposite parallel horizontal legs 674B are disposed spaced between the the opposite end plates (not shown) of panel 666. The channels 674 are secured to the horizontal legs 668B of the double-angle strut 668 and particularly at the ends of the edge plate 678 of panel 666.

A modified panel 680 (similar to the panel 10 of FIG. 1) is arranged vertically oriented for supporting the panel 666. The supporting angle 682 has a horizontal leg 682B with a vertical leg 682A secured by bolt 673 to the top base plate 686 of panel 680, the horizontal leg 682B having a free end flange 682D and vertical leg 682A having a free end flange 682E. The free end flanges 682D and 682E are secured to the horizontal legs 668B of the double-angle strut 668 at a location bordering the open space 672 to bridge said space 672 between the sections 694A and 694B of the rigid insulation board 694 defining a chamber 675 between the panel 666 and the panel 680. Equally spaced reinforcing bars 684 are disposed above the rigid insulation boards 694. The web-reinforcement bars 684 have one end 684A and an opposite end 694B. Starting at end 684A secured within the gap 677 of the double-angle strut 668, the web-reinforcement bars 684 have a series of curved bends beginning with the curved bend 684B shown seated upon the reinforcing bar 682 and tied thereto by wire 685. The web-reinforcement bar 684 continues to pass from the reinforcing bar 682 toward the horizontal leg 668B of the top double-angle strut 668 and then entering the gap 677. The first lower bend 684C is then seated and secured within the gap 677 and continues directed toward the next reinforcing bar 682 with the next upper bend 684B over the reinforcing bar 682 and tied thereto by wire 685. The web-reinforcement bar 684 then continues toward the horizontal leg 668B and the gap 642, and enters the gap 677 with the next lower bend 684C being secured therein. However, the last mentioned lower bend 684C is located within the gap 642. The web-reinforcement bar 684 then continues toward the next reinforcing bar 682 with the bend 684D over the said next reinforcing bar and tied thereto by wire 685. The web-reinforcement bar 684 then continues in a straight-line path to and through the gap 677 of the top double-angle strut 668 wherefrom it is directed toward the bottom double-angle strut 670, entering the gap 676 thereof and being seated and secured therein with the next lower bend within said gap 677. The web-reinforcement bar 684 then continues outward from the gap 676 of the lower double-angle strut 670 diagonally toward the gap 677 of the top double-angle strut 668 entering and passing through said gap 677 and continuing, in this FIGURE, toward the visible terminal end 683. The intervening bends (not shown) are appropriately alternating between the reinforcing bars and the lower double-angle strut 670 before reaching said terminal end 683.

Concrete is flowed into the panel 666, filling the entire chamber 675 as well as chamber 675A forming the concrete wall 687 of the panel 666 as well the coupling concrete bridge between the panels 666 and 680.

Figure 31:
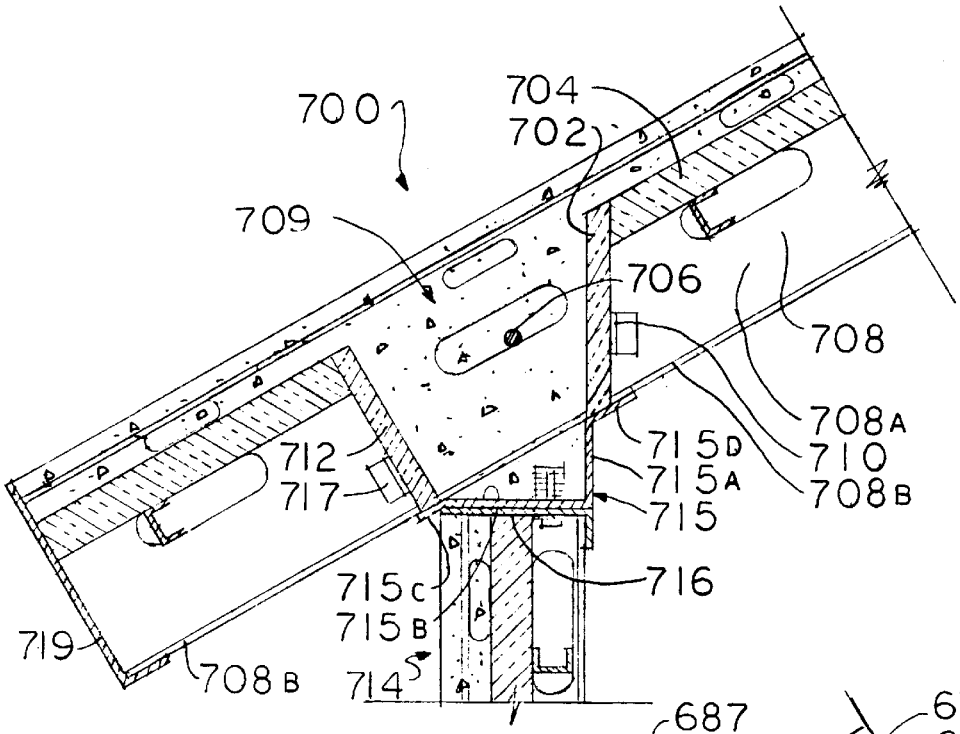
FIG. 31 is a sectional elevational view of a modified embodiment of the invention suitable for installation as an angularly disposed panel coupled to a building panel constructed in accordance with the invention.

FIG. 31 illustrates a panel 700 like panel 10 (see FIG. 1) which panel 700 has been modified to enable said modified panel to be installed oriented in sloped (or angular) orientation so as to constitute a roof of a building. The modified panel is designated generally in FIG. 31 by reference character 700. Here, similar to panel 666 of FIG. 29, a mid-portion of the rigid insulation boards such as employed in panel 10 of FIG. 1, have been omitted and a rigid insulation board section 702 diagonally disposed from the break in the rigid insulation board section 704 to the inner flange 708B of the channel 708 and is supported by punch-out tab 710. The punch-out tab is similar to the punch-out tabs 34 shown in FIG. 1 and is installed secured to the outer web 708A of the channel 708. A section 712 of rigid insulation board is arranged perpendicular to the rigid insulation section 704 along the web 708A of the channel 708 to bridge the open space between said section 704 and the inner flange 708A of the channel 708 and is supported in place by punch-out tab 717. The top base plate of panel 714 comprises an angle 716 closely similar to the angle 682 shown in FIG. 30. A supporting angle 715 of panel 700 has a horizontal leg 715B and a vertical leg 715A. The horizontal leg 715B has a free bent end flange 715C and the vertical leg 715A has a free bent end flange 715D. The free bend end flanges 715B and 715D are secured to the inner flange 708B of the channel 708, preferably by spot welding. The rigid insulation boards 702 and 712 connect the panel rigid insulation board 704 to the bent end flanges 715C and 715D of the support angle to define a chamber 709. As in the panel 10, a reinforcing bar 706 is introduced through the web 708A of the channel 708. The chamber 709 defined by the rigid insulation board sections 702 and 712 and the angle 715.

As with the panel 666, the sloped panel portion between the rigid insulation board section 712 and the base plate 719 functions as the eave of the sloped installed panel 700 (functioning here as the roof.

Figure 32:
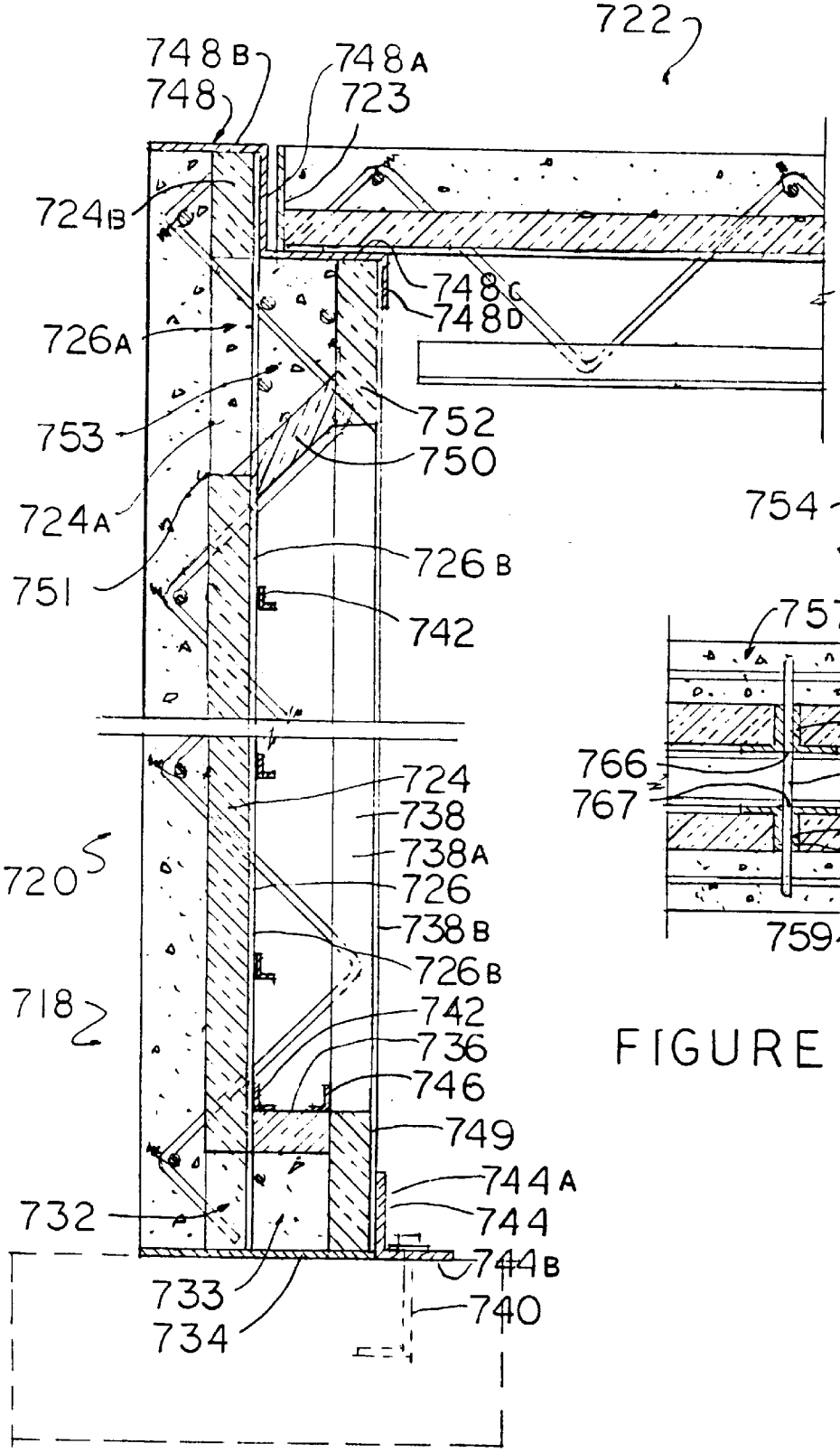
FIG. 32 is a sectional view of a modified embodiment of the combination concrete panel and truss shown in FIG. 27 shown coupled to a horizontally oriented combination concrete panel and truss closely similar to the combination concrete panel and truss shown in FIG. 27.

FIG. 32 illustrates the installation of a panel panel arrangement 718 consisting of a vertically oriented panel 720 which has been modified for vertical orientation and coupled to a horizontally oriented panel 722 extending outward from the upper end of said panel 720. Both panels 720 and 722 are similar to the panel 600 shown in FIG. 28. Both panel 720 and 722 are described herein from a horizontally oriented position assumed when assembled and before their installed orientation. When the panel 720 is in a completed stage, reference will return to its vertical orientation and in its installed stage.

Panel 720 differs from panel 600 by deleting a portion of the rigid insulation board 724 which rests upon the horizontal legs 726B of the double-angle strut 726 adjacent the edge plate 734 leaving a gap 732 between the remaining rigid insulation board 724 and the edge plate 734. A narrow section 736 of rigid insulation board is disposed verticaly between the end of rigid insulation board 724 and the top of the vertical legs 738A of double-angle strut 738. Section 736 of rigid insulation board is supported both by angles 742 and 746, a plurality of angles 442 also are arranged parallel and equally spaced between the opposite end plates (not shown) of the panel 720 and secured thereto. Angle 746 is secured to the ends of the vertical legs 738B of double-angle strut 738. An additional section 749 of rigid insulation board is placed along the horizontal leg 738B of double-angle strut 738 abutting the edge plate 734 and a location below the vertically oriented section 736 of rigid insulation board, thereby defining a chamber 733 for receiving concrete. The edge plate 734 of panel 720 functions as the bottom base plate of said panel 720 when said panel is oriented vertically. The panel 720 is secured to the concrete footing (shown in phantom outline). An angle 744 is arranged along the length of the panel 720 with the vertical leg 744A thereof secured to the remaining bottom chord 738 of said panel 720 and the horizontal leg 744B resting on the footing (shown in phantom outline). The panel 720 is fastened to the footing by the bolt of bolt/washer/nut assembly 740.

The opposite end of the panel 720 which now is the top end thereof, also has been modified, deleting a portion (indicated by reference character 724A) of the rigid insulation board 724 to form gap 753. A section 750 of rigid insulation board is placed diagonally between the end 751 of rigid insulation board and a section 752 of rigid insulation board disposed along the horizontal legs 738B of the double-angle strut 738.

The opposite edge plate 606 of panel 600 now becomes a top base plate 748 for panel 720 and is similar to the top base plate 640 of panel 636 illustrated in FIG. 28. The top base plate 748 has a horizontal leg 748B and a vertical leg 748A. The horizontal leg 748B of base plate 748 is secured to the top end of the installed panel 720, including the remainder rigid insulation board section 724B. The vertical leg 748A of base plate 748 is secured to the undersurface of horizontal legs 726B of the double-angle strut 726. The horizontal leg 748C of the top base plate 748 is secured to the ends of the vertical legs 738A of the double-angle strut 738 while the leg 748D is secured to the undersurface of legs 738B defining a shelf accommodating one end 723 of panel 722 with said panel 722 arranged extending outwardly horizontally oriented from and perpendicular to the panel 720. Panel 722 is identical to panel 600 described in FIG. 28 and reference is made to said FIG. 28 for a detailed description thereof.

While the height of conventional prefabricated panels have been limited to utilization as vertically oriented building walls between a maximum of 30 feet, the panel 700 when utilized as a vertically oriented building wall is effective at least for walls 60 feet.

Figure 33:
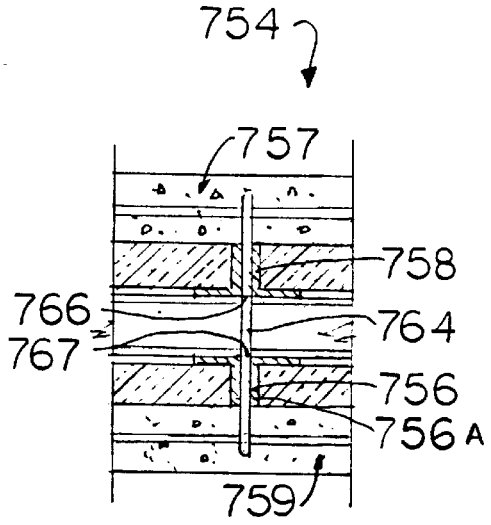
FIG. 33 is a fragmentary sectional detail illustrating a modified combination concrete panel and truss similar to the combination concrete panel and truss illustrated in FIG. 26 but modified to have a substantially the same combination concrete wall structures characterized as opposite double-walled panel units.

Referring to FIG. 33, there is illustrated a fragmentary section of a modified combination concrete panel and truss designated generally by reference character 754. Panel 754 is substantially similar in construction to panel 720 except the lower double-angle strut 756 constituting the lower chord of the panel 754 includes a double-angle strut 756 in which the orientation of the strut 756 is reversed, that is, the strut 756 opens downwardly, with the vertical legs 756A directed downward. The web-reinforcing bar 764 passes through the top strut 758 at the gap 766 of the top strut 758 to the gap 767 at double-angle strut 756, and continues back and forth alternately between the struts 758 and 756 and the reinforcing bars alternating between said struts 758 and 756. The concrete filler is first introduced to the panel 754 to fill the chamber 757, curing same thereafter. When the top wall is completed (cured), the panel 754 is inverted and concrete is added to the chamber 759 forming the second, opposite concrete wall.

Figure 34:
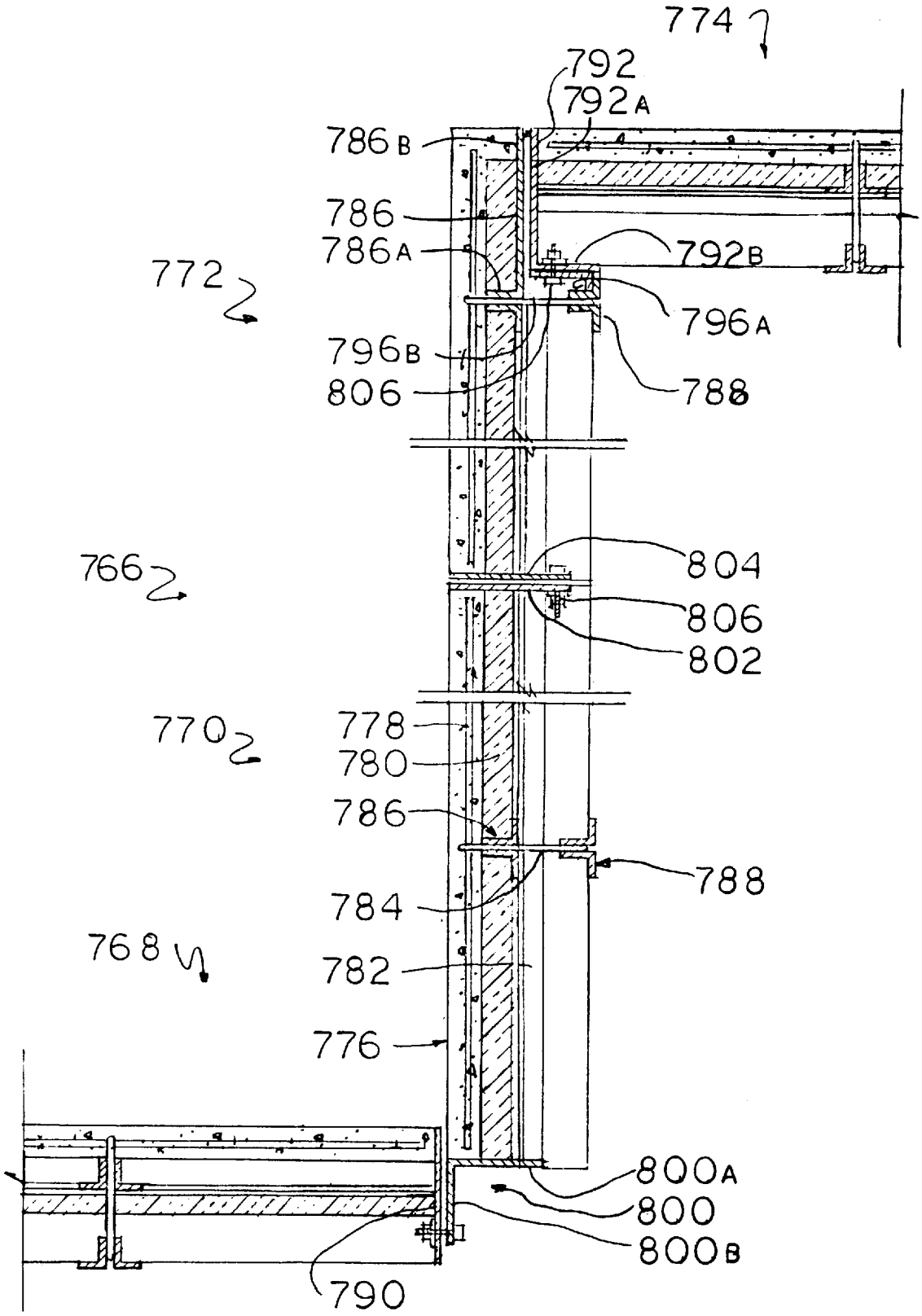
FIG. 34 is a plan view of a building panel installation accordng to the invention formed as an assemblage of combination concrete panel and truss panels, each closely similar to the combination concrete and truss panel shown in FIG. 32, said assemblage providing changes in direction to provide outside and inside cormers.

Referring now to FIG. 34, an assemblage 766 of panels 768, 770, 772 and 774 are illustrated, the said panels coupled end to end and showing changes in direction from one end of the assemblage 766 to the opposite end of the assemblage 766. Each of the said panels are substantially similar to the panel 600 illustrated in FIGS. 27 and 28.

Each panel of panels 768–774 includes an outside concrete wall 776, reinforcing bars 778 embedded in the concrete wall, rigid insulation boards 780 seated upon the plural angles 782 disposed equally spaced between the opposite ends of said panels, wall-reinforcing bars 784 tied to the reinforcing bars 778 and passed through top and bottom double-angled struts 786 and 788. The end plate 790 of panel 768 is secured to the leg 800B of angle 800, the other leg 800A of angle 800 being the end plate of panel 770. The opposite end plate 802 of panel 770 is secured to end plate 804 of panel 772 by bolt assembly 806. The top double-angle strut 786 of panel 772 has horizontal legs 786B and vertical legs 786A. The leg 786B extends to the end of the panel 772. An angle 792 is the end plate of panel 774 and the leg 792A is parallel to leg 786B of panel 772. The leg 796A of angle 796 is secured to the bottom strut 788. A bolt 806 secures panel 774 at the leg 792B to leg 796B securing panel 772 to panel 774. The respective double-angle truss structures are incorporated in the respective panels.

Figure 35:
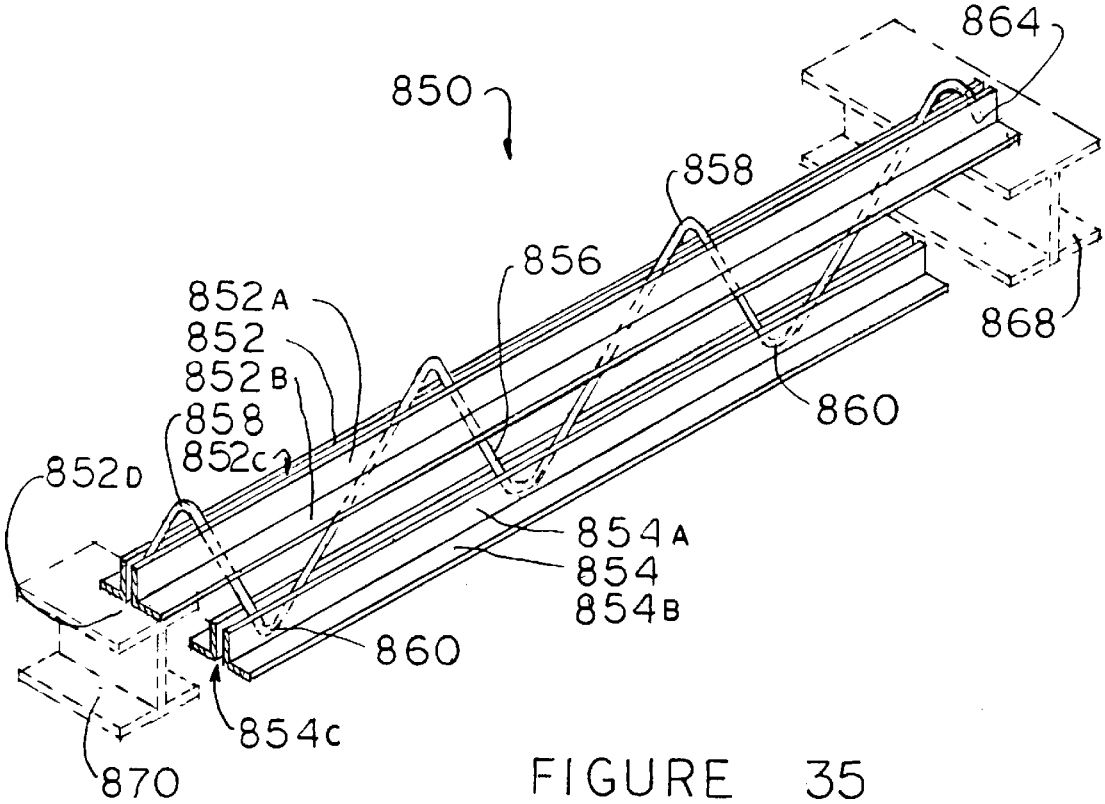
FIG. 35 is an isometric view of the truss structure according to the invention, said truss structure being adapted to be incorporated as an intimate part of the panels according to the invention.

In FIG. 35, the truss structure that is incorporated in selected ones of the pre-fabricated building panels is illustrated and designated generally by reference charter 850. The particular truss structure simple and easy to construct but to date has not been recognized by the art, and is not believed to be obvious in view of the prior art relating to truss constructions.

The truss 850 comprises a pair of double-angle struts 852 and 854, arranged spaced apart in horizontally parallel planes, the upper one 852 of the pair above the lower one 854 of the pair, the double-angle struts 852 and 854 aligned with their gaps 852C and 854C also aligned, each double-angle strut having vertical legs and horizontal legs, 852A, 852B and 854A, 854B, respectively.

An elongate web-reinforcement bar 856 is bent repeatedly along its length to form upper and lower alternating curved bends 858,860 respectively along the length of said bar 856. The bar 856 has one end 852C seated secured within gap 852C so that the first bend 858 extends beyond the said gap 852C and the bar continuing downward toward the gap 854C of the double-angle strut 854 thus entering said gap 854. The first lower bend 860 then is seated and secured within the gap 854C, the lower bend reaching the interior gap 854C between the vertical legs 854A of double-angle strut 854. The web-reinforcement bar 856 then continues with a relatively straight-line portion thereof directed to the gap 852C defined by the vertical legs 852A of said double-angle strut 852, the bar 856 passing through the gap 852D and continuing, repeatedly, to pass the alternating bends 858 and 860 alternately between the vertical legs of additional struts for forming the truss structure 850, the terminal end 864 of the web-reinforcement bar being secured within the last gap of the last double-angle strut of the series.

It should be noted that the upper double-angle strut 852 is longer than the lower double-angle strut 854 so as to define opposite extensions suitable for mounting horizontally disposed on spaced apart vertically oriented I-beams 868 and 870 (shown in phantom outline) bridging the space therebeteen.

Figure 36:
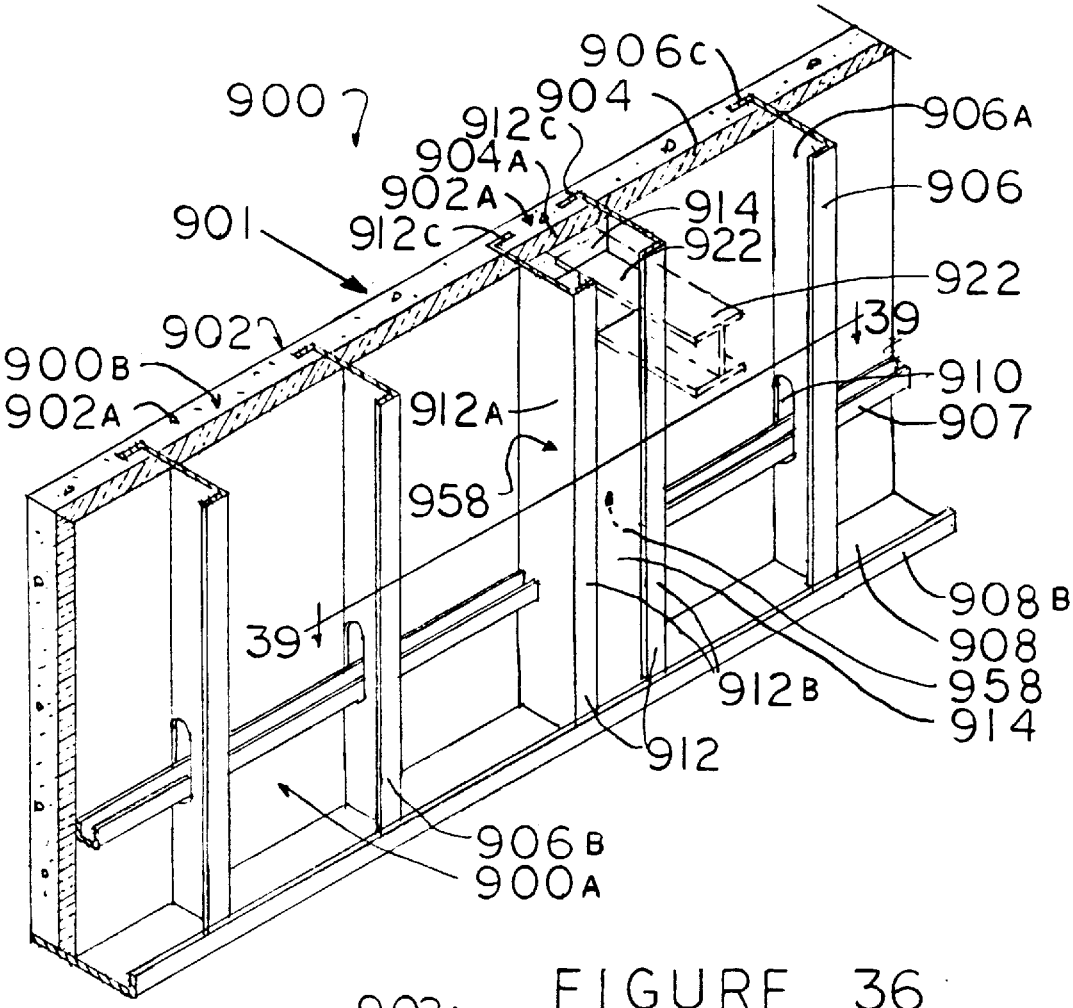
FIG. 36 is an isometric representation of a modified building panel according to the invention wherein a structural load carrying beam is intimately part of the panel and defined as extending outward horizontally parallel to said panel, said FIGURE illustrating one method of forming said load carrying beam.

In FIG. 36, a section of a panel 900 constructed according to the invention is illustrated. The said section of panel 900 has a concrete wall 902, a rigid insulation board 904 applied between each of the channels 906. The channels 906 are arranged aligned spaced vertically oriented within the bottom base plate 908. The outer flanges 906C of each channel 906 are embedded within the concrete wall 902 while the inner flanges 906B engage and are secured to the inner flange 908B of the bottom base plate 908. The web 906A of each of the channels 906 is provided with a hole 910, said holes 910 of said channels 906 being aligned. Plural sections 904 of rigid insulation board are placed between the webs of the respective channels 906. A cold-rolled narrow support channel 907 is illustrated as passing through said aligned holes 910. A pair of aligned spaced intermediate facing channels 912 are seated within the bottom base plate 908, the facing outer flanges 912C are embedded within the concrete wall 902. The spaces between the webs 912A of the intermediate facing channels 912 are left open leaving a path opening from the outer chamber 902A (more clearly shown in FIG. 37) to the space between the webs 912A of the facing channels 912. The facing webs 912A of said channels 912 are imperforate so that the support channels 907 are secured to the outer surfaces of the webs 912A of said channels 912. The inner flanges 912B of said facing channels 912 engage and are secured to the inner flange 908B of the base plate 908. An elongate narrow section of rigid insulation board 914 is disposed tightly between the webs 912A of facing channels 912 along the inner flanges 912B of said facing channels 912 bottoming on the web 908A of the bottom base plate 908 and secured to the flanges 906B thereof. A elongate vertical chamber 958 thus is defined by the rigid insulation board 914 and the webs 912A The chamber 902A opens to the chamber 958 which extends along the length of the pair of facing channels.

In filling the panel 900 with concrete, the concrete first can be introduced with the skeletal assembly 900A and its forming structure 900B arranged horizontally, filling the outer chamber 902A and the chamber 958. A bridging section 904A of rigid insulation board is placed between the webs 912A of said facing channels 912 adjacent the outer flanges 912C. A rectangular rigid metal section 922 is placed horizontally between the webs 912A and extending between the flanges 912C and 912B, defining a shelf 916 between the facing channels 912. Once the concrete filling the chambers 902A and 958 has been cured, one end of an I-beam can be supported upon the shelf 922, the I-beam extending perpendicularly outward from the panel 900. The arrow 901 illustrates the direction of the entry of concrete into the panel 900 while the skeletal assembly 900A and its forming structure 900B are oriented horizontally.

Figure 37:
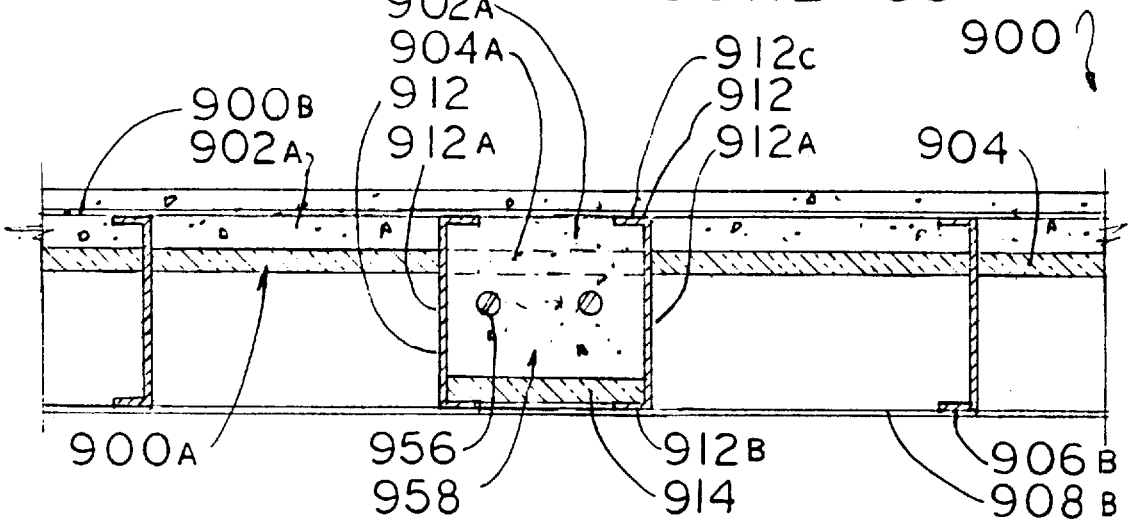
FIG. 37 is a fragmentary sectional view taken along lines 37—37 of FIG. 36 and viewed in the direction indicated by the arrows.

FIG. 37 illustrates a section taken along lines 37—37 of FIG. 36 and illustrates a method by which the panel 900 can be completed with the skeletal assembly 900A arranged horizontally oriented within the forming structure 900B thereof. The outer chamber 902A defines the outer concrete wall 902. The space between the facing webs 912A of the facing channels 912 is left open. Vertically oriented reinforcing bars 956 are arranged within the chamber 958. When the concrete is introduced to form the concrete wall 902 of panel 950, concrete also is introduced at the same time to the chamber 958 filling same, and thus forming, when the concrete therein is cured, not only the concrete wall 902 but also forming a load beam extending parallel to the channels 912 and 906. The rigid insulation board sections may be replaced with rigid wall board or other rigid material.

Figure 38:
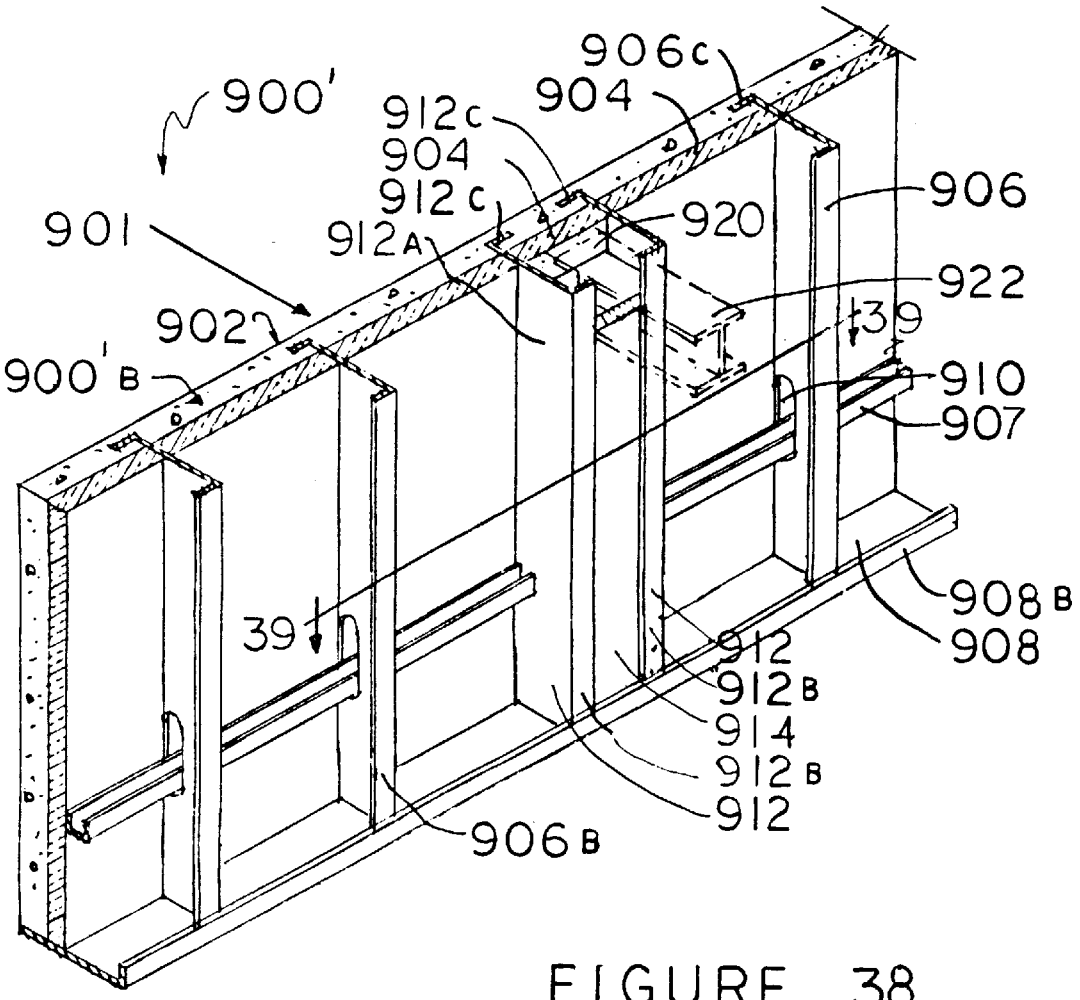
FIG. 38 is an isometric representation of a modified building panel incorporating a concrete load carrying beam formed incorporated as an intimate part of said building structure as shown in FIG. 36 but modified to illustrate another method of forming the parallel arranged load carrying beam thereof.

FIG. 38 illustrates a modified installation compared to the panel 900 illustrated in FIG. 36, the modified panel 900' differs from panel 900 only in that the rigid insulation board that was omitted between the webs 912A and near the outer flanges 912C of the facing channels 912, is continuous by introducing a section 904A' of rigid insulation board between the web 912A and in line with rigid insulation board 904. The vertical section 904A' of rigid insulation board replaces the section 904A shown in FIG. 36 redefining the chamber 958 as described in panel 900 which now becomes isolated. The outer wall 902 of the panel is formed by first introducing concrete to the forming structure 900'B while the skeletal assembly 900'A is oriented horizontally within the forming structure 900'B (see arrow 901). After the concrete wall 902 is cured, the panel 900' is oriented vertically for completing the installation. At this time, the chamber 958 is filled through the top end of the vertically disposed panel 900'. In panel 900', supporting angles 916 are installed secured to the webs 912A of the channels 912 with the legs 916B of the supporting angles 916 bearing against the rigid insulation board 904. In lieu of installing the plate 922 as shown in FIG. 36, the chamber 958 is filled with concrete to a level below the top of the panel 900' so as to define, when cured, a shelf for supporting a structural member such as an I-beam (shown in phantom outline).

Figure 39:
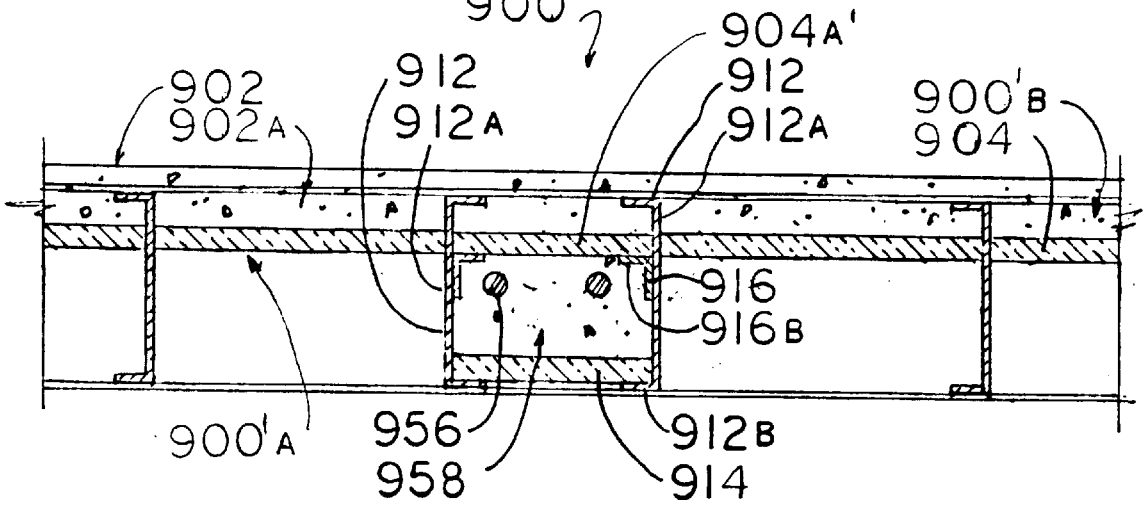
FIG. 39 is a fragmentary sectional view taken along lines 39—39 of FIG. 38 and viewed in the direction of the arrows to illustrate the modified method of forming the parallel arranged load carrying beam thereof.

FIG. 39 is a section taken along line 39—39 of FIG. 38 showing the introduction of concrete into the panel 900' first while the skeletal assembly 900'A and the forming structure 900'B of said panel is oriented horizontally and then, after the outside concrete wall 902 is cured, by pouring the concrete into the chamber 958 through the vertically arranged chamber 958 defined by facing channels 912, the rigid insulation section 904A' and the section 914 of rigid insulation board.

Figure 40:
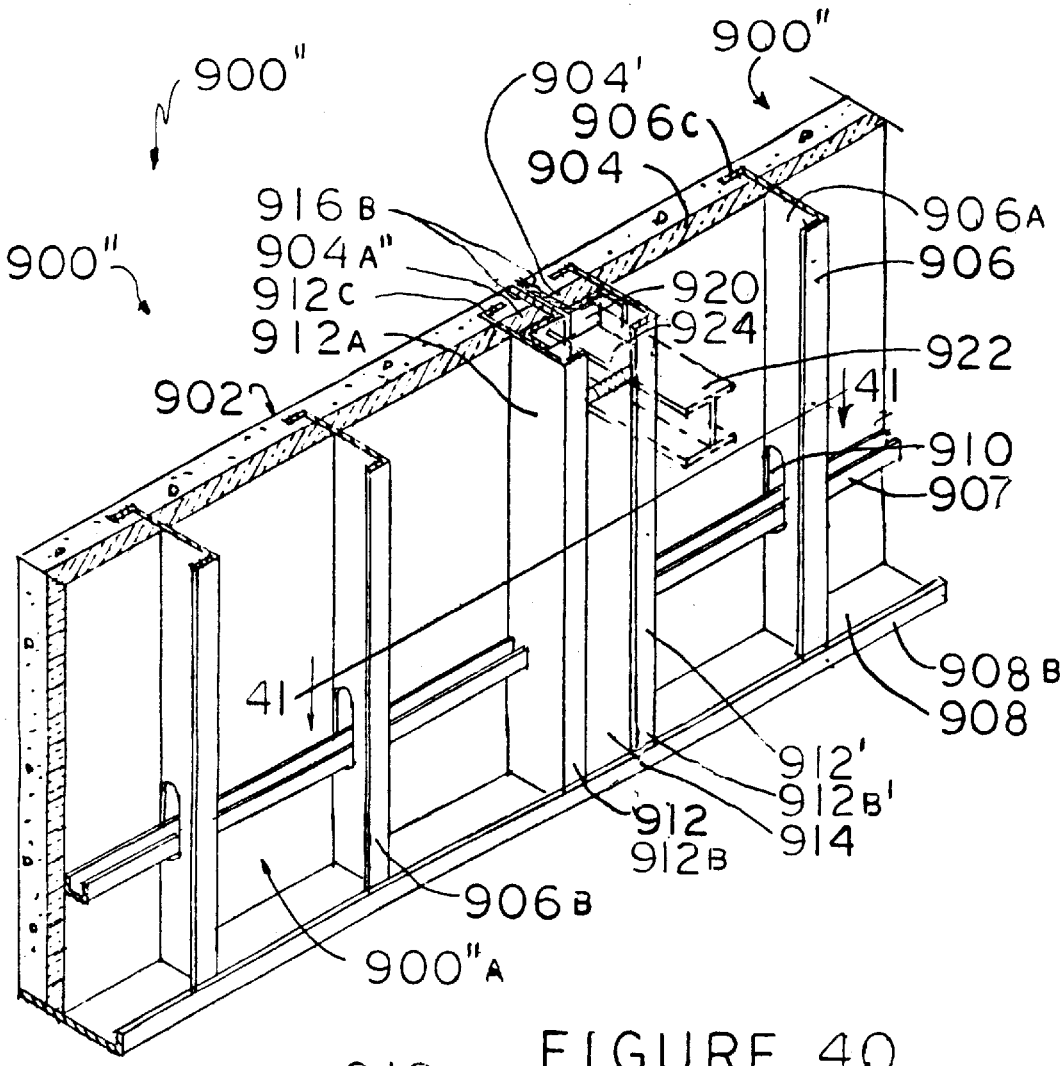
FIG. 40 is an isometric representation of an arrangement of a pair of panels engaged end to end with a parallel arranged load carrying beam formed bridging the juncture of said pair of panels, the arrangement being closely similar to the respective panels shown in FIGS. 36 and 38 and illustrating a further modified method of forming the load carrying beam thereof.

Referring to FIG. 40 wherein a pair of like panels 900" are arranged coupled end to end at a butt-joint between a pair of end plates 916 of each of said panels 900". As found in the panel 900, the skeletal assemblies 900"A of the panels 900" each including plural spaced elongate like structural steel channels 906, each having an outer flange 906C, a web 906A and an inner flange 906B. The channels 906 are arranged along and secured to a bottom base plate 908 having an inner flange 908B and a web 908A. Each end plate 916 comprises a Z-angle having a leg 916B, a leg 916A and a leg 916C. The leg 916B is secured to the end portion of each panel; the leg 916A is secured to the inner side of each panel and the leg 916C being directed perpendicular to leg 916A in a plane parallel thereto and extending between the facing channels 912 and 912' along and secured to the facing webs 912A and 912A' of channels 912 and 912'. Each channel 912 and 912' comprise the end channels of each of said panels 900" and each is provided with outer flange 912C, a web 912A and an inner flange 912B. The end channels 912 and 912' facing each other and will be referred to as facing channels 912 and 912' Aligned holes 910 are formed in each of the webs 906A of the channels 906 to accommodate the narrow supporting channels 907 passing therethrough. Rigid insulation boards 904 are positioned seated between the webs 906A of channels 906 at locations between the outer flanges 906C and the aligned holes 910. Narrow sections 904' of rigid insulation board are positioned seated securely between the webs 912A of facing channels 912 and 912' and the legs 916B of the end channels 916 of the panels 900" at locations parallel with the rigid insulation boards 904. An elongate narrow section 904A" of rigid insulation board is seated securely between the webs 912A of the facing channels 912 and 912' and adjacent the inner flanges 912B of the facing channels 912 and 912'. The section 904A" extends to the base plate 908. The facing channels 912 and 912' are secured together by bridging bolt 920. Thus, an elongate open-topped chamber 958 is defined. The chamber 958 is filled with concrete while the panels 900", including the chamber 958, is vertically oriented, by pouring the concrete vertically and parallel to the channels so as to form the concrete beam parallel to the channels. A shelf 924 is formed when the concrete reaches the height of the rigid insulation board 914 between the facing channels. The resulting beam effectively bridges the butt-joint.

Figure 41:
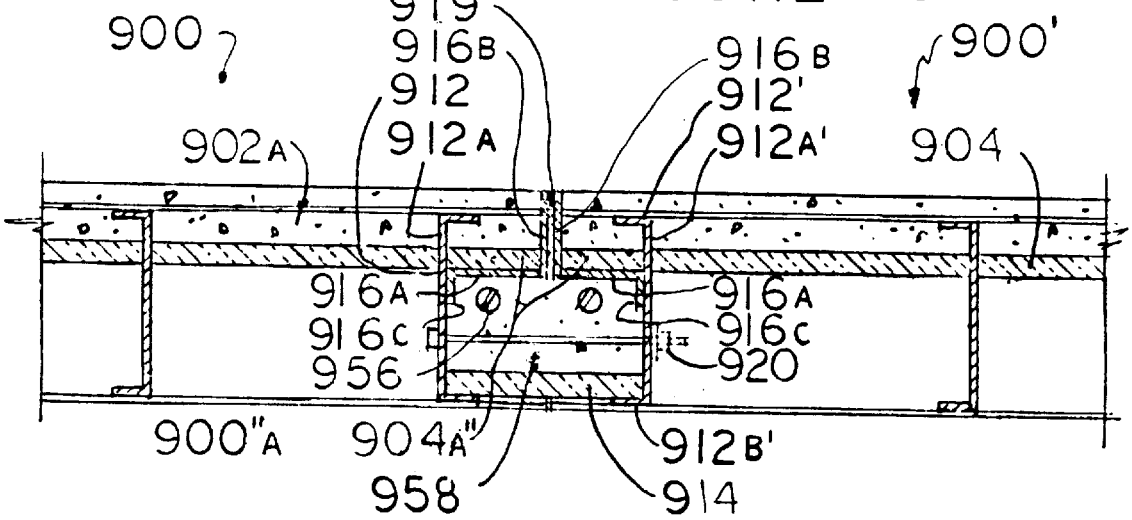
FIG. 41 is a fragmentary sectional plan view taken along lines 41—41 of FIG. 40 as viewed in the direction indicated by the arrows illustrating the further modified method of forming the load carrying beam.

As is shown in FIG. 41, a pair of elongate reinforcing bars 956 are disposed vertically oriented within the chamber 958, preferably prior to filling the chamber 958. Caulk 919 is introduced between the end plates 916 of panels 900" at the butt-joint to assure against moisture penetration thereat.

Figure 42:
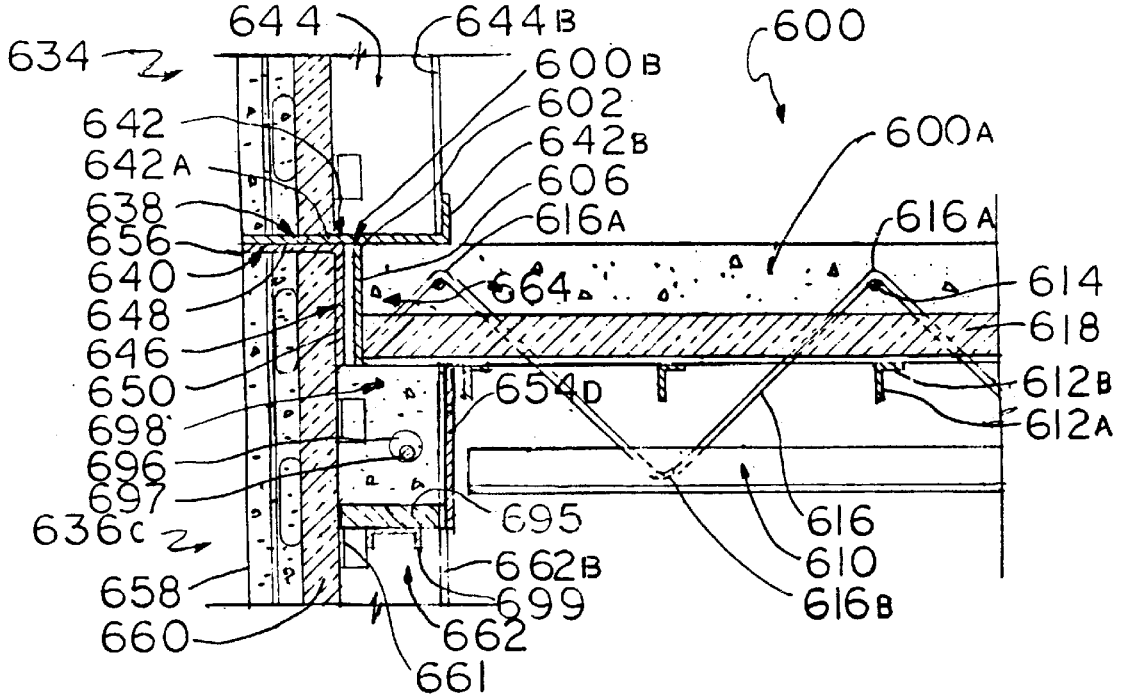
FIG. 42 is a sectional view of the modified combination arrangment of a pair of concrete panels and a concrete panel and truss arrangement similar to the combination arrangement shown in FIG. 28 and illustrating the inclusion of a panel arrangement wherein one panel thereof carries a parallel load carrying beam unitary with the combination concrete panel and truss.
Figure 43:
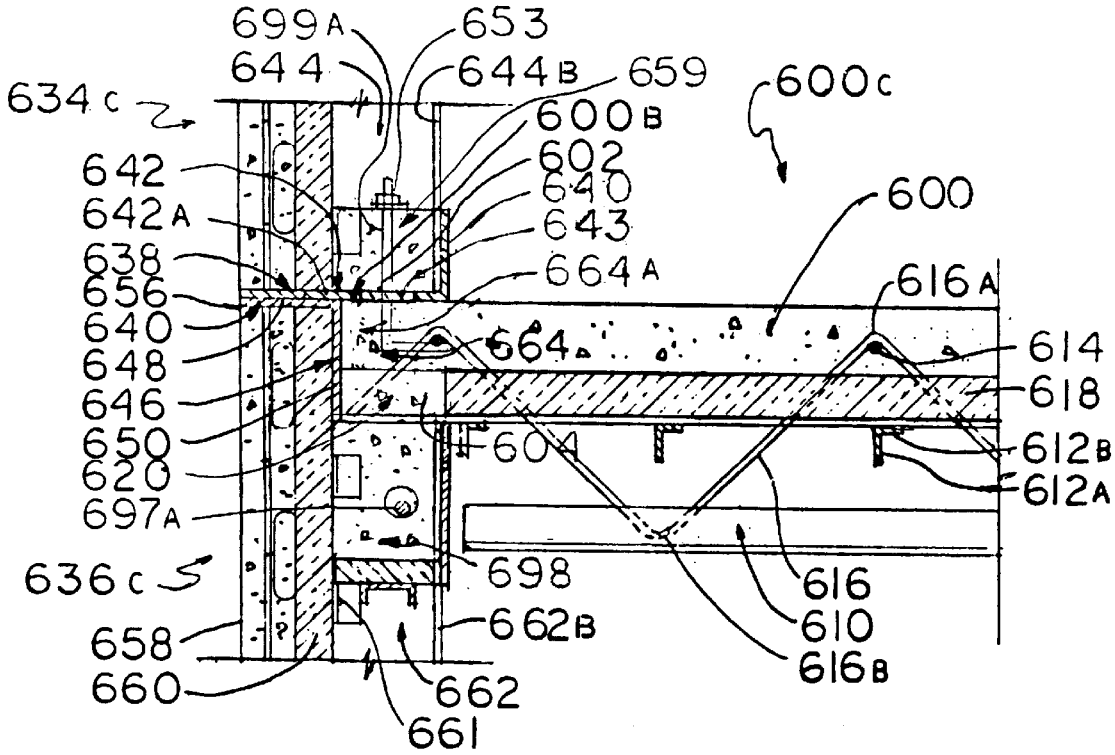
FIG. 43 is a sectional view of a modified combination arrangement of a pair of concrete panels and a concrete panel and truss arrangement similar to the combination arrangement shown in FIG. 28 and illustrating the inclusion of a panel arrangement wherein each of the panels are provided with a continuous load carrying beam perpendicular to the channels of said panels and the truss of the combination concrete panel and truss, and illustrating a method of forming same as a continuous load carrying beam.

In FIGS. 42 AND 43 there are illustrated a pair of panel arrangements which are similar to the panel arrangement shown in FIG. 28. In each of FIGS. 42 and 43 a pair of panels 634 and 636 are seated vertically oriented one upon the other. Not shown in these FIGURES are additional panels similar in construction with the panels 634 and 636 which are arranged side by side lengthwise to provide a building wall.

Each of panel arrangements shown in FIGS. 42 and 43 are distinguished by the methods employed to complete the installation thereof in a building construction. Some modifications of one of the the panels shown in FIG. 28 have been made, particularly in the panel 636, to result in modified panel 636C illustrated in FIG. 42.

In the FIGS. 42 AND 43, reference characters are employed which are the same as those directed to elements therein identical to the elements illustrated in FIG. 28. The elements which are added or modified in the modified panels are designated by additional reference characters in FIG. 42.

Directing attention to FIG. 42, and referring also to the arrangement shown in FIG. 28 for comparison, panels 634 and 600 are identical to panels 634 and 600 of FIG. 28. Panel 634 and 636C are arranged vertically oriented, panel 634 being mounted on the top of panel 636C. Modified panel 636C omits the horizontal leg 652 and the vertical leg 654 forming the section of base plate 640 extending over the upper ends of the shortened portions of channels 662. The plate 654D replaces leg 654 and is secured along a portion of the inner flange 662B of channel 662. A narrow length 695 of rigid insulation board is disposed perpendicular to the rigid insulation board 660 between said board 660 and the inner flange 662B bridging the portion of channel 662 carrying plate 654D. An elongate supporting channel 699 is secured between the webs 662A of channels 662 to support the insulation board 695. A hole 696 is formed in the channel 662 and a reinforcing rod 697 is disposed therein, within the chamber 698 defined by the rigid insulation board 660, rigid insulation board 695 and the panel 600. The panel 600 has not been modified has been modified over the panel 600 of FIG. 28 and is identical thereto.

One should note that additional panels 634 and 636D as well as the panel 600 (forming the floor of the building construction), are disposed coupled side by side and are not visible in the FIG. 42. The installation of said panels 634, 636C and 600 proceeds as follows: the outer wall 658 of panel 636C is poured when the skeletal assembly and forming structure of panel 636C is horizontally oriented. The panel 636C, with the concrete wall 658 thereof cured, is placed in vertical orientation, along with the similar side by side additional vertically oriented panels 636C. The panels 634 are placed over and upon the tops of the panels 636C. The panel 600 and the associated side by side additional panels 600 are placed in the cavity (cavities) 664 defined between the base plate 640 of panels 634 and associated side by side panels 634, and the tops of the channels 662. Concrete for forming the panel 600 can be poured while the panel 636C is assembled at the off-site manufacturer's facilities. The pouring also can be effected at the job site with the skeletal assembly and forming structure of said panel 600 introduced into the aforementioned cavity (cavities) 664.

Prior to installing panels 634 and 600, the concrete wall 658 of panel 636C has been cured. Additional side by side panels 636C have been installed. The reinforcing bar 697 has been secured to each of the side by side panels 636C. Concrete is then poured into the chamber 696 and is cured. Then panels 600 and 634 can be installed. This is accomplished at the job site and, when the concrete wall 658 is cured, connection between the numerous panels along the line defined by said panels 634, 636C and 600 by the load beam which is formed after curing of the concrete introduced into the chamber 698, said load beam extending perpendicular to the channels and along the line of the numerous side by side panels 636C.

In FIG. 43, two of the three panels of the illustrated assemblage illustrated in FIG. 42 have been modified over their counterparts 634, and 600 illustrated in FIG. 28, resulting in panels 636C, 634C and 600C. Panel 634C is provided with a bottom base plate 644B having a leg 644B longer than the leg 644A of panel 634, defining a chamber 659. The horizontal leg 644A is provided with hole 643. The panel 636C is identical to the modified panel 636 shown in FIG. 42. The panel 600C has been modified to omit a portion 604 of the rigid insulation board 618 thereby defining a path between the chamber 664A and the chamber 698 when the skeletal assembly of panel 600C is introduced into the cavity 664 defined between panels 634C and 636C. Optionally, a reinforcing angle bar 699A can be introduced in the chamber 644A before said chamber is filled. One leg 699B of angle bar 699A extends through the hole 643 formed in the bottom base plate 644 of panel 634 and terminates at the bend 616 of the web-reinforcement bar 616. Concrete can be poured simultaneously into the chambers 664A and 698 after the panel 636C is installed and the skeletal assembly of panel 600C is introduced into the cavity 664 and cured. Now the panel 634C is mounted on panels 636C and 60C, and concrete is poured into the chambers 659 defined by base plate 644, the leg 699B being disposed within chamber 659.

Figure 44:
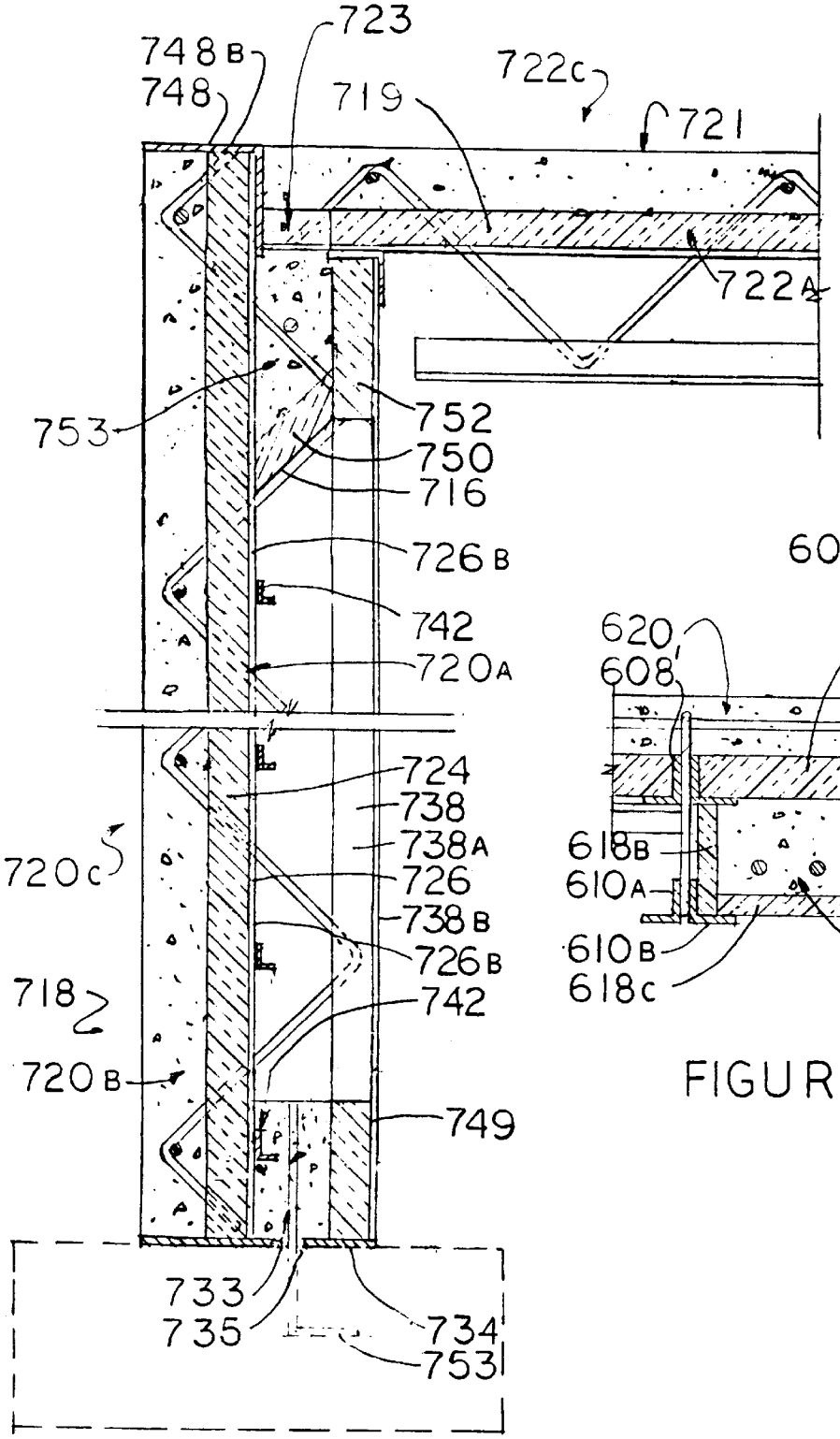
FIG. 44 is a sectional view of a modified embodiment of the arrangement of a vertically oriented combination concrete panel and truss shown coupled to a horizontally oriented combination concrete panel and truss similar to the arrangement illustrated in FIG. 32, the modification involving the provision of a load carrying beam at the lower end of the vertically oriented combination concrete beam and truss, as well as a joint load carrying beam at the upper end of said vertically oriented combination concrete panel and truss, said joint load carrying beam extending into the horizontally oriented combination concrete panel and truss, and illustrating the method of forming said respective beams; and, FIG. 45 is a fragmentary sectional detail of a modified embodiment of the combination concrete panel and truss shown in FIG. 27, said modification providing a load carrying beam as a part of the truss.

Attention now is directed to FIG. 44 wherein a modified combination concrete panel and truss assemblies 720C and 722C are illustrated. The panels 720C and 722C are modifications of the panels 720 and 722 as illustrated in FIG. 32 heretofore described. The purpose of the modifications is to improve the installation of these panels as vertically oriented and combined into an wall construction wherein the panel 720 is installed vertically oriented and secured to a footing (shown in phantom outline). The panel 722 is secured in a horizontal orientation to the top end of the panel 720. Each of the panels 720 and 722 are formed independently and assembled to their orientation coupled end to end. It would be of considerable advantage to provide a combined structure which can be completed on-site, with a portion of the structure constituting a self-contained structual beam linking the two panels and any associated side by side plural panels, and completed on site. In addition, modifications of selected sections of the panels could be made over the structures shown in FIG. 32 to improve the strength of the assembly shown in said FIGURE.

Accordingly, the reference characters designating common elements of the panels and the arrangement thereof shown in FIGS. 32 and 44 are utilized. First, referring to the concrete beam 748 in panel 720, the rigid insulation board 724 is separated into sections along its length, leaving gaps at the area of the intended beam 748, and being severed at the area of the gap 732. The panel 720C has been modified first to utilize a single unbroken length of rigid insulation board from base plate 734 to the base plate 748. Second, an elongate relatively narrow length of rigid insulation board 750 is applied angularly arranged over the web-reinforcing bar 716 between the rigid insulation board 724 and the rigid insulation board 752. The concrete is poured to form the concrete wall 720B of panel 720 when the skeletal assembly 720A and the forming structure 720B is arranged horizontally.

Panel 722C has been modified by deleting a portion 723 of the rigid insulation board 719 of the skeletal assembly of panel 722C defining a path to the chamber 753 of panel 720C. After the panel 720C is installed vertically and the panel 722C is secured over the shortened bottom double-angle strut 738, concrete can be introduced to the chamber 723 of panel 722C filling the same to form the concrete wall 721 thereof and said concrete continues to flow into the chamber 753 defining the beam thereat. The chamber 723 also is filled subsequent to the pouring and curing leading to completion of the concrete wall 721 of panel 722C.

In panel 720C, in addition to providing the rigid insulation boards 724 continuously over the length of the top double-angle strut 726, the lower beam is formed by filling the chamber 733 defined by the base plate 734 and the rigid insulation boards 724 and the section 749 and is reinforced by a reinforcing bar 753 entering the chamber 733 through a hole 735 formed in the base plate 734 and extending through the chamber, the angle portion of said bar 753 being embedded within the footing (shown in phantom outline) with the reinforcing bar 753 extending outward of the footing and hence through the concrete beam. It also should be noted that the necessity for utilzing an angle such as 744 of FIG. 32 for the purpose of securing the panel 720 to the footing, is obviated.

Figure 45:
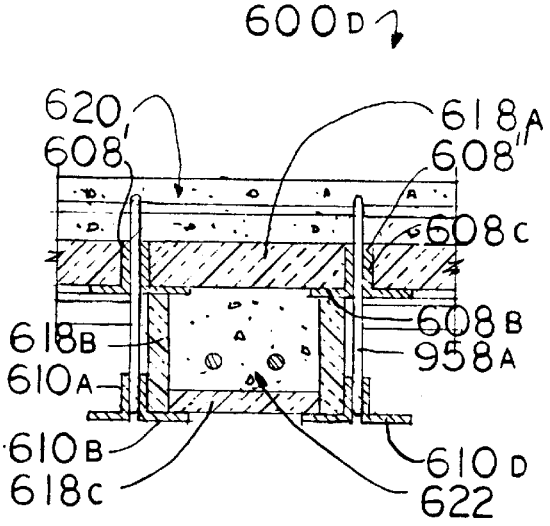

FIG. 45 illustrates a modified beam forming channel parallel to the web-reinforcement bars 958A of the truss portion of a modified combination concrete panel and truss panel similar to the combination concrete panel and truss 600 illustrated in FIGS. 27 AND 28. The modified panel is represented generally by reference character 600D. The double-angle struts 608C and 610D are closer together than the double-angle struts 608 and 610 of the panel 600. Section 618A of rigid insulation board is seated upon the legs 608B of adjacent struts 608' and 608" forming a bridge therebetween. Sections 618B of rigid insulation board are seated between the facing angles 608A and 608B and the facing angles 610A and 610B. The sections 618B being thinner than the section 618A. A section 618C of thickness the same as the thickness of section 618B is seated on the remaining horizontal portions of the facing angles 610 of said double-angle bottom struts 610, thereby to define a rectangular walled box chamber 622. Concrete is introduced into the chamber 620 first when the skeletal arrangement and the forming structure thereof is arranged horizontally oriented. Upon completion of the resulting concrete wall of the panel 600C, the chamber 622 is filled with concrete by pouring the concrete thereinto when the panel is oriented vertically, thereby defining, when the concrete is cured, a beam parallel to the struts 608' and 610'. If the section 618A is omitted, the concrete can be introduced into chamber 620 from which it passes to the chamber 622, forming the parallel beam and the concrete wall with a single pour of concrete while the said skeletal assembly and forming structure are oriented horizontally.

In the course of providing the pre-fabricated self-contained building panel of the invention, and particularly, the various described embodiments thereof, attention has been directed to the realization of the capability of the respectively described skeletal assemblies developed to function independently as concrete forms serving as means to provide architectural bodies heretofore not capable of being produced combined as an element of a pre-fabricated self-contained wall panel but also which can function as stand-alone structures, such as columns or load-carrying beams integral with building panels or walls formed of structural steel channels, said resulting load-carrying beams being directed parallel and/or providing a unique load-carrying beam extending along the top of a building panel and directed perpedicular to the structural steel channels thereof, as well as load-carrying beams unitary with the building wall and disposed integral with a vertically oriented beam or column, said load-carrying beams extending horizontally outward thereof.

Figure 46:
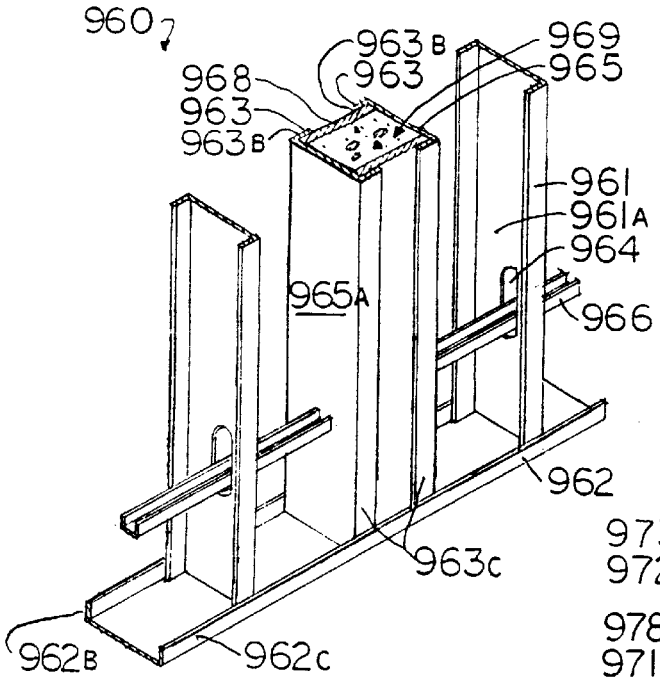
FIG. 46 is an isometric view of a concrete form according to the invention for providing a structural column independent of or combined with a building structure.
Figure 47:
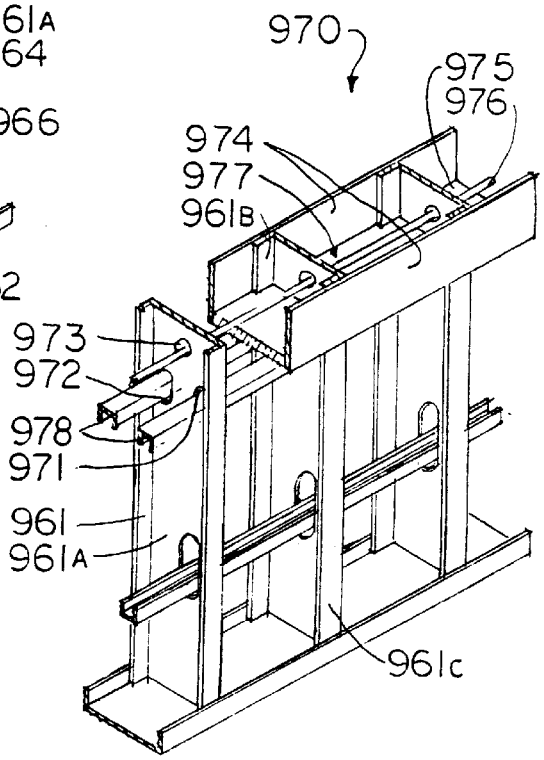
FIG. 47 is an isometric view of a concrete form according to the invention similar to the concrete form illustrated in FIG. 46 but modified to provide a structural beam resting on, and as a part of, a building structure; and, FIG. 48 is an isometric view of a concrete form according to the invention similar to the concrete form illustrated in FIG. 46 but modified to provide a horizontally disposed structural support beam in combination with a building structure.
Figure 48:
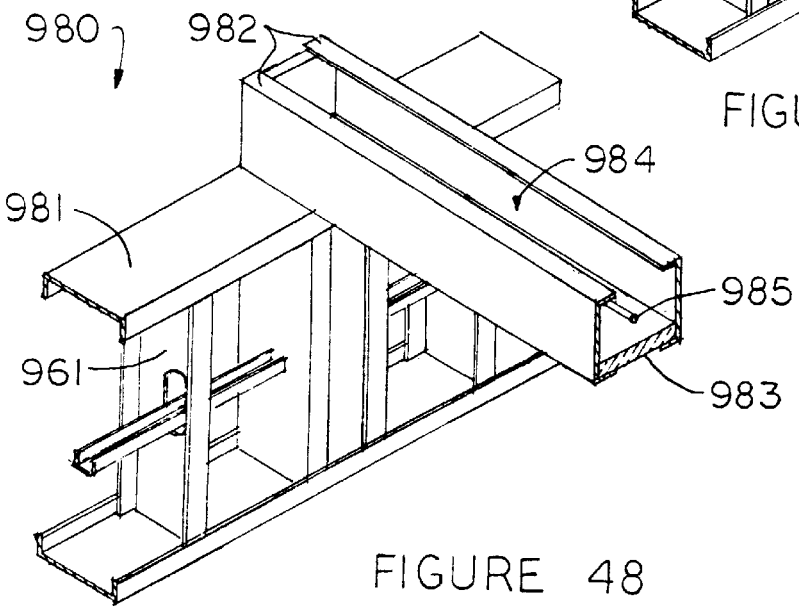

Directing attention to FIGS. 46 through 48 wherein there are illustrated concrete forms embodying the invention which enable the provision either as an element within a building panel or a stand-alone building column; a load-carrying beam disposed along the top of a building panel and extending perpendicular to the channel array forming the structureal basis of the building panel; and a load-carrying beam unitary with a vertical column disposed within a pre-fabricated building panel and extending horizontally outward from the vertical column (and the panel) in a direction perpendicular thereto.

In FIG. 46, the concrete form according to the invention, is designated generally by reference character 960. The concrete form 960 comprises an array of vertically oriented structural steel channels having opposite longitudinal edge flanges, said structural steel channels 961 are seated spaced in a row within a bottom base plate 962 having opposite flanges 962B and 962C. Of said channels 961, a pair of facing channels 963 are disposed intermediate to the channels 961. Channels 961 each are provided with at least a hole 964 in the central web 961A thereo, said holes 964 of the channels 961 being aligned. Narrow supporting channels 966 are directed through the aligned holes 964 and secured to the respective steel channels 961 as well as secured to the outwardly facing surfaces 965A of the imperforate webs 965 of the facing channels 963. Rigid insulation boards 968 are disposed between the facing channels adjacent 963 adjacent the opposite flanges 963B and 963C thereof, said rigid insulation boards 968 being seated on the base plate 962, thereby defining a vertical concrete receiving chamber 969. Concrete is introduced vertically into the chamber 969 thereby to form a concrete column as an element combined with a building structrue, here one utilizing the respective channels 961.

In FIG. 47, a modified embodiment of the concrete form embodying the invention is designated generally by reference character 970. Elements of concrete form 970 which are common with the corresponding elements shown in respect of concrete form 960, will be designatd by the same reference characters employed in FIG. 46. Each of the vertically oriented channels 961 are provided with a first pair of side-by-side holes 971, 972 formed in the webs 961A thereof, proximate the upper ends of said channels 961. A third hole 973 also is provided in said webs 961A of channels 961 at a predetermined location thereat. The holes 971, 972 and 973 of each of the channels 961 are aligned. A pair of narrow U-shaped steel channels 978, similar to the channels 966 are passed through the side-by-side holes 971, said narrow channels 978 opening downwardly to provide planar mid-portions.

A pair of plates 974 are secured to the upper portions of the respective flanges 961B and 961C of each of the channels 961. A rigid plate 975 is disposed between the plates 974 and between the channels 961, said plate 975 resting upon and secured to the planar mid-portions of the narrow channels 978 between the pair of plates 974. An elongate reinforcing bar 976 is passed through the holes 973 and is disposed along said rigid plate 975. The assembly of said plates 974, said channels 961 and said plate 975 define a top opening concrete receiving chamber 977 into which concrete can be introduced filling the chamber 977 to define a load-carrying beam extending along the top of the form to be utilized with the building structure.

In FIG. 48, a modified embodiment of the concrete form of the invention as illustrated in FIGS. 46 and 47 is designated generally by reference character 980 and comprises a skeletal structure similar to that of concrete form 960 but, additionally, having the top of the channels 961 fitted within an elongate oppositely flanged top base plate 981 into which the upper ends of the channels 961 are seated in and secured thereto. A pair of facing channels 982 are coextensively seated on and secured to the top base plate 981 and extend outward thereof. A section 983 formed of rigid insulation board or other rigid material is seated and secured between the top base plate 981. The channel thus defined is closed off at its ends to define a concrete receiving chamber 984 extending in a direction perpendicular to the channels 961. Optionally, a reinforcing bar 985 can be placed within the chamber 984. The concrete receiving chamber 984 is filled with concrete to define a beam extending outward from the channel assembly.

It should be pointed out that the column illustrated in FIG. 46 can be formed as a structurel column using only a pair of facing channels and the rigid insulation boards defining the concrete receiving chamber 969.

It should be understood by one skilled in the art, that although the preferred self-hardening material is concrete and its various concrete compositions, other self-hardening materials such as clay, mud and even certain self-hardening resinous compositions can be employed for the formation of the self-contained pre-fabricated building panels, including the combination self-contained pre-fabricated building panels and truss structures according to the invention when concrete and concrete compositions may not be readily available. It is important to recognize that the said self-contained pre-fabricated building panels and the combination pre-fabricated building panels and truss structures according to the invention can be fabricated either at the manufacturing plant or on a construction site.

Many variations are contemplated in the structures of the concrete panels, methods, etc. disclosed in the foregoing specification without departing from the scope of the invention disclosed and claimed. The prospective uses of the panels described and claimed herein are many and varied without departing from the scope of the invention, including the panels, the methods of making same and the truss structure alone and incorporated within the various panels.

What I claim is:

1. A molded self-contained pre-fabricated building panel comprising:

a. a skeletal assembly having opposite sides and including an array of structural steel channels each arranged in a generally parallel row, said channel array including spaced channels having opposite top and bottom ends, base-plate means seating said channel array, at least a rigid sheeting disposed along at least one side of said skeletal assembly, said channel array, said base-plate means and said rigid sheeting defining a forming structure, b. a self-hardening material within said forming structure with at least a portion of said skeletal assembly embedded therein, and, c. said forming structure being retained as an integral part of said building panel.

2. The building panel according to claim 1 in which each of said structural steel channels include an elongate web having at least one longitudinal edge flange, said rigid sheeting resting upon said one longitudinal edge flange.

3. The building panel according to claim 2 in which said elongate web includes a row of spaced holes formed therein along the length thereof.

4. The building panel according to claim 2 in which said channels each includes an elongate web having opposite edges and a pair of said longitudinal edges flanges along said opposite edges of said web, said rigid sheeting resting upon said longitudinal edge flanges.

5. The building panel according to claim 4 in which at least one of said pair of longitudinal edge flanges carries spaced holes formed therein along the length thereof.

6. The building panel according to claim 1 in which said web includes at least a pair of unitary punch-out tabs formed therein, said tabs bearing against said rigid sheet.

7. The building panel according to claim 1 in which said channels have a pair of opposite longitudinal edge flanges and a central elongate web, said base-plate means extending the length of said skeletal assembly including a top base plate and a bottom base plate, each of said base plates having opposite end flanges, said channel array seated within said top base plate and angles secured to at least one of said end flanges respectively of said top and bottom base plates whereby to define a chamber receiving said self-hardening material forming an outside wall of self-hardened material.

8. The building panel according to claim 1 in which said rigid sheeting comprise rigid insulation boards.

9. The building panel according to claim 8 in which said rigid insulation boards are disposed between each of said channels along said webs thereof.

10. The building panel according to claim 8 in which said rigid sheeting extends continuously over both said longitudinal edge flanges of said channels.

11. The building panel according to claim 7 in which said angles are secured to said top and bottom base plates along the length thereof defining said chamber.

12. The building panel according to claim 11 in which a pair of said angles have horizontally extending legs, one of said pair of angles which is secured to said top base plate has a horizontally outwardly extending leg which is longer than said horizontally extending leg of the other one of said pair of angles which is secured to said top base plate whereby to define said outside wall.

13. The building panel according to claim 11 in which one of said pair of angles which is secured to said top base plate has a horizontally extending leg and a vertical leg, said horizontally extending leg being longer than said horizontally extending leg of the other one of said pair of angles which are secured to said top plate whereby to define a thickened portion of said outside wall formed of said self-hardening material.

14. The building panel according to claim 13 in which said longer horizontally extending leg has a load bearing capacity.

15. The building panel according to claim 13 and an additional angle is secured to one of said opposite longitudinal edges flanges of said channels of said channel array at a location between said top and bottom base plates, said additional angle including an outwardly extending horizontal leg capable of defining an additional thickened portion of said outside wall formed of said self-hardening material and located between said top and bottom base plates.

16. The building panel according to claim 15 in which said rigid sheeting comprise rigid insulation boards, and an additional angle is secured to one of said rigid insulation boards and to an adjacent one of said longitudinal edge flanges of said channels, said additional angle having a horizontal outwardly extending leg having a load carrying capacity.

17. The building panel according to claim 3 and reinforcing means disposed through selected spaced holes in said webs of said channels of said channel array.

18. The building panel according to claim 17 in which sid reinforcing means comprise reinforcing bars.

19. The building panel according to claim 3 in which plural narrow cold-rolled steel support channels are each arranged horizontally parallel passing through selected ones of said spaced holes formed in said webs of said spaced channels and bearing against said rigid sheeting.

20. The building panel according to claim 2 in which said rigid sheeting comprises steel decking secured to said longitudinal flanges of said channels of said skeletal assembly.

21. The building panel according to claim 20 in which said decking is disposed adjacent said longitudinal flanges of said channels and exterior thereof.

22. The building panel according to claim 20 in which said longitudinal edge flanges have inner portions and portions of said decking are disposed below said longitudinal edge flanges and secured to said inner portions of said longitudinal edge flanges and said portions of said decking are disposed between said longitudinal edge flanges of said channels.

23. The building panel according to claim 1 in which selected pairs of said channels of said channel array have ends open to the atmosphere and said bottom base plate has an elongate web having at least one hole formed therein permitting gravity flow of self-hardening material therethrough forming a unitary footing along the length of said panel.

24. The building panel according to claim 1 in which said forming structure is filled entirely with said self-hardening material and said forming structure, including said skeletal assembly thereof, is embedded in said self-hardening material.

25. The building panel according to claim 1 in which a pair of facing spaced intermediate channels is introduced between an adjacent pair of said channels of said channel array defining said skeletal assembly and seated within said bottom base plate, said pair of facing spaced intermediate channels having open ends, a section of rigid sheeting is disposed tightly between said pair of intermediate spaced facing channels defining an open upper ended chamber between said section of rigid sheeting and said bottom base plate, said building panel capable of being vertically oriented subsequent to formation of said hardened outside wall thereof with said open upper ended chamber capable of receiving self-hardening material therein filling same, said self-hardening material being hardened and said panel remaining vertically oriented whereby to define a beam extending parallel to said pair of intermediate spaced facing channels and a cavity capable of receiving one end of a structural beam therein.

26. A self-contained building panel assembly comprising a skeletal assembly, a forming structure enclosing at least a portion of said skeletal assembly and a hardened self-hardening material embedding said portion of said skeletal assembly, said forming structure becoming a permanent integral part of said building panel, said skeletal assembly including a first section formed of a plurality of parallel spaced structural steel channels arranged in a spaced array thereof, each of said structural steel channels having opposite upper and lower ends, a central web and at least one longitudinal edge flange along the length thereof, at least one row of spaced holes formed in said central webs along said channels of said channel array, base-plate means secured to at least one of said opposite ends of said channels, rigid sheeting means applied to said channels of said channel array proximate to at least one longitudinal edge flange thereof along the length of said channels, reinforcing means arranged through selected spaced holes formed in said central webs of said channels, support means arranged closely proximate said rigid sheeting means and angles secured to said base-plate means and said longitudinal edge flange of said channels, said forming structure including said angles, said base-plate means and said rigid sheeting means defining a chamber receiving said self-hardening material.

27. The building panel according to claim 26 in which said rigid sheeting means comprise rigid insulation boards.

28. The building panel according to claim 27 in which said rigid insulation boards are disposed between each of said channels.

29. The building panel according to claim 27 in which said rigid sheeting means comprise a rigid insulation board disposed over at least one said longitudinal edge flange of said channels and secured thereto.

30. The building panel according to claim 26 in which punch-out tabs are provided along the length of said spaced channels between said row of spaced holes and said at least one longitudinal edge flange thereof, said tabs being capable of bearing against said rigid sheeting means.

31. The building panel according to claim 26 in which at least one of said angles has a longer outwardly directed leg capable of supporting a structural load component.

32. The building panel according to claim 26 in which said base-plate means include a bottom base plate seating said channel array.

33. The building panel according to claim 32 in which said upper ends of said channels are open to the atmosphere during receipt of said self-hardening material.

34. The building panel according to claim 32 in which said bottom base plate includes openings permitting said self-hardening material to pass therethrough defining a unitary footing for said building panel.

35. The building panel according to claim 26 in which said base-plate means further include a top base plate having a Z-shaped configuration formed of a first horizontal leg having a depending end flange and a vertical leg terminating in a second horizontal leg thereof extending outwardly of said vertical leg, said second horizontal leg extending over said panel.

36. The building panel according to claim 26 in which said base-plate means further include a bottom base plate having a C-shaped configuration formed of a first horizontal leg having one edge and a vertical leg along said one edge thereof, a return bent second horizontal leg extending parallel to said first horizontal leg, said first horizontal leg extending along said building panel, said return bent second horizontal leg of said Z-shaped top base plate being coextensive with said first horizontal leg, said vertical leg and said return bent second horizontal leg of said Z-shaped top base plate with said C-shaped bottom base plate defining a chamber receiving said self-hardening material thereby defining both an outside wall and a beam of said building panel, said beam extending perpendicular to said spaced channels.

37. The building panel according to claim 26 in which said base-plate means further include a bottom base plate plate having a C-shaped configuration formed of a first horizontal leg having a vertical leg, said vertical leg having a return-bent second horizontal leg extending parallel to said first horizontal leg, said first horizontal leg extending over one end of said panel, said C-shaped base plate defining a chamber receiving said self-hardening material thereby to form a beam of said panel extending perpendicular to said channels.

38. The building panel according to claim 26 in which said base-plate means include a bottom base plate formed of a vertical leg and a horizontal leg, a bridging section of rigid sheeting disposed between said vertical leg and said rigid sheeting along one longitudinal edge flange of said channels, said channels having at least one additional hole formed therein between said bridging section and said horizontal leg of said bottom base plate, said vertical and said horizontal leg together defining a chamber capable of receiving said self-hardenable material thereby enabling the formation of a beam extending perpendicular to said channels.

39. The building panel according to claim 26 in which said base-plate means include top and bottom base plates each having inner and outer opposite end flanges, and an additional section comprising a first angle secured to said inner end flange of said top base plate of said first section and having a horizontal leg and a vertical leg, and a second angle having a horizontal leg and a vertical leg, said vertical leg of said second angle being secured to said inner end flange of said bottom base plate of said first section, said vertical leg of said second angle being substnatially longer than said vertical leg of said first section and is secured to said inner end flange of said bottom base plate of said first section, said horizontal leg of said second angle extending coextensive with said horizontal leg of said first angle, rigid sheeting disposed between said horizontal legs of said first and second angles adjacent said vertical legs of said first and second angles to define an additional receiving chamber capable of receiving said self-hardening material, said first chamber being filled with self-hardening material and hardened, said first section being invertable, said additional chamber being capable of being filled with self-hardening material and hardened thereby forming hardened walls on opposite sides thereof, a vertically oriented second building panel having an upper end, said horizontal leg of said second angle being secured to said upper end of said vertically oriented second building panel, caulking being introduced between the juncture of said horizontal leg of said second angle and said upper end of said vertically oriented second building panel thereby defining a cavity capable of receiving a horizontally oriented construction component.

40. A self-contained pre-fabricated building panel comprising:

a. a skeletal assembly, b. a forming structure enclosing said skeletal assembly, c. a hardened hardenable material embedding said skeletal assembly within said forming structure, d. said skeletal assembly being formed of plural elongate structural steel spaced channels, each spaced channel having opposite top and bottom ends, each spaced channel having a central web and a pair of opposite longitudinal edge flanges extending along the length of said said spaced channel, at least one of said spaced channels having at least one row of spaced holes in said central web thereof, base-plate means secured to at least one adjacent pair of said opposite ends of a pair of adjacent spaced channels, to said bottom ends and to adjacent opposite longitudinal edge flanges of said spaced channels, at least said one pair of adjacent spaced channels having said top ends being open to the atmosphere, and, rigid sheeting means secured to at least one of said opposite longitudinal edge flanges of said spaced channels, e. said forming structure including said elongate structural steel spaced channels, said base-plate means and said rigid sheeting means and becoming an integral permanent part of said building panel subsequent to hardening of said hardenable material, and, f. said hardenable material being introduced through said open top end of said panel.

41. The building panel according to claim 40 wherein said forming structure ia embedded within said self-hardening material.

42. The building panel according to claim 40 and a pair of additional panels coupled to said ends of said building panel forming inside and outside corners and means securing said building panels together, said row of holes in said central web of said spaced channels defining a path for said hardenable material to enable filling said forming structure thereof.

43. The building panel according to claim 40 in which plural ones of said additional panels are secured end to end respectively defining at least a pair of corner junctures and at least one abutting juncture, said junctures having outwardly facing surfaces and water-stop means having lower ends and being secured to said outwardly facing surfaces at selected ones of said junctures along the length thereof.

44. The building panel according to claim 43 in which a weep-passage is defined at the lower ends of said water-stop means.

45. The building panel according to claim 43 in which said water-stop means are formed by securing angle members at said junctures.

46. The building panel according to claim 45 in which said water-stop means are formed by securing angle members at said junctures.

47. The building panel according to claim 45 in which said water-stop means are formed by securing angle members at said corner junctures and a plate member is secured over said at least one abutting juncture.

48. In combination, said self-contained building panel assembly according to claim 27 and a structural building truss as an integral part thereof, said building truss comprising at least a spaced pair of vertically aligned top and bottom double-angle struts, each said double-angle strut of said pair having top and bottom gaps, said pair of top and bottom double-angle struts arranged aligned one above the other with said top and bottom gaps vertically aligned one above the other, an elongate web-reinforcement bar being disposed secured within said top gap and said web-reinforcement bar continuing further along said top double-angle strut with a first upper bend above the level of said top gap, said web-reinforcement bar then continuing further along said top double-angle strut in a generally straight line direction but angularly toward said bottom double-angle strut to enter said bottom gap and seating the following lower bend secured within said bottom gap, said web-reinforcement bar then continuing thereafter along its length in a straight line direction angularly toward said top double-angle strut to and through said top gap of said top double-angle strut and above the level of said top gap and then secured therein with said next following upper bend above said top double-angle strut, said web-reinforcement bar then continuing along its length alternating with said respective following bends similarly disposed between said top and bottom gaps until said opposite end of said web-reinforcement bar is reached.

49. A structural steel building truss comprising at least a pair of linearly spaced top and bottom double-angle struts, each of said top and bottom double-angle struts have top and bottom gaps respectively, each of said top and bottom double-angle struts being arranged vertically aligned one above the other with said gaps thereof aligned, an elongate web-reinforcement bar having opposite ends and plural alternating upper and lower bends along the length thereof, one end of said web-reinforcement bar being secured within said top gap of said top one of said top one of said pair of top and bottom double-angle struts, said reinforcement bar then continuing along said top one of said top and bottom double-angle struts with a first upper bend of said web-reinforcement bar being above the level of said top gap of said top double-angle strut, said web-reinforcment bar continuing along said one top double-angle strut of said one pair of top and bottom double-angle struts in a generally straight line but angularly toward said one bottom double-angle strut of said one of said pair of top and bottom double-angle struts to enter said bottom gap thereof seating the following next bend of said one bottom double-angle strut of said pair of top and bottom double-angle struts secured within said bottom gap, said web-reinforcement bar then continuing thereafter along its length in a straight line direction anglarly toward said one top double-angle strut of said other pair of said top and bottom double-angle struts to and through said top gap of said one top double-angle strut of said other pair of top and bottom double-angle struts and above the level of said top gap of said top double-angle strut of said other pair of top and bottom double-angle struts to and through said top gap of said one top double-angle strut of said other pair of top and bottom double-angle struts and above the level of said top gap of said top double-angle strut of said other pair of top and bottom double-angle stucts and being secured therein with said next bend of said web-reinforcement bar above said one of said top double-angle strut of said other pair of top and bottom double-angle struts and being secured the continuing along its length alternating with said bends similarly between said top and bottom gaps until said opposite end being secured to one of said top and bottom double-angle struts which is coincident with said opposite end, said truss being capable of extending between a pair of vertical supports.

50. A structural steel building truss according to claim 49 in combination as an integral part of a self-contained pre-fabricated concrete building panel, said building panel formed of a skeletal assembly including a rectangular frame having opposite end plates and opposite edge plates, plural spaced parallel purlins arranged between said end plates and secured thereto, said top double-angle struts resting on and secured to said purlins, rigid sheeting positioned between each of said purlins and between each of said purlins and between said top double-angle struts and said end plates, a concrete receiving chamber defined above said rigid sheeting bounded by said rectangular frame, plural reinforcing bars disposed parallel spaced within said concrete receiving chamber and between said end plates, said reinforcing bars extending below said top bends of said web-reinforcement bars of said truss structure with said bottom double-angle struts exterior of said building panel, concrete being introduced to said concrete receiving chamber forming an outer concrete wall embedding said top bends and said reinforcement bars of said truss structure with said bottom double-angle struts exterior of said building panel.

51. The structure according to claim 49 wherein a mid-portion of said rigid sheeting between said edge plates is deleted to define an elongate gap portion and an angle plate member is secured to said top double-angle struts bridging said elongate gap, said concrete being introduced to said concrete receiving chamber and passing through said elongate gap portion to occupy the interior of said angle plate member, said self-contained pre-fabricated concrete building panel being vertically oriented and having an upper end, said angle plate member capable of being connected to said vertically oriented self-contained concrete building panel in an assembly wherein said resulting truss and concrete panel are angularly disposed forming the roof of a building construction.

52. The structure according to claim 49 wherein said end plates and said edge plates encompass said truss and concrete panel, a first portion of said rigid sheeting adjacent one end of said edge plate is deleted defining a flow-through gap thereat, a first section of rigid sheeting is disposed along said bottom double-angle strut extending from one end of said edge plate and a second section of rigid sheeting is disposed between said top double-angle strut and said first section of rigid sheeting to bridge the space therebetween whereby to define a second concrete receiving chamber, a second portion of said rigid sheeting spaced from said opposite edge plate is deleted, a third section of rigid sheeting is disposed along said bottom double-angle strut from said opposite edge plate and a fourth section of rigid sheeting is disposed along said web-reinforcement bar between said remaining rigid sheeting disposed along said bottom double-angle strut whereby to define a third concrete receiving chamber, said second and third concrete receiving chambers capable of being filled with concrete simultaneously with the introduction of concrete into said first concrete receiving chamber.

53. The structure according to claim 52 in which said opposite edge plate is formed of a Z-angle, said Z-angle having an intermediate leg extending along said top double-angle strut and a second leg extending between said intermediate leg and said bottom double-angle strut, including said fourth section of rigid sheeting.

54. The structure according to claim 51 in which said second leg defines a shelf and an additional pre-fabricated concrete building panel and truss is seatable upon said shelf to extend perpendicular to said vertically oriented self-contained pre-fabricated concrete building panel and truss.

55. In combination, a first self-contained pre-fabricated bulding panel and at least an additional self-contained pre-fabricated panel, said additional self-contained pre-fabricated building panel including a skeletal assembly formed of plural spaced elongate structural sheet channels arranged seated between top and bottom base plates, said channels having a central web and opposite longitudinal inner and outer flanges along the length thereof, a first row of spaced holes formed in said central web along the length thereof and first rigid sheeting disposed adjacent said first row of spaced holes, a second row of spaced holes formed in said web adjacent said rigid insulation board and between said first rigid sheeting and said inner longitudinal flange; said channels, said base plates and said first rigid sheeting together constituting a forming structure for said additional self-contained pre-fabricated building panel, and a hardened concrete wall formed interior of said forming structure along said outer longitudinal flange and said first rigid sheeting; said first self-contained pre-fabricated also comprising a skeletal assembly and a forming structure therefor enclosing at least a portion of said skeletal assembly, a hardened concrete wall embedding said portion of said skeletal assembly within said forming structure, said forming structure becoming an intimate part of said first self-contained pre-fabricated building panel; said skeletal assembly of said first self-contained pre-fabricated building panel being formed of a plurality of parallel spaced elongate structural steel channels arranged in an array thereof, each of said structural steel channels having a central web and opposite elongate longitudinal inner and outer edge flanges along the length thereof, a first self-contained pre-fabricated building panel including a first row of spaced holes formed in said central web of said structural steel channels along the length thereof, at least a pair of first rigid sheetings arranged along said central web adjacent said first row of spaced holes, a second row of spaced holes formed in said central web adjacent said rigid sheetings, support means arranged along said channels proximate said first rigid sheetings, a diagonally disposed additional rigid sheeting secured between one of said first rigid sheetings and said outer longitudinal flange of said channels bridging the spaced therebetween and a further additional rigid sheeting bridging the spaced between said pair of first rigid sheetings and said outer longitudinal flange of said channels and a bridging angle secured to said top base plate of said additional self-contained pre-fabricated building panel whereby said first self-contained pre-fabricated building panel is sloped relative said additional pre-fabricated building panel thereby defining a roof construction.

56. A self-contained pre-fabricated building panel having opposite sides, opposite ends and an outer concrete wall, said self-contained pre-fabricated building panel including a spaced array of structural steel channels, each spaced channel having a central web and opposite inner and outer longitudinal edge flanges along the length thereof, at least one base plate seating said spaced channels, at least a pair of spaced channels facing eachother, said facing channels having upper ends, a rigid sheeting disposed between said facing channels, a first concrete receiving chamber defined adjacent said rigid sheeting and including a portion of said facing channels and a first elongate section of rigid material arranged between said central webs of said facing channels and engaging said inner edge flanges of said facing channels along the length thereof defining a second concrete receiving chamber, said first concrete receiving chamber being capable of being filled with concrete when said self contained pre-fabricated building panel is oriented horizontally and said second concrete receiving chamber being capable of receiving concrete filling therein subsequent to completion of said outer concrete wall whereby defining a beam within said second concrete receiving chamber, said beam formed parallel to said spaced array of channels.

57. The building panel according to claim 56 in which a second elongate section of rigid material is introduced between said central webs of said facing channels extending along said vertically oriented self-contained concrete building panel.

58. The building panel according to claim 56 in which a rigid plate is seated between said pair of facing channels below said upper ends thereof and on top of said beam whereby to support a structural member extending horizontally outward thereof.

59. The building panel according to claim 56 in which a rectangular narrow section of rigid material is disposed between said central webs bridging said facing channels adjacent said upper ends thereof.

60. The building panel according to claim 59 and angular support means are secured to said central webs of said pair of facing channels adjacent said narrow rigid section.

61. The building panel according to claim 58 in which a rigid plate is seated between said pair of facing channels at a location below said upper ends thereof and said narrow section defining a path capable of introducing concrete to form said outer concrete wall and said beam simultaneously.

62. The building panel according to claim 59 in which reinforcing bar means are disposed within said beam.

63. The building panel according to claim 58 in which said concrete receiving chamber defined between said pair of facing channels is capable of receiving concrete thereinto, said second elongate section of rigid material and said first elongate rigid sheeting are disposed adjacent said inner longitudinal flanges of said pair of facing channels, said concrete receiving chambers being arranged to enable introduction of concrete thereinto through the upper end of said first and second concrete receiving chambers subsequent to completion of said outer concrete wall.

64. The building panel according to claim 56 and support means arranged horizontally along said rigid sheeting between said channels of said spaced channel array other than said facing channels.

65. The building panel according to claim 59 in which a rigid member is secured to said central webs of said pair of facing channels between said facing channels bridging same at a location below said upper ends thereof defining a shelf capable of supporting a structural member extending outward therefrom.

66. The building panel according to claim 56 in which vertically arranged reinforcing bar means are disposed between said facing channels.

67. The building panel according to claim 56 and an additional self-contained pre-fabricated building panel is arranged end to end with said self-contained pre-fabricated building panel coupled thereto, each self-contained pre-fabricated building panel having a skeletal assembly including structural steel spaced channels having opposite edge flanges along the lengths thereof and rigid sheeting formed of rigid insulation disposed between said spaced channels, a pair of said channels arranged respectively at an end of said building panels, one of said pair of channels facing the other one of said pair of channels, Z-angle means disposed between said pair of facing channels defining a butt joint between said building panels, said Z-angle means including unitary angles extending along said rigid sheeting and terminating secured to said webs of said facing channels and defining, with said facing channels and said elongate section of rigid material, said second concrete receiving chamber effective to define said butt-joint effecting coupling of said end to end arranged adjacent building panels.

68. The building panel according to claim 56 in which anchor bolt means are secured to said facing channels bridging same.

69. In combination as an assembly, a vertically oriented self-contained pre-fabricated concrete and steel building panel and truss and a horizontally oriented self-contained building panel and truss coupled thereto; said vertically oriented self-contained pre-fabricated building panel and truss formed of a skeletal assembly including a rectangular frame having opposite end plates and opposite edge plates, plural spaced parallel purlins arranged between said opposite end plates and secured thereto; plural sets of top and bottom double-angle struts arranged spaced between said opposite end plates, each of said top and bottom double-angle struts having top and bottom gaps between said respective angles thereof, each set of top and bottom double-angle struts being vertically aligned one above the other with said top and bottom gaps thereof being vertically aligned, an elongate web-reinforcement bar having opposite ends and plural alternating upper and lower bends along the length thereof, one end of said web-reinforcement bar being disposed adjacent one of said opposite edge plates with one end of said web-reinforcement bar secured within said top gap of said top double-angle strut with a first upper bend above the level of said top gap, said web-reinforcement bar then continuing along said top double-angle strut in a generally straight line direction angularly toward said bottom double-angle strut to enter said bottom gap thereof, said web-reinforcement bar then continuing further along its length in a generally straight-line direction angularly toward said top double-angle strut to and through said top gap of said top double-angle strut above the level of said top gap and secured therein with the next upper bend thereof above said top gap, said web-reinforcement bar continuing along its length alternating with said upper and lower bends between said top and bottom gaps until said opposite end thereof is reached and said opposite end being secured to a one of said top and bottom double-angle struts which is coincident with said opposite end thereof and the other one of said opposite edge plates, plural spaced purlins arranged between said opposite end plates and secured thereto, said top and bottom double-angle struts resting on and secured to said spaced purlins, rigid sheetings positioned between each of said top double-angle struts and said end plates, a first concrete receiving chamber bounded by said rectangular frame, plural spaced parallel reinforcing bars disposed between said opposite end plates within said first concrete receiving chamber and passing through and below said upper bends of said web-reinforcement bar of said truss, tie means tying said reinforcing bars to said upper bends of said web-reinforcement bar, said bottom double-angle struts being exterior of said panel, said first concrete receiving chamber being capable of receiving concrete introduced thereinto forming an outer concrete wall embedding said tied upper bends of said web-reinforcement bar and said reinforcing bars therein, said vertically oriented self-contained building panel and truss arrangable on said one of said opposite edge plates thereof, a section of rigid sheeting arranged seated on said one of said opposite edge plates and extending along said bottom double-angle strut defining a second concrete receiving chamber bounded by said section section of rigid sheeting and said one of said opposite edge plates, said other one of said opposite edge plates being formed as an angle having a horizontal leg extending along the upper end of said vertically oriented panel and truss and a vertical leg engaged with said top double-angle strut, an additional rigid sheeting arranged on said bottom double-angle strut of said vertically oriented building panel and truss, said additional rigid sheeting extending from the vertically uppermost portion of said vertically oriented building panel and truss and a diagonally oriented rigid sheeting arranged along a portion of said web-reinforcement bar and engaged with said additional rigid arranged on said bottom double-angle strut defining a third concrete receving chamber having an open top; said horizontally oriented self-contained pre-fabricated building panel and truss being formed of a skeletal assembly including a rectangular frame having opposite end plates and edge plates, plural spaced parallel perlins arranged between said end plates and secured thereto, plural top and bottom double-angle struts resting on and secured to said purlins, a further rigid sheeting each of said top double-angle struts and said end plates of said horizontally oriented self-contained pre-fabricated building panel and truss, a fourth concrete receiving chamber bounded by said rectangular frame of said horizontally oriented panel and truss, plural reinforcing bars disposed parallel spaced within said fourth concrete receiving chamber and between said opposite end plates of said rectangular frame, a portion of said further rigid sheeting adjacent one of said opposite edge plates of said horizontally oriented self-contained building panel and truss being deleted to define a flow-through path from said fourth concrete receiving chamber of said horizontally oriented self-contained pre-fabricated concrete and steel building panel and truss to said third concrete receiving chamber of said vertically oriented self-contained pre-fabricated concrete and steel structural building panel and truss, angle means secured between said bottom double-angle strut and said top double-angle strut of said horizontally oriented self-contained pre-fabricated building panel and truss, said fourth concrete receiving chamber thereof being capable of receiving concrete introduced thereto, said concrete passing in a vertical direction through said flow-through path to enter and fill said fourth concrete receivng chamber of said vertically oriented pre-fabricated self-contained building panel and truss whereby to define a first beam extending through a side-by-side arranged vertically oriented pre-fabricated self-contained building panel and truss, said second concrete receiving chamber of said vertically oriented self-contained pre-fabricated building panel and truss being filled with concrete introduced in a vertical direction to form a second beam extending perpendicular to said truss portion of said vertically oriented self-contained pre-fabricated building panel and truss and said forming of said second perpendicular beam being subsequent to completion of said first beam and said concrete wall thereof.

70. The combination according to claim 69 in which plural sections of rigid sheeting are disposed between said top and bottom double-angle struts of adjacent sets of top and bottom double-angle struts and bridging said bottom double-angle struts whereby to define with said rigid sheeting of said self-contained pre-fabricated building panel and truss, an enclosed additional concrete receiving chamber and a bottom plate disposed to close off said additional concrete receiving chamber whereby to enable receipt of concrete through said open top of said third concrete receiving chamber forming an additional beam parallel to said vertically oriented self-contained pre-fabricated building panel and truss.

71. The combination according to claim 70 in which elongate reinforcing bars are disposed along the length of said additional concrete receiving chamber whereby to be encased within said resulting beam.

72. In combination, upper and lower self-contained pre-fabricated building panels vertically arranged one on the other and a horizontally oriented self-contained pre-fabricated panel and truss; said lower self-contained pre-fabricated building panel comprising a skeletal assembly formed of plural parallel structural steel channels arranged in a spaced array, each channel of said spaced array having upper and lower opposite ends, central webs, inner and outer longitudinal edge flanges along the length of said central webs, top base-plate means and bottom base-plate means, said channels being seated between said top and said bottom base-plate means, first rigid sheeting disposed along the length of said central webs of said channels, selected adjacent ones of said channels having uniformly shortened length portions between said first rigid sheeting and said inner longitudinal edge flanges thereof, said channels having at least one row of spaced holes formed in said central webs thereof along the length thereof and between said first rigid sheeting and said outer longitudinal edge flanges, support means provided along said central webs of said channels adjacent said first rigid sheeting, U-shaped narrow channel members horizontally oriented between said shortened portions of said channels and secured to said central webs thereof, second rigid sheeting secured to said central webs of said shortened portions of said channels bridging said second rigid sheeting along said central webs of said shortened portions of said channels and said inner longitudinal edge flanges thereof and secured to said central webs, horizontally oriented rigid sheet portions disposed between said second rigid sheeting and said outer longitudinal edge flanges of said shortened portions of said channels bridging same, said horizontally oriented rigid sheet portions being supported upon said U-shaped narrow channel members, and a plate secured an upper portion of said longitudinal edge flanges, said plate extending from said upper ends of said shortened channels to a location coincident with said rigid sheeting portions defining a concrete receiving chamber open at the upper end thereof, said base-plate means including said top and bottom base plates, said top base plate defined by an angle having a horizontal leg and a vertical leg engaging said rigid sheeting along said central webs of said channels, said bottom base plate of said upper one of said self-contained pre-fabricated building panel and truss supporting same, said horizontally oriented self-contained building panel and truss being formed of a skeletal assembly including a rectangular frame having opposite end plates and opposite edge plates, plural spaced parallel purlins arranged between said opposite end plates and opposite edge plates, plural sets of linearly spaced top and bottom double-angle struts resting on and secured to said purlins, each set of said linearly spaced top and bottom double-angle struts being vertically aligned, rigid sheeting positioned on and secured to said purlins, rigid sheeting members positioned on and between each of said top and bottom double-angle struts and said end plates, said horizontally oriented self-contained pre-fabricated building panel and truss having a concrete receiving chamber bounded by said rectangular frame and said rigid sheeting, plural reinforcing bars disposed parallel spaced within said concrete receiving chamber and between said opposite end plates, said concrete receiving chamber of said horizontally oriented pre-fabricated building panel and truss being capable of receiving concrete therein forming a concrete wall embedding said web-reinforcement bars.

73. The combination according to claim 72 in which a portion of said rigid sheeting adjacent one edge plate of said horizontally oriented self-contained pre-fabricated building panel and truss is deleted to define a flow-through path from said concrete receiving chamber whereby concrete is introduced to said concrete receiving chamber in a vertical direction to fill same with said concrete also entering said concrete receiving chamber of said lower positioned vertically oriented self-contained pre-fabricated building panel forming a beam extending perpendicular to said channels of said lower positioned vertically oriented pre-fabricated self-contained building panel, including any side by side lower disposed vertically oriented self-contained pre-fabricated building panel.

74. The combination according to claim 72 in which said upper one of said pair of vertically oriented self-contained building panels includes a bottom base plate having a vertical leg defining an open-topped concrete receiving chamber and said bottom base plate having an opening formed therein, said horizontally oriented self-contained pre-fabricated building panel and truss having an open-topped concrete receiving chamber defined therein, an angled bolt seated within said concrete receiving chamber, said horizontally oriented self-contained pre-fabricated building panel and truss also including an elongate web-reinforcement bar having alternating upper and lower bends and reinforcing bars, tie means tying said web-reinforcing bar and said reinforcing bars together within said concrete receiving chamber of said horizontally oriented self-contained pre-fabricated building panel and truss, said angled bolt having a threaded end extending through said opening of said bottom base plate into said open-topped concrete receiving chamber, concrete being introducable in a vertical direction into said concrete receiving chamber passing through said openng to fill both said concrete receiving chamber of said horizontally oriented self-contained pre-fabricated building panel and truss and said concrete receiving chamber of said lower positioned one of said pair of vertically oriented self-contained pre-fabricated building panel whereby to define a beam within said upper one of said pair of self-contained pre-fabricated building panels, said beam extending perpendicular to said channels thereof, and a fastening member secured to said threaded end of said angle bolt subsequent to hardening of said concrete within said concrete receiving chambers.

75. The combination according to claim 72 in which plural sections of rigid sheeting are disposed between said top and bottom double-angle struts of adjacent sets of said top and bottom double-angle struts and bridging said bottom double-angle struts whereby to define, with said rigid sheeting of said pre-fabricated self-contained building panel and truss, an enclosed open-top additional concrete receiving chamber and a bottom plate is disposed to close off said additional chamber whereby to enable reception of concrete into said open-top additional concrete receiving chamber forming a base extending parallel to said pre-fabricated self-contained building panel and truss.

76. A method of forming a self-contained pre-fabricated building panel of the type including plural elongate spaced structural steel channels arranged in an array of said channels in a row, each channel having a central web and at least one longitudinal edge flange extending along the length thereof, top and bottom base-plates, said spaced channels being seated secured within at least said bottom base plate, rigid insulation boards disposed between each of said spaced channels along said longitudinal edge flanges, support means arranged between each of said spaced channels along said longitudinal edge flanges and extending adjacent said rigid insulation boards and angles secured to at least one of said longitudinal edge flanges, said base plates and adjacent said rigid insulation boards defining a framing structure including a concrete receiving chamber therewithin; said method comprising the steps of:

a) assembling said spaced channel array, base plates, rigid insulation boards and said angles defining said framing structure formed of at least a portion of said spaced channel array, said base plates and said angles bounded by said rigid insulation boards;

b) placing said completed assembly horizontally oriented on a planar surface;

c) introducing a self-hardening material into said completed assembly;

d) embedding at least a portion of said completed assembly of said channel array, base plates, rigid insulation boards and angles within said self-hardening material; and, e) permitting said self-hardening material to harden forming an outer wall of said building panel with said framing structure retained as an intimate part of said building panel.

77. The method according to claim 76 and the step of orienting said completed assembly vertically and introducing said self-hardening material in a vertical diretion into said framing structure.

78. The method according to claim 76 in which said completed assembly of channels, base plates, rigid insulation boards and said framing structure is raised to a vertical orientation and said self-hardening material is introduced in a vertical direction into said framing structure.

79. The method according to claim 76 in which said base plate is provided with a through passage; the additional steps of:

orienting said completed assembly vertically and introducing said self-hardening material in a vertical direction to said framing structure and permitting said self-hardening material to flow through said through passage into said framing structure and harden whereby to form a unitary footing of the building panel.

80. The method according to claim 76 and the step of applying rigid sheeting to the opposite side of said completed assembly whereby to define a pair of opposite walls.

81. The method according to claim 76 and the steps of;

forming a series of spaced openings in said central webs of said channels between said rigid sheeting and said longitudinal edge flanges of said channels prior to completion of said assembly and introducing service means through said openings after said building panel is completed.

82. The method according to claim 76 and the step of filling the entire interior of said framing structure with said self-hardening material with the completed assembly therein.

83. The method according to claim 76 and the step of raising said completed assembly from its horizontal orientation to a vertical orientation prior to introducing said self-hardening material in a vertical direction into said framing structure.

84. The method according to claim 76 and the steps of;

inverting the completed building panel and introducing said self-hardening material to the opposite side of said assembly while the completed building panel is horizontally oriented thereby forming a solid wall opposite the first wall.

85. The method according to claim 76 and the step of orienting said completed assembly vertically and introducing the self-hardening material in a vertical direction into said framing structure.

* * * * *